US008128189B2

(12) United States Patent
Nakata et al.

(10) Patent No.: US 8,128,189 B2
(45) **Date of Patent: *Mar. 6, 2012**

(54) POSITION DETECTING DEVICE, LIQUID EJECTING APPARATUS AND METHOD OF DETECTING SMEAR OF SCALE

(75) Inventors: Satoshi Nakata, Nagano (JP); Hitoshi Igarashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/776,850

(22) Filed: May 10, 2010

(65) Prior Publication Data

US 2010/0220138 A1 Sep. 2, 2010

Related U.S. Application Data

(63) Continuation of application No. 11/527,805, filed on Sep. 26, 2006, now Pat. No. 7,731,330.

(30) Foreign Application Priority Data

| | | |
|---|---|---|
| Sep. 26, 2005 | (JP) | 2005-277274 |
| Sep. 26, 2005 | (JP) | 2005-277275 |
| Sep. 28, 2005 | (JP) | 2005-281514 |
| Oct. 11, 2005 | (JP) | 2005-295966 |

(51) Int. Cl.
*B41J 29/393* (2006.01)

(52) U.S. Cl. ..... 347/19

(58) Field of Classification Search ..... 347/19, 347/37, 20, 5

See application file for complete search history.

(56) References Cited

U.S. PATENT DOCUMENTS

| | | | | |
|---|---|---|---|---|
| 5,302,944 | A | 4/1994 | Curtis | |
| 5,563,591 | A | 10/1996 | Jacobs et al. | |
| 6,755,499 | B2 * | 6/2004 | Castano et al. | 347/19 |
| 7,133,630 | B2 * | 11/2006 | Sakai | 399/301 |
| 7,731,330 | B2 * | 6/2010 | Nakata et al. | 347/37 |

FOREIGN PATENT DOCUMENTS

| | | | |
|---|---|---|---|
| JP | 05-069626 | A | 3/1993 |
| JP | A-8-029201 | | 2/1996 |
| JP | 9-136465 | | 5/1997 |
| JP | 2004138386 | A | 5/2004 |
| JP | 2004-160810 | | 6/2004 |
| JP | 2004-202963 | A | 7/2004 |
| JP | 2005-081691 | A | 3/2005 |
| JP | 2005-231155 | A | 9/2005 |

* cited by examiner

*Primary Examiner* — Jason Uhlenhake
(74) *Attorney, Agent, or Firm* — Nutter McClennen & Fish LLP; John J. Penny, Jr.; Christina M. Sperry

(57) ABSTRACT

A position detecting device for detecting a position of an object, includes a light emitting portion that emits light, a light receiving portion that receives the light from the light emitting portion, and a scale that is arranged between the light emitting portion and the light receiving portion, and includes a position detecting pattern and a smear detecting pattern. The position detecting pattern has a first light transmitting portion for transmitting the light from the light emitting portion and a first light interception portion for intercepting the light from the light emitting portion which are alternately arranged in a detection range of the object. The smear detecting pattern for detecting smear of the scale has a second light transmitting portion for transmitting the light from the light emitting portion and a second light interception portion for intercepting the light from the light emitting portion which are alternately arranged.

14 Claims, 35 Drawing Sheets

POSITION DETECTING DEVICE, LIQUID EJECTING APPARATUS AND METHOD OF DETECTING SMEAR OF SCALE

This application is a continuation of U.S. application Ser. No. 11/527,805, filed on Sep. 26, 2006, whose priority is claimed from Japanese Patent Application Nos. 2005-281514 filed on Sep. 28, 2005, 2005-277274 filed on Sep. 26, 2005, 2005-277275 filed on Sep. 26, 2005 and 2005-295966 filed on Oct. 11, 2005, the contents of which are hereby incorporated by reference in their entirety.

BACKGROUND OF THE INVENTION

The present invention relates to a position detecting device, a liquid ejecting apparatus having the position detecting device, and a method of detecting the smear of a scale of the position detecting device.

There is known an ink jet printer as a liquid ejecting apparatus for ejecting a liquid to a predetermined medium of paper or the like. The ink jet printer is mounted with various motors of a sheet feeding motor for driving a carry roller for carrying printing sheet constituting a medium, a carriage motor for driving a carriage mounted with a printing head and the like. As such a motor, a DC motor is widely utilized with an object of calm sound formation or the like. The ink jet printer mounted with the DC motor includes a photosensor having a light emitting element and a light receiving element, and an encoder constituted by a scale alternately formed with a light transmitting portion for transmitting light from the light emitting element and a light interception portion for intercepting the light from the light emitting element as a position detecting device for carrying out a position control, a speed control or the like of the DC motor.

Further, according to the ink jet printer, it is known that when ink drops are delivered from a printing head, during a time period until the ink drops reach a printing face of a printing sheet or the like, or when the ink drops reach the printing face, ink mist floating in air by constituting portions of the ink drops in a mist-like form is produced and the produced ink mist is adhered to respective constitutions at inside of the printer. When the ink mist is adhered to a scale constituting the encoder, by an influence of the ink mist, the scale cannot pertinently transmit or block light emitted from the light emitting element. Hence, there is proposed an ink jet printer including a position detecting accuracy maintaining apparatus for maintaining a detecting accuracy of a linear encoder (refer to, for example, Patent Reference 1). Patent Reference 1 discloses a block plate arranged to block an interval between an ink ejection face of a printing head and a linear scale. Further, Patent Reference 2 discloses a constitution for correcting a duty ratio of an output signal outputted from a light receiving element becomes 50% even when the duty ratio is reduced by adhering ink mist.

[Patent Reference 1] JP-A-2005-81691 (refer to summary and paragraph No. 0032, FIG. 3 and the like)

[Patent Reference 2] JP-A-2004-202963 (refer to summary and paragraph Nos. 0034 through 0040, FIG. 3 through FIG. 5 and the like)

According to the linear encoder disclosed in Patent Reference 1, the detecting accuracy can be maintained by restraining the ink mist from adhering to the linear scale by the block plate. However, Patent Reference 1 does not propose specific means for detecting adherence per se of the ink mist to the linear scale (that is, smear of linear scale).

Further, although the constitution for correcting the signal is disclosed in Patent Reference 2, similar to Patent Reference 1, a degree of smear cannot be detected. Further, also in Patent Reference 2, with regard to the adherence of the ink mist to the rotary encoder, the adherence is not taken into consideration at all.

The invention has been carried out based on the above-described situation and it is an object thereof to provide a position detecting device including a scale capable of detecting a degree of smear and capable of preventing erroneous detection at a light receiving portion, a liquid ejecting apparatus including the position detecting device, and a method of detecting smear of a scale of the position detecting device.

SUMMARY OF THE INVENTION

In order to achieve the above object, according to the present invention, there is provided a position detecting device for detecting a position of an object, comprising:

a light emitting portion that emits light;

a light receiving portion that receives the light from the light emitting portion; and a scale that is arranged between the light emitting portion and the light receiving portion, and includes a position detecting pattern and a smear detecting pattern, wherein the position detecting pattern has a first light transmitting portion for transmitting the light from the light emitting portion and a first light interception portion for intercepting the light from the light emitting portion which are alternately arranged in a detection range of the object; and wherein the smear detecting pattern for detecting smear of the scale has a second light transmitting portion for transmitting the light from the light emitting portion and a second light interception portion for intercepting the light from the light emitting portion which are alternately-arranged.

According to the above configuration, the smear of the linear scale can be detected from a result of detection at the light receiving portion of the light emitted from the light emitting portion and transmitted through the second light transmitting portion. Further, by detecting smear, for example, presence or absence of a necessity of cleaning the linear scale can be confirmed, or a measure for preventing an erroneous operation of the detected object which can be brought about by a failure in detecting the position owing to smear of the linear scale can be taken.

Preferably, the scale is a linear scale having a long plate shape. The smear detecting pattern is arranged at an outer side of the position detecting pattern in a longitudinal direction of the linear scale.

According to the above configuration, the smear of the linear scale can be detected without effecting an influence on detection of the position of the detected object. Further, smear of the linear scale can be detected by a simple constitution of relatively moving the light emitting portion and the light receiving portion relatively moved in the longitudinal direction of the linear scale when the position of the detected object is detected further in the longitudinal direction of the linear scale.

Preferably, the scale is a linear scale having a long plate shape. The smear detecting pattern is arranged so as to be contiguous to the position detecting pattern in a width direction of the linear scale.

According to the above configuration, the smear of the linear scale can be detected from a result of detection at the light receiving portion of light emitted from the light emitting portion and transmitted through the second light transmitting portion. Further, by detecting smear, for example, presence or absence of a necessity of cleaning the linear scale can be confirmed, or a measure for preventing erroneous operation of the detected object which can be brought about by a failure in detecting the position owing to smear of the linear scale can be taken.

Preferably, the scale is a rotary scale having a circular plate shape. The smear detecting pattern is arranged at an inner diameter side of the rotary scale with respect to the position detecting pattern.

According to the above configuration, in normally detecting the position, the photosensor detects the position detecting pattern disposed on an outer diameter side and in detecting smear, the photosensor detects the smear detecting pattern disposed on the inner diameter side. Thereby, the inner diameter side of the rotary encoder can effectively be utilized for detecting smear.

Preferably, the second light transmitting portion is formed with a light interception pattern so that a light transmitting area of the second light transmitting portion into which the light from the light emitting portion transmits is smaller than that of the first light transmitting portion or a light transmittivity in the second light transmitting portion is smaller than a light transmittivity in the first light transmitting portion.

According to the above configuration, a portion of intercepting light is made to be easy to be produced at a portion of the linear scale in the longitudinal direction at the second light transmitting portion by the smear of the linear scale in comparison with the first light transmitting portion. That means, light is made to be easy to be blocked at the second light transmitting portion by smear of the linear scale in comparison with the first light transmitting portion. Therefore, at the first light transmitting portion used for detecting the position of the detected object, before light is blocked by a portion or a total in the longitudinal direction of the linear scale and erroneous detection is brought about at the position detecting apparatus, smear of the linear scale can be detected from a result of detection at the light receiving portion of light transmitted through the second light transmitting portion.

Preferably, the light transmitting area of the second light transmitting portion constitutes a constant rate relative to the transmitting area of the first light transmitting portion, or the light transmittivity of the second light transmitting portion constitutes a constant rate relative to the light transmittivity of the first light transmitting portion.

According to the above configuration, a detection limit of the position detecting apparatus can be recognized. That is, when constituted in this way, smear is detected by the position detecting apparatus and the rate of transmitting area or the transmittivity of the light at the second light transmitting portion when erroneous detection is brought about at the position detecting apparatus can be investigated. Therefore, from the rate of the transmitting area or the transmittivity of the light at the second light transmitting portion, there can be recognized a detection limit of the position detecting apparatus of by what degree of smear is brought about, erroneous detection is brought about by the position detecting apparatus.

Preferably, the light interception pattern is changed so that the light transmitting area or the light transmittivity in the smear detecting pattern is changed.

According to the above configuration, at the second light transmitting portion having a comparatively small transmitting area or a comparatively low transmittivity, light is blocked by smear of the linear scale at a comparatively early stage, at the second light transmitting portion having a comparatively large transmitting area or a comparatively high transmittivity, light is blocked at a comparatively later stage. Therefore, a degree of smear brought about at the linear scale can be detected. Further, by detecting the degree of smear brought about at the linear scale, a change over time of smear brought about at the linear scale can be grasped. As a result, a time period or the like until finally bringing about erroneous detection by the position detecting apparatus can be predicted. Further, by detecting the degree of smear brought about at the linear scale, a detection limit of the position detecting apparatus of by what degree of smear is brought about, erroneous detection is brought about at the position detecting apparatus can be recognized.

Preferably, the scale is a linear scale having a long plate shape. The light interception pattern in the smear detecting pattern is changed along a longitudinal direction of the linear scale.

According to the above configuration, the degree of smear brought about at the linear scale can be detected by a simple constitution of utilizing movement of the light emitting portion and the light receiving portion relatively moved in the longitudinal direction of the linear scale when the position of the detected object is detected.

Preferably, the scale is a linear scale having a long plate shape. The light interception pattern in the smear detecting pattern is changed along a width direction of the linear scale.

According to the above configuration, the position detecting apparatus can be downsized in the longitudinal direction of the linear scale.

Preferably, the scale is a rotary scale having a circular plate shape. The light interception pattern in the smear detecting pattern is changed along a tangential line direction or a diameter direction of the rotary scale.

According to the above configuration, by changing the light interception pattern, at the second light transmitting portion having a comparatively small transmitting area or a comparatively low transmittivity, light is blocked by smear of the rotary scale at a comparatively early stage. Further, at the second transmitting portion having a comparatively large transmitting area or a comparatively high transmittivity, light is blocked at a comparatively later stage. Therefore, the degree of smear brought about at the rotary scale can easily be detected. Further, by detecting the degree of smear brought about at the rotary scale, a change over time of smear brought about at the rotary scale can be grasped. As a result, a time period until bringing about erroneous detection finally at the position detecting apparatus can be predicted. Further, by detecting the degree of smear brought about at the rotary scale, there can be recognized a detection limit of the position detecting apparatus of to what degree of the smear is brought about, erroneous detection is brought about at the position detecting apparatus.

Preferably, the scale is a linear scale having a long plate shape. The light interception pattern includes a light interception portion having skewed line shape, the light interception portion being inclined to a longitudinal direction of the linear scale.

According to the above configuration, smear of the linear scale can simply and pertinently be detected. That is, in a case in which the light interception pattern is formed by a light interception portion in parallel with the longitudinal direction of the linear scale, when positions of an optical axis of the light emitting portion and the light interception portion are shifted from each other in a short side direction of the linear scale, relative to the first light transmitting portion, the transmitting area of light of the second transmitting portion cannot be reduced, or the transmittivity of light cannot be made to be low. Further, when the light interception pattern is formed by a light interception portion orthogonal to the longitudinal direction of the linear scale, the light interception portion becomes a portion in the longitudinal direction of intercepting the light. Therefore, at the second light transmitting portion, it is difficult to form a portion of intercepting the light by smear at a portion in the longitudinal direction. Further, a processing for detecting smear of the linear scale becomes complicated. Therefore, when the light interception pattern is formed by the light interception portion in the shape of the skewed line, smear of the linear scale can simply and pertinently be detected.

Preferably, the scale is a rotary scale having a circular plate shape. The light interception pattern includes a light interception portion having a rectangular shape, the light interception portion being inclined to a tangential line direction of the rotary scale.

According to the above configuration, smear of the rotary scale can simply and pertinently be detected. Here, in a case in which the light interception pattern is formed by a light interception portion along the tangential line direction of the rotary scale, when an optical axis of the light emitting portion is varied along the diameter direction of the rotary scale, relative to the first light transmitting portion, the transmitting area of light of the light transmitting portion cannot be made to be small, or the transmittivity of light cannot be made to be low. Further, when the light interception pattern is formed by a light interception portion along the diameter direction of the rotary scale, it is difficult to determine a boundary portion with the second light interception portion and there is a concern of bringing about erroneous detection at the position detecting pattern. In contrast thereto, when the light interception portion is skewedly formed, there is not brought about a drawback as in a case in which the light interception portion is along the tangential line direction or the diameter direction, and smear of the rotary scale can simply and pertinently be detected.

Preferably, the light interception pattern includes a light interception portion in a rectangle shape and a light transmitting portion in a rectangle shape which are arranged in a checker pattern.

According to the above configuration, the light interception pattern is easily formed.

Preferably, the second light transmitting portion is smaller in width than the first light transmitting portion.

According to the above configuration, by smear of the linear scale, at the second light transmitting portion, in comparison with the first light transmitting portion, light is made to be easy to be blocked. Therefore, at the fist light transmitting portion used for detecting the position of the detected object, light is blocked by a portion or a total in the longitudinal direction of the linear scale, before bringing about erroneous detection by the position detecting apparatus, smear of the linear scale can be detected from a result of detection at the light receiving portion of light transmitted through the second light transmitting portion.

Preferably, a width of the second light transmitting portion is changed.

According to the above configuration, the width of the second light transmitting portion is changed at the smear detecting pattern. Therefore, at the second light transmitting portion having a comparatively narrow width, light is blocked by smear of the linear scale at a comparatively early stage, at the second light transmitting portion having a comparatively wide width, light is blocked at a comparatively later stage. Therefore, a degree of smear brought about at the linear scale can be detected. Further, by detecting the degree of smear brought about at the linear scale, a change over time can be grasped, and a time period or the like until finally brining about erroneous detection by the position detecting apparatus can be predicted. Further, by detecting the degree of smear brought about at the linear scale, a detection limit of the position detecting apparatus can be recognized.

Preferably, the scale is a rotary scale having a circular plate shape. The width of the second light transmitting portion is changed along a tangential line direction or a diameter direction of the rotary scale.

According to the above configuration, at the second light transmitting portion having the comparatively narrow width, light is blocked by the smear of the rotary scale at a comparatively early stage, at the second light transmitting portion having the comparatively wide width, light is blocked at a comparatively later stage. Therefore, the degree of smear brought about at the rotary scale can be detected. Further, by detecting the degree of smear brought about at the rotary scale, a change over time of smear brought about at the rotary scale can be grasped, and a time period or the like until finally bringing about erroneous detection at the position detecting apparatus can be predicted. Further, by detecting the degree of smear brought about at the rotary scale, the detection limit of the position detecting apparatus can be recognized.

Preferably, the position detecting device further includes a light amount controlling unit that controls to increase an amount of the light emitted from the light emitting portion when smear of the scale is detected.

According to the above configuration, even when the linear scale is smeared, by a simple constitution of increasing the light emitting amount from the light emitting portion, light from the light emitting portion is made to be easy to be transmitted through the first light transmitting portion. Therefore, the detected object can pertinently be detected.

Preferably, the position detecting device further includes a sensor position switching unit that moves a photosensor having the light emitting portion and the light receiving portion to switch a state of detecting the position detecting pattern and a state of detecting the smear detecting pattern.

According to the above configuration, when switched to the state of detecting the smear detecting pattern by the photosensor, a degree of smear of the rotary scale can be detected from a detection result at the light receiving portion of the light emitted from the light emitting portion and transmitted through the second light transmitting portion. Further, both of detection of the position and detection of the degree of smear can be carried out by the single rotary scale. Further, by detecting the degree of smear, for example, presence or absence of a necessity of cleaning the rotary scale can be confirmed, or there can be carried out a measure for preventing erroneous operation of the detected object which can be brought about by a failure in detecting the position owing to smear of the rotary scale.

Preferably, the sensor position switching unit includes an arm which supports the photosensor at one end side thereof, an eccentric cam which has a cam face in which a distance from a center of rotation is changed in accordance with a rotational position, the cam face being brought into contact with other end side of the arm, and a pivoting shaft which is disposed between the one end side and the other end side of the arm for supporting the arm pivotably.

According to the above configuration, the arm can be pivoted centering on the pivoting shaft, and a position of the photosensor opposed to the rotary encoder can be switched.

According to the present invention, there is also provided a liquid ejecting apparatus comprising;

the position detecting device; and a liquid ejection portion that ejects a liquid to a medium.

According to the above configuration, the position detecting apparatus of the invention can be used in a liquid ejecting apparatus having a liquid ejection portion for ejecting a liquid to a predetermined medium. According to the liquid ejecting apparatus, smear of the linear scale brought about by the liquid delivered from the liquid ejection portion can be detected. Further, a measure for preventing erroneous operation of the detected object owing to smear of the linear scale can be taken.

Preferably, the scale is a linear scale having a long plate shape, the smear detecting pattern is arranged so as to be contiguous to the position detecting pattern in a width direction of the linear scale. The linear scale is arranged so that a width direction of the linear scale is same as a height direction of the liquid ejecting apparatus. The smear detecting pattern is arranged on a lower side of the position detecting pattern in the height direction.

According to the above configuration, at the first light transmitting portion, light is blocked by a portion or a total in the longitudinal direction of the linear scale, and before erroneous detection is brought about at the position detecting apparatus, smear of the linear scale can firmly be detected from a result of detection at the light receiving portion of light transmitted through the second light transmitting portion.

According to the present invention, there is also provided the liquid ejecting apparatus further includes a scale lifting unit that moves down the scale in a first direction when smear of the scale is detected. The scale is a linear scale having a long plate shape. The linear scale is arranged so that a width direction of the linear scale is same as the first direction.

According to the above configuration, when the scale lifting mechanism moves down the linear scale when smear of the linear scale is detected, the position of the detected object can be detected by utilizing an upper side portion of the linear scale which is less adhered with the liquid. Therefore, the detected object can pertinently be detected.

According to the present invention, there is also provided a method of detecting smear of a scale having a position detecting pattern and a smear detecting pattern of a position detecting device, the method comprising:

detecting the scale by a photosensor while the photosensor is relatively moved with respect to the scale;

obtaining a signal detected by the photosensor; and determining whether the scale is smeared or not based on the obtained signal.

Preferably, it is determined that the scale is smeared when a period or a frequency of a part of the signal corresponding to the smear detecting pattern is deviated from a predetermined range of a basis period or a basis frequency.

Preferably, it is determined that the scale is smeared when a phase of the signal corresponding to the smear detecting pattern is reversed.

Preferably, the method further includes a process of performing at least one of operations when it is determined that the scale is smeared, the operations being as follows:

halting a liquid ejecting operation of a liquid ejecting apparatus provided with the position detecting device;

setting an upper limit of a moving speed of the carriage provided with the photosensor so as to move the carriage slower than that of the carriage at the detecting time;

increasing an light amount emitted from the photosensor for detecting the scale;

moving down the scale relative to the photosensor to detect other area in the scale; and cleaning the scale.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

An explanation will be given of a position detecting device and a liquid ejecting apparatus according to an embodiment of the invention in reference to the drawings as follows.

(Outline Constitution of Liquid Ejecting Apparatus)

Figure 1:
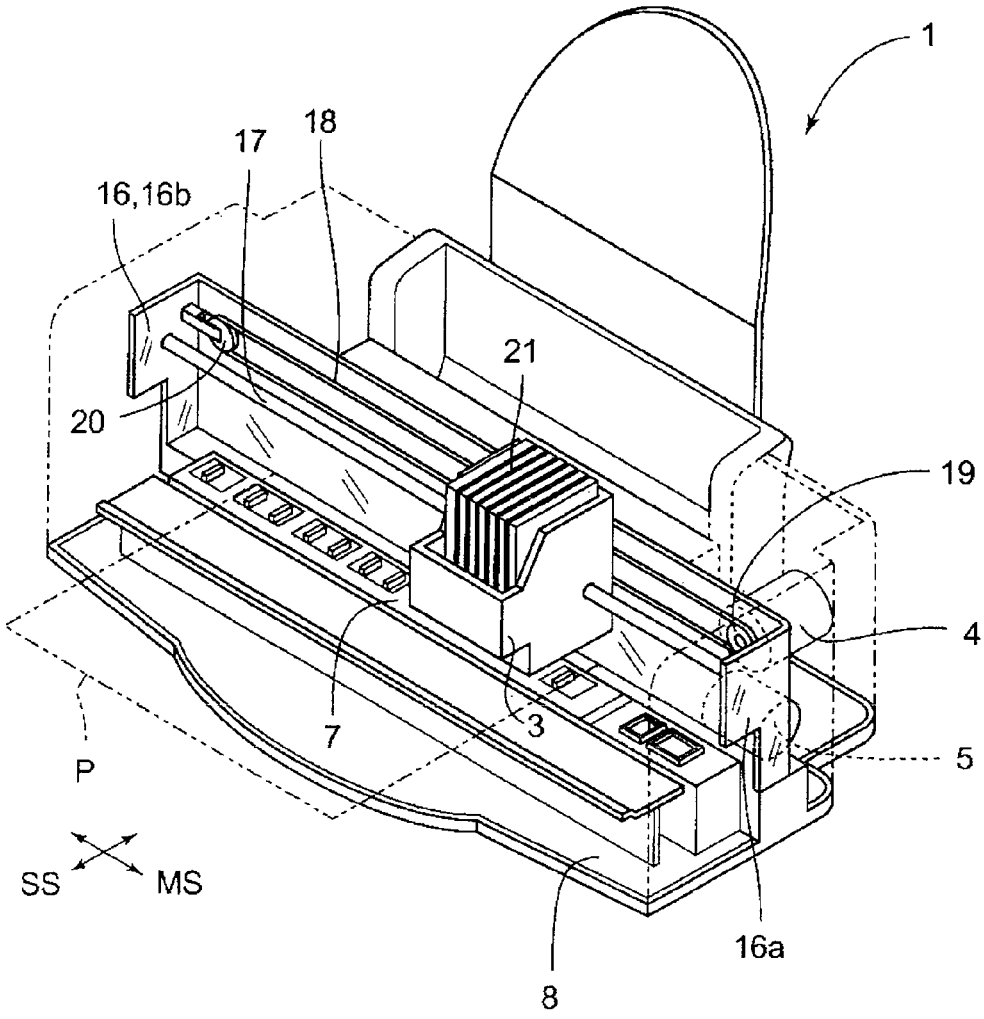
FIG. 1 is a perspective view showing an outline constitution of a liquid ejecting apparatus (printer) according to an embodiment.
Figure 2:
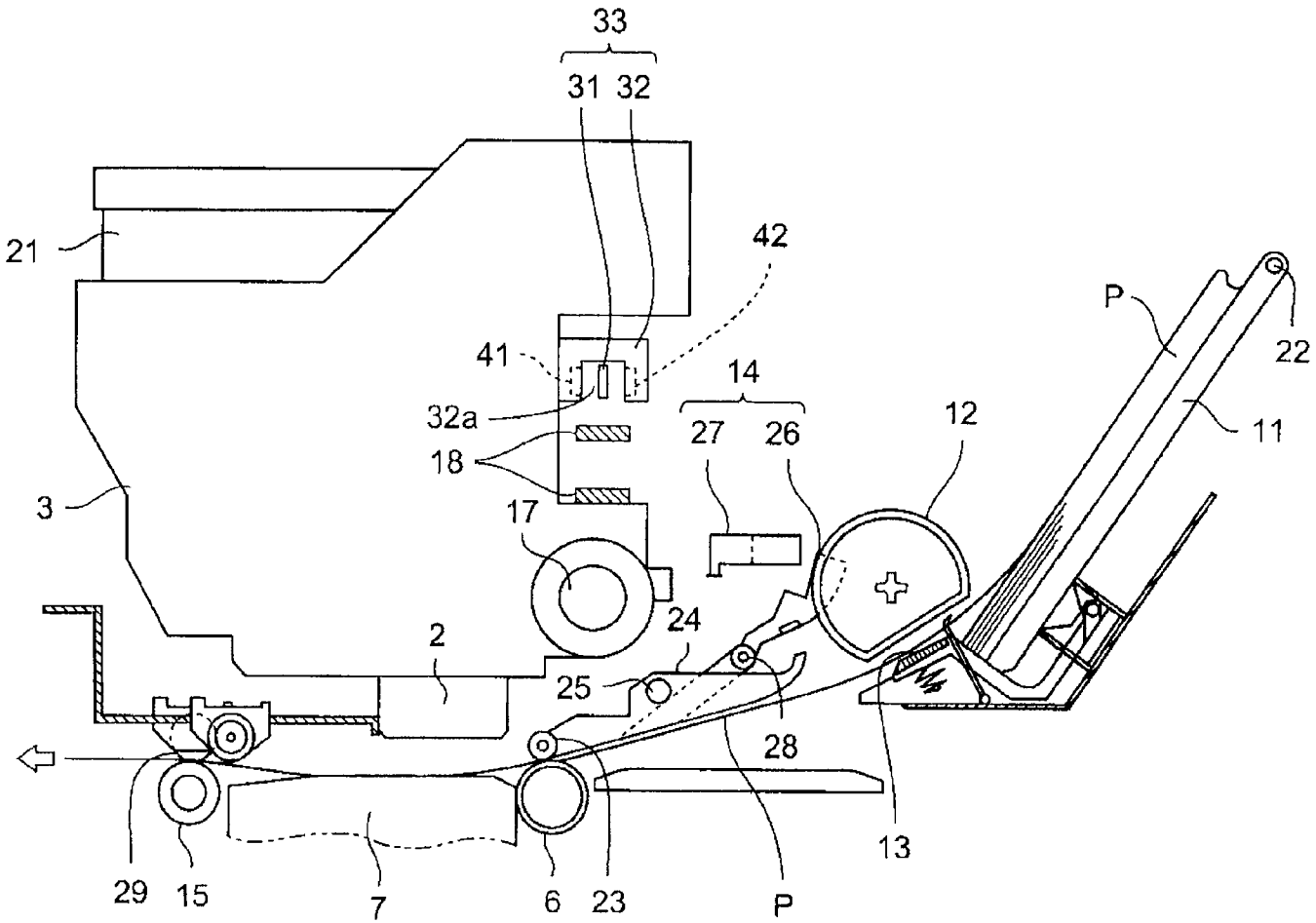
FIG. 2 is an outline side view showing an outline constitution of a portion with regard to sheet feeding of the printer of FIG. 1.
Figure 3:
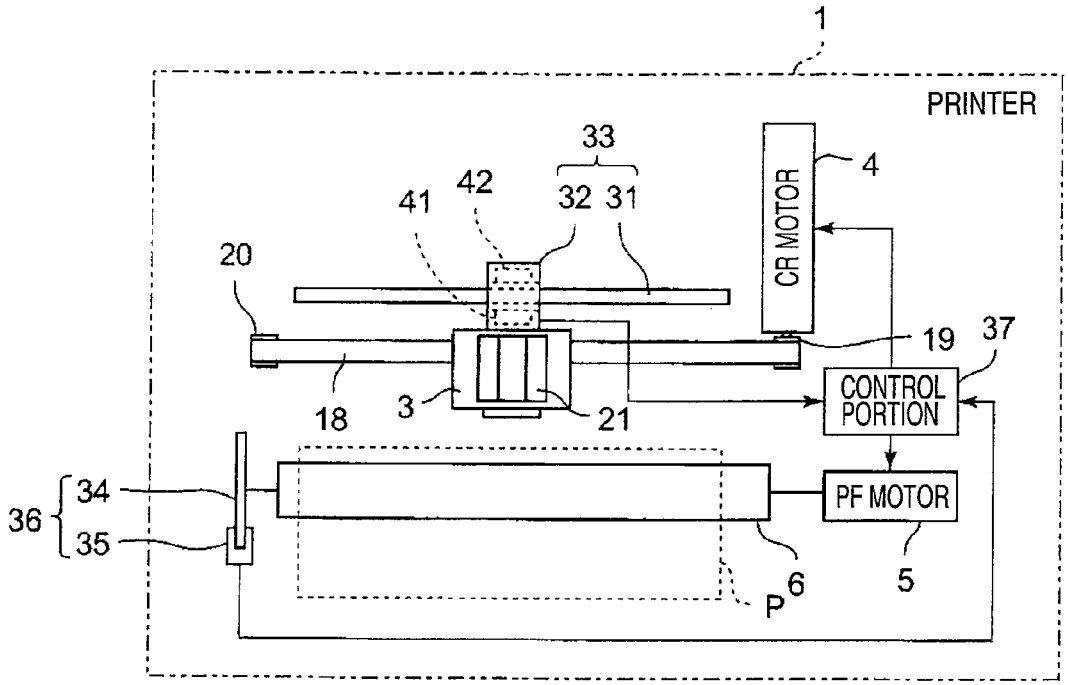
FIG. 3 is an outline constitution view showing a carriage of FIG. 1 and a mechanism of detecting a PF drive roller of FIG. 2.

FIG. 1 is a perspective view showing an outline constitution of a liquid ejecting apparatus (printer) 1 according to an embodiment of the invention. FIG. 2 is an outline side view showing an outline constitution of a portion with regard to sheet feeding of the printer 1 of FIG. 1. FIG. 3 is an outline constitution view schematically showing a mechanism for detecting a carriage 3 of FIG. 1 and a PF drive roller 6 of FIG. 2.

The liquid ejecting apparatus 1 according to the embodiment is an ink jet printer for printing by ejecting ink in a liquid state to a printing sheet P or the like as a medium. In the following, the liquid ejecting apparatus 1 of the embodiment is designated as the printer 1. As shown by FIG. 1 through FIG. 3, the printer 1 according to the embodiment includes the carriage 3 mounted with a printing head 2 for ejecting ink drops, a carriage motor (CR motor) 4 for driving the carriage 3 in a main scanning direction MS, the PF drive roller 6 connected to the PF motor 5, a platen 7 arranged to be opposed to a nozzle face (lower face of FIG. 2) of the printing head 2 and a main body chassis 8 mounted with the constitutions. According to the embodiment, both of the CR motor 4 and the PF motor 5 are direct current (DC) motors.

Further, as shown by FIG. 2, the printer 1 includes a hopper 11 mounted with the printing sheet P before printing, a sheet feeding roller 12 and a separating pad 13 for taking the printing sheet P mounted on the hopper 11 to inside of the printer 1, a sheet detector 14 for detecting passing of the printing sheet P taken to inside of the printer 1 from the hopper 11, and a discharge drive roller 15 for discharging the printing sheet P from inside of the printer 1.

Further, according to the printer 1, a right side of FIG. 1 (this side of paper face of FIG. 2) constitutes a home position side of the carriage 3. In the following, the home position side of the carriage 3 of the printer 1 is designated by as 0 column side and a side of the carriage 3 of the printer 1 opposed to the home position (left side of FIG. 1, depth side of paper face of FIG. 2) is designated as 80 column side.

The carriage 3 is constituted to be able to be carried in the main scanning direction MS by a guide shaft 17 supported by a support frame 16 fixed to the main body chassis 8, and a timing belt 18. The timing belt 18 is fixed to the carriage 3 at a portion thereof (refer to FIG. 2) and is arranged to provide a constant tension in a state of being hung by a pulley 19 attached to an output shaft of the CR motor 4 and a pulley 20 rotatably attached to the support frame 16. The guide shaft 17 slidably holds the carriage 3 to guide the carriage 3 in the main scanning direction MS. Further, the carriage 3 is mounted with an ink cartridge 21 containing various inks supplied to the printing head 2 in addition to the printing head 2.

The printing head 2 is arranged with a plurality of nozzles illustration of which is omitted. Further, the printing head 2 is arranged with a piezoelectric element (not illustrated) constituting one of electrorestrictive elements and excellent in response to correspond to each nozzle. Specifically, the piezoelectric element is arranged at a position in contact with a wall face forming an ink path (not illustrated). Further, the printing head 2 delivers an ink drop from the nozzle arranged at an end portion of the ink path by pressing the wall face by operating the piezoelectric element. In this way, according to the embodiment, the printing head 2 constitutes a liquid ejection portion for ejecting an ink in a liquid state to the printing sheet P. Further, the ink cartridge 21 is contained with, for example, a die species ink excellent in color development and excellent in an image quality, a pigment species ink excellent in waterproof and lightproof or the like, and the die species ink or the pigment species ink or the like is delivered from the printing head 2.

The sheet feeding roller 12 is connected to the PF motor 5 by way of a gear, not illustrated, and is driven by the PF motor 5. As shown by FIG. 2, the hopper 11 is a plate-like member capable of mounting the printing sheet P and is made to be pivotable centering on a pivoting shaft 22 provided at an upper portion thereof by a cam mechanism, not illustrated. Further, by pivoting by the cam mechanism, a lower end portion of the hopper 11 is elastically brought into press contact with the sheet feeding roller 12 and separated from the sheet feeding roller 12. The separating pad 13 is formed by a member having a high friction coefficient and is arranged at a portion opposed to the sheet feeding roller 12. Further, when the sheet feeding roller 12 is rotated, a surface of the sheet feeding roller 12 and the separating pad 13 are brought into press contact with each other. Therefore, when the sheet feeding roller 12 is rotated, a topmost one of the printing sheet P of the printing sheets P mounted on the hopper 11 is fed to a sheet discharge side by passing the portion of bringing the surface of the sheet feeding roller 12 and the separating pad 13 into press contact with each other, however, the printing sheet P mounted secondly from the top and thereafter are hampered from being carried to the sheet discharge side by the separating pad 13.

The PF drive roller 6 is connected to the PF motor 5 directly or by way of a gear, not illustrated. Further, as shown by FIG. 2, the printer 1 is provided with a PF driven roller 23 for carrying the printing sheet P along with the PF drive roller 6. The PF driven roller 13 is pivotably held on a sheet discharge side of a driven roller holder 24 constituted pivotably centering on a rotary shaft 25. The driven roller holder 24 is urged in the counterclockwise direction of the illustration by a spring, not illustrated, such that the PF driven roller 23 is always exerted with an urge force directed to the PF drive roller 6. Further, when the PF drive roller 6 is driven, the PF driven roller 23 is also rotated along with the PF drive roller 6.

As shown by FIG. 2, the sheet detector 24 is constituted by a detecting lever 26 and a sensor 27 and is provided at a vicinity of the driven roller holder 24. The detecting lever is made pivotable centering on the pivoting shaft 28. Further, when the printing sheet P has finished to pass through a lower face side of the detecting lever 26 from a state of passing the printing sheet P shown in FIG. 2, the detecting lever 26 is pivoted in the counterclockwise direction. There is constructed a constitution in which when the detecting lever 26 is pivoted, passing of the printing sheet P can be detected by intercepting light directed from a light emitting portion to a light receiving portion of the sensor 27.

The sheet discharge drive roller 15 is arranged on the sheet discharge side of the printer 1 and connected to the PF motor 5 by way of a gear, not illustrated. Further, as shown by FIG. 2, the printer 1 is provided with a sheet discharge driven roller 29 for discharging the printing sheet P along with the sheet discharge drive roller 15. Also the sheet discharge driven roller 29 is always exerted with an urge force directed to the sheet discharge drive roller 15 by a spring, not illustrated, similar to the PF driven roller 23. Further, when the sheet discharge drive roller 15 is driven, also the sheet discharge driven roller 29 is rotated along with the sheet discharge drive roller 15.

Further, as shown by FIGS. 2 and 3, the printer 1 includes a linear encoder 33 having a linear scale 31 and a photosensor 32 as a position detecting device for detecting a position of the carriage 3 or a speed or the like of the carriage 3 in a main scanning direction MS. Further, as shown by FIG. 3, the printer 1 includes a rotary encoder 36 having a rotary scale 34 and a photosensor 35 as a position detecting device for detecting a position of printing sheet P or a speed of carrying the printing sheet P or the like in a sub scanning direction SS. As shown by FIG. 3, signals outputted from the linear encoder 33 and the rotary encoder 36 are inputted to a control portion 37 to carry out various controls of the printer 1. Further, according to the embodiment, the carriage 3 constitutes a detected object a position of which is detected by the linear encoder 33. Further, in FIG. 1, illustration of the linear scale 31 is omitted for convenience of explanation.

A linear scale 31 is formed in an elongated shape (shape of a slender linear line) from a thin plate of a transparent resin or the like. The linear scale 31 is attached to a support frame 16 in parallel with the main scanning direction MS. That is, according to the printer 1, the linear scale 31 is attached to the support frame 16 in a state of constituting a height direction by a short side direction of the linear scale 31. Further, the linear scale 31 is constructed by a constitution of being able to be moved in an up and down direction relative to the support frame 16 by a scale lifting mechanism 44 (refer to FIG. 4 and the like) mentioned later.

As shown by FIG. 2 and FIG. 3, a photosensor 32 constituting a linear encoder 33 includes a light emitting portion 41 and a light receiving portion 42 and is fixed to the carriage 3. Specifically, the photosensor 32 is fixed to a back face (face on depth side of paper face of FIG. 1) of the carriage 3. Detailed constitutions of the linear scale 31 and the photosensor 32 will be described later.

A photosensor 35 constituting the rotary encoder 36 includes a light emitting portion having a light emitting element (not illustrated) and a light receiving portion having a light receiving element (not illustrated) and is fixed to the main body chassis 8 or the like by way of a bracket, not illustrated.

The rotary scale 34 is formed in a shape of a circular disk by, for example, a thin steel plate made of stainless steel or a thin plate made of transparent resin. The rotary scale 34 of the embodiment is attached to a PF drive roller 6. That is, when the PF drive roller 6 is rotated by one rotation, also the rotary scale 34 is rotated by one rotation. The rotary scale 34 is alternately formed with a light transmitting portion (not illustrated) for transmitting light from a light emitting element of a photosensor 35 and a light interception portion (not illustrated) for intercepting the light from the light emitting element of the photosensor 35 along a circumferential direction. Further, at the rotary encoder 36, a light receiving element receives the light emitted from the light emitting element to the rotary scale 34 and transmitted through the light transmitting portion of the rotary scale 34 to output a predetermined output signal.

Further, when the rotary scale 34 is formed by the thin plate of the transparent resin, by subjecting a surface thereof to printing of a predetermined width along the circumferential direction by a predetermined pitch, the light transmitting portion and the light interception portion can be formed. Further, when the rotary scale 34 is formed by the thin steel plate made of stainless steel, by forming a slit hole penetrated through the thin steel plate along a circumferential direction by the predetermined pitch, the light transmitting portion and the light interception portion can be formed. Further, the rotary scale 34 may be connected to the PF drive roller 6 by way of a gear or the like. However, by directly attaching the rotary scale 34 to the PF drive roller 6 to be rotated integrally therewith, an amount of rotating the rotary scale 34 and an amount of rotating the PF drive roller can be corresponded to each other accurately by a one to one relationship without including an error of play (rattle) or the like brought about at a portion of a gear brought in mesh therewith.

A control portion 37 includes various memories of ROM and RAM and the like and circuits of driving the various motors and the like, CPU, ASIC and the like. CPU and ASIC and the like are inputted with respective output signals from the linear encoder 33, the rotary encoder 36 and the like.

(Constitution of Scale Lifting Mechanism)

Figure 4:
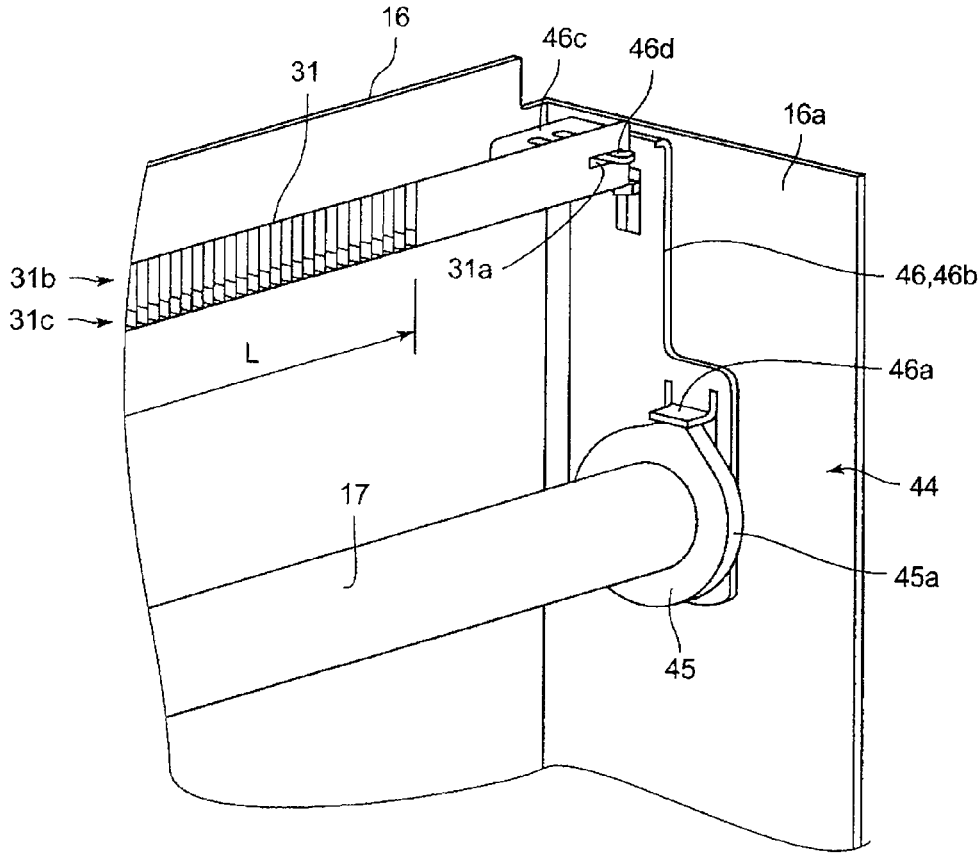
FIG. 4 is an outline perspective view showing a state of attaching one end portion of a linear scale of FIG. 3.
Figure 5:
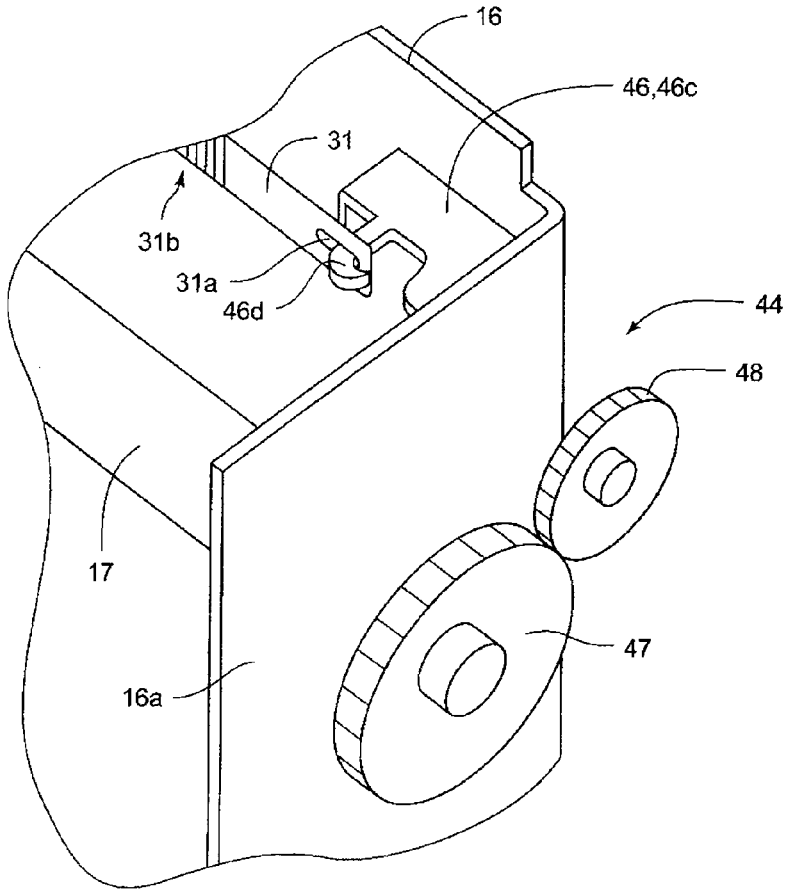
FIG. 5 is an outline perspective view showing a state of attaching the one end portion of the linear scale from a depth side of a paper face of FIG. 4.
Figure 6:
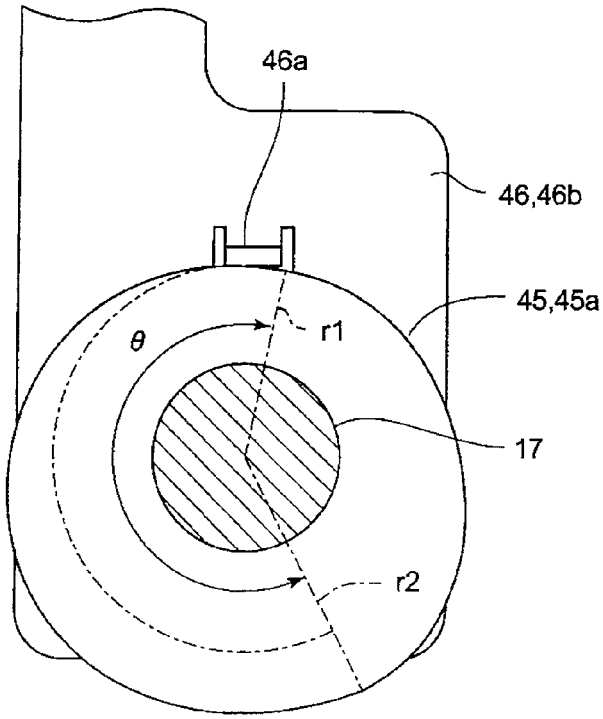
FIG. 6 is a view showing a relationship between a cam and an attaching bracket of FIG. 4.

FIG. 4 is an outline perspective view showing a state of attaching one end portion of the linear scale 31 of FIG. 3. FIG. 5 is an outline perspective view showing the state of attaching the one end portion of the linear scale 31 from a depth side of paper face of FIG. 4. FIG. 6 is a view showing a relationship between a cam 45 and an attaching bracket 46 of FIG. 4.

The printer 1 of the embodiment includes a scale lifting mechanism 44 for moving up and down the linear scale 31 relative to the support frame 16. That is, the linear scale 31 is made to be able to be moved up and down relative to the support frame 16 by the scale lifting mechanism 44. That is, according to the embodiment, the linear scale 31 in an initial state is arranged at, for example, a position proximate to an upper limit position and is made to be able to be moved up and down by the scale lifting mechanism 44.

As shown by FIG. 4, FIG. 5, the scale lifting mechanism 44 includes an eccentric cam 45 fixed to the guide shaft 17 on an inner side of one side face 16*a* (right side face of FIG. 1) of the support frame 16, the attaching bracket 46 attached to one end portion (end portion on 0 column side) of the linear scale 31 and moved up and down by the eccentric cam 45 along with the linear scale 31, a driven gear 47 fixed to a front end of the guide shaft 17 on an outer side of the one side face 16*a*, and a middle gear 48 for transmitting power of a drive motor (not illustrated) to the driven gear 47 on a side of the one side face 16*a*. Further, the scale lifting mechanism 44 is provided with the eccentric cam 45, the attaching bracket 46, the driven gear 47, the middle gear 48 and the drive motor (not illustrated) similarly also on a side of the other side face 16*b* (left side face of FIG. 1, refer to FIG. 1). Constitutions of these are common to constitutions provided on the side of the one face 16*a* and therefore, illustration and explanation thereof will be omitted as follows. Further, in FIG. 1, illustration of the scale lifting mechanism 44 is omitted for convenience of explanation.

According to the embodiment, the driven gear 47 fixed to the guide shaft 17 is rotated by the power of the drive motor (not illustrated) transmitted by way of the middle gear 48. That is, the guide shaft 17 is rotated along with the driven gear 47. Further, also the eccentric cam 45 fixed to the guide shaft 17 is rotated. Further, the middle gear 48 may directly be connected to the drive motor, or may be connected to the drive motor by way of a predetermined gear train.

The eccentric cam 45 is a member substantially in a state of a circular disk formed with a cam face 44*a* on an outer peripheral side thereof. As shown by FIG. 6, for example, the eccentric cam 45 is formed such that a radius relative to a center of rotation is continuously changed from a radius r1 to a radius r2 larger than the radius r1 in a predetermined angle range θ.

The attaching bracket 46 is formed by, for example, a metal member in a flat plate shape, and is constituted by a base portion 46*b* formed with a contact portion 46*a* brought into contact with the cam face 46*a* of the eccentric cam 45, and an attaching portion 46*c* attached with an end portion of the linear scale 31.

The base portion 46*b* is formed with a through hole (not illustrated) in a shape of a long hole prolonged in an up and down direction for inserting the guide shaft 17. The through hole is formed such that the attaching bracket 46 can be moved in an up and down direction relative to the guide shaft 17. As shown by FIG. 4, the base portion 46*b* is interposed to be arranged between the eccentric cam 45 and the one side face 16*a* of the support frame 16 in a state of inserting the guide shaft 17 into the through hole. Further, the contact portion 46*a* is formed to rise from the base portion 46*b* to an inner side of the printer 1. An illustrated lower face of the contact portion 46*a* is brought into contact with the cam face 45*a*. Further, the attaching portion 46*c* is formed to rise to the inner side of the printer 1 from an illustrated upper end of the base portion 46*b*. The attaching portion 46*c* is formed with a locking hook 46*d* locked by an attaching hole 31*a*, mentioned later, formed at the linear scale 31. Further, the attaching bracket 46 is constructed by a constitution of moving up and down without being inclined by guiding means illustration of which is omitted.

When the drive motor (not illustrated) is driven and the eccentric cam 45 is rotated along with the guide shaft 17, the contact portion 46*a* is moved up and down along the cam face 45*a* and the linear scale 31 attached to the attaching bracket 46 is moved up and down. For example, as shown by FIG. 6, when the eccentric cam 46 is rotated in the clockwise direction, the linear scale 31 is moved up. Further, the attaching bracket 46 provided to the side of the one side face 16*a* and the attaching bracket 46 provided on the side of the other side face 16*b* are constituted to be moved up and down in synchronism with each other, and the linear scale 31 is moved up and down in a state of maintaining to be horizontal.

(Constitution of Linear Encoder)

Figure 7:
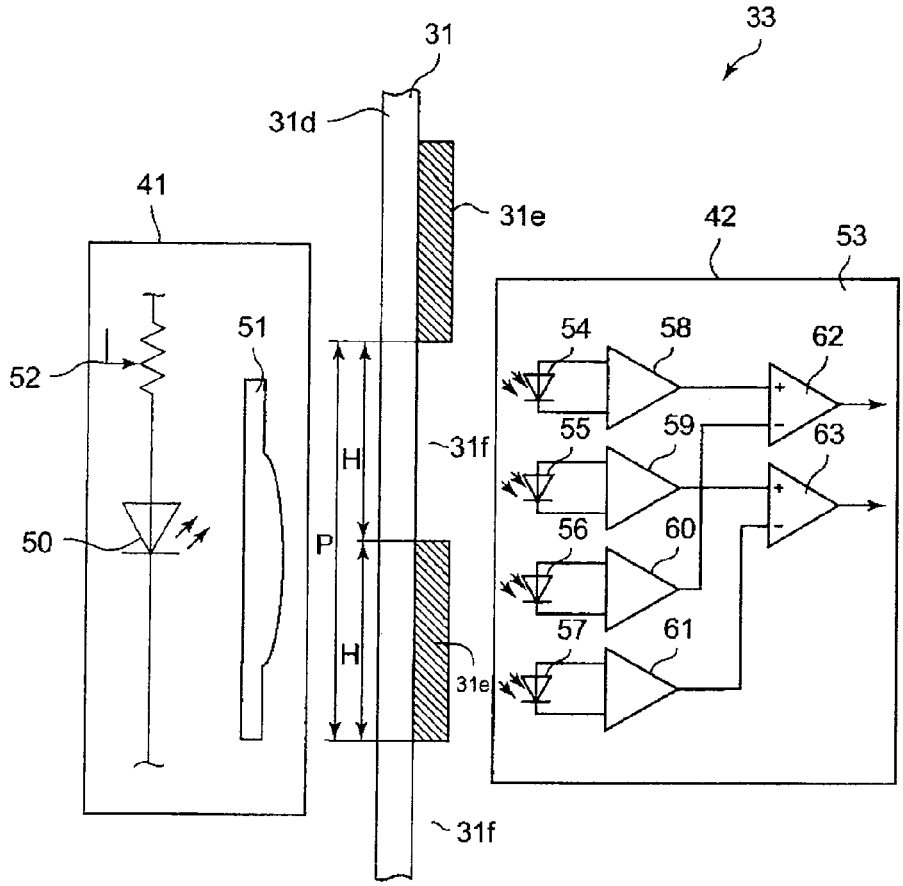
FIG. 7 is a schematic view showing an outline constitution of a linear encoder of FIG. 3.
Figure 8:
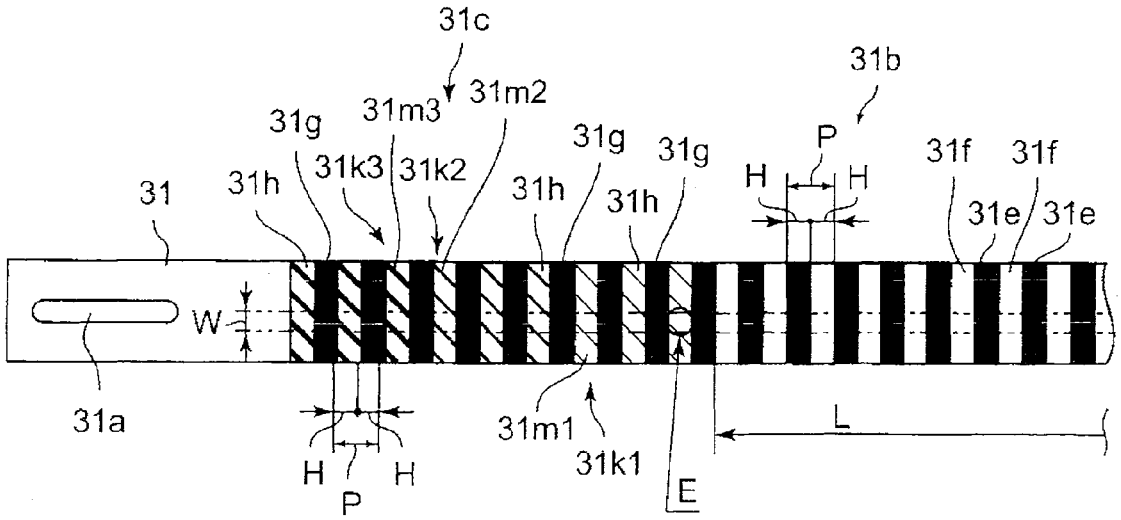
FIG. 8 is a view showing 80 column side of the linear scale of FIG. 3.
Figure 11A:
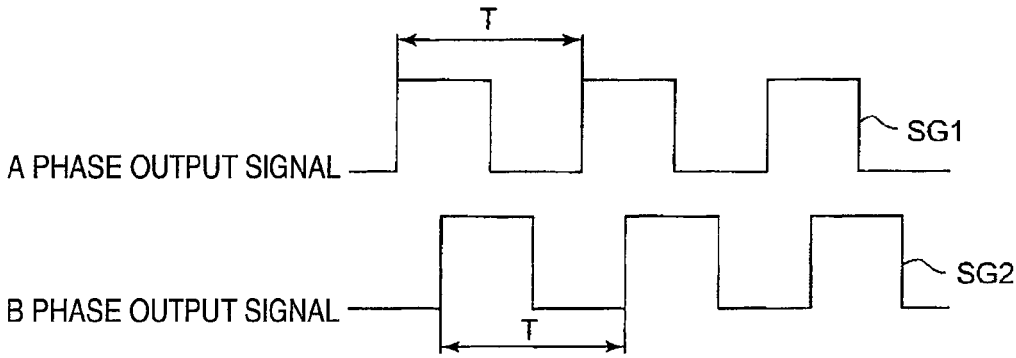
FIG. 11 illustrates diagrams showing a signal waveform outputted from the linear encoder of FIG. 3.
Figure 11B:
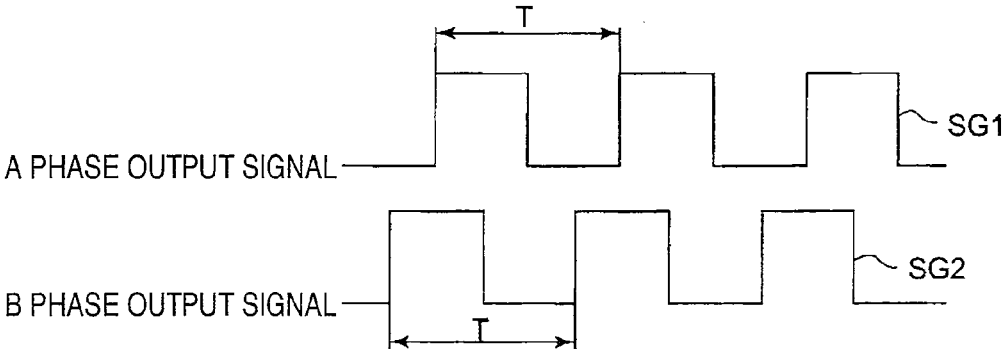

FIG. 7 is a schematic view showing an outline constitution of the linear encoder 33 of FIG. 3. FIG. 8 is a view showing 80 column side of the linear scale 31 of FIG. 3. FIGS. 11A and 11B illustrate diagrams showing a signal waveform outputted from the linear encoder 33 of FIG. 3, FIG. 11A is a diagram showing a signal waveform when the carriage 3 is moved from 0 column side to 80 column side, FIG. 11B is a diagram showing a signal waveform when the carriage 3 is moved from 80 column side to 0 column side.

As described above, the linear scale 31 is formed in the elongated shape by the thin plate of transparent resin or the like. Specifically, the linear scale 31 according to the embodiment is formed by transparent polyethyleneterephthalate (PET) having a thickness of, for example, 180 μm. Both end sides in a longitudinal direction of the linear scale 31 are respectively formed with the attaching holes 31*a* substantially in a rectangular shape locked by the locking hooks 46*d* of the attaching brackets 46. Further, as shown by FIG. 8 and the like, the linear scale 31 includes a position detecting pattern 31*b* for detecting a position of the carriage 3, and a smear detecting pattern 31*c* for detecting smear of the linear scale 31.

The position detecting pattern 31*b* is formed as follows. That is, in a detecting range L (refer to FIG. 4, FIG. 8) of the carriage 3 which needs to detect the position for printing the printing sheet P, one surface of the linear scale 31 is subjected to printing of black color or the like for intercepting color at predetermined intervals. Specifically, in the detecting range L, as shown by FIG. 7, one face of a base member 31*d* made of PET is subjected to printing of black color of a constant width H at a constant pitch P. That is, in the detecting range L, the portion is subjected to printing of black color having the constant width H in a short side direction of the linear scale 31 in a state of maintaining the pitch P in the main scanning direction MS such that a printed portion of black color constitutes a vertical pattern (refer to FIG. 4, FIG. 5). The portion subjected to printing of black color constitutes a first light interception portion 31*e* for intercepting light from the light emitting portion 41. Further, a portion between the respective first light interception portion 31*e* which is not subjected to printing of black color constitutes a first light transmitting portion 31*f* for transmitting light from the light emitting portion 41. In this way, in the detecting range L, the linear scale 31 is alternately formed with the first light interception portion 31*e* and the first light transmitting portion 31*f*. Further, also a width of the first light transmitting portion 31*f* is constituted by the constant width H.

The smear detecting pattern 31*c* is arranged on an outer side (end portion side) of the position detecting pattern 31*b* in the longitudinal direction of the linear scale 31. According to the embodiment, as shown by FIG. 8, the smear detecting pattern 31*c* is formed to be contiguous to the outer side of the position detecting pattern 31*b* on 80 column side of the linear scale 31.

The smear detecting pattern 31*c* is formed substantially similar to the position detecting pattern 31*b*. That is, at outside of the detecting range L on 80 column side of the linear scale 31, a face the same as a face formed with the first light interception portion 31*e* is subjected to printing of black color or the like for intercepting light at predetermined intervals. Specifically, a right face of the base member 31*d* in FIG. 7 is subjected to printing of black color of the constant width H at the constant pitch P. That is, as shown by FIG. 8, also at outside of the detecting range L on 80 column side, the portion is subjected to printing of black color of the constant width H in the short side direction of the linear scale 31 in a state of maintaining the pitch P in the longitudinal direction such that the printed portion of black color constitutes a vertical pattern. The portion subjected to printing of black color constitutes a second light interception portion 31*g* for intercepting light from the light emitting portion 41. In this way, at outside of the detecting range L on 80 column side of the linear scale 31, the linear scale 31 is alternately formed with the second light interception portion 31*g* and the second light transmitting portion 31*h*. Further, also a width of the second light transmitting portion 31*h* is constituted by the constant width H.

The second light transmitting portion 31*h* is formed with third light interception patterns 31*k*1 through 31*k*3 for making a transmitting area (transmittivity) of light from the light emitting portion 41 of the second light transmitting portion 31*h* smaller than a light transmitting area (transmittivity) of the light emitting portion 41 of the first light transmitting portion 31*f*. Specifically, the first light interception pattern 31*k*1, the second light interception pattern 31*k*2, the third light interception pattern 31*k*3 are formed from 0 column side such that the transmitting area and the transmittivity of light of the second light transmitting portion 31*h* is gradually reduced in this order. For example, as shown by FIG. 8, in the smear detecting pattern 31*c*, the first light interception pattern 31*k*1 are formed at initial three of the second light transmitting portions 31*h* from 0 column side to 80 column side, the second light interception patterns 31*k*2 are formed at next three of the second light transmitting portions 31*h*, and the third light interception patterns 31*k*3 are formed at final three of the second light transmitting portions 31*h*. Further, in the following, when the first through the third light interception pattern 31*k*1 through 31*k*3 are summarizingly designated, the light interception patterns are designated as a light interception pattern 31*k*.

The first through the third light interception patterns 31*k*1 through 31*k*3 are formed by a first through a third light interception portion 31*m*1 through 31*m*3 in a shape of a skewed line inclined to the longitudinal direction of the linear scale 31. According to the embodiment, by subjecting a surface of the base member 31*d* to printing of black color or the like for intercepting light in the shape of the skewed line inclined to the longitudinal direction by, for example, 45° and at the constant pitch. Specifically as shown by FIG. 8, the first light interception portion 31*m*1, the second light interception portion 31*m*2, the third light interception portion 31*m*3 are formed such that widths thereof are gradually widened in this order. Further, the first light interception pattern 31*k*1 is formed by a plurality of the first light interception portions 31*m*1, the second light interception pattern 31*k*2 is formed by a plurality of the second light interception portions 31*m*2, and the third light interception pattern 31*k*3 is formed by a plurality of the third light interception portions 31*m*3. In this way, the transmitting area and the transmittivity of the second light transmitting portion 31*h* are changed by gradually changing the first through the third light interception patterns 31*k*1 through 31*k*3 in the longitudinal direction of the linear scale 31 by changing the widths of the first through the third light interception portions 31*m*1 through 31*m*3. Further, in the following, when the first through the third light interception portions 31*m*1 through 31*m*3 are summarizingly designated, the light interception portions are designated as light interception portions 31*m*.

The transmitting area or the transmittivity of light of the second light transmitting portion 31*h* constitutes a constant rate relative to the transmitting area or the transmittivity of light of the first light transmitting portion 31*f* by the light interception pattern 31*k*. For example, the transmitting area of light of the second light transmitting portion 31*h* formed with the first light interception pattern 31*k*1, the transmitting area of light of the second light transmitting portion 31*h* formed with the second light interception pattern 31*k*2 and the transmitting area of light of the second light transmitting portion 31*h* formed with the third light interception pattern 31*k*3 respectively become 90%, 80%, and 70% of the transmitting area of light of the first light transmitting portion 31*f*. Further, for example, the transmittivity of light of the second light transmitting portion 31*h* formed with the first light interception pattern 31*k*1, the transmittivity of light of the second light transmitting portion 31*h* formed with the second light interception pattern 31*k*2 and the transmittivity of light of the second light transmitting portion 31*h* formed with the third light interception pattern 31*k*3 may respectively be constituted as 90%, 80%, and 70% of the transmittivity of light of the first light transmitting portion 31*f*.

Also, other example of a smear detecting pattern 31*c* will be explained in FIG. 9. A second light transmitting portion 31*h* of the smear detecting pattern 31*c* is formed with a light interception pattern 31*k* for making a transmitting area of light from the light transmitting portion 41 of the second light transmitting portion 31*h* smaller than a transmitting area of the light from the light emitting portion 41 of the first light transmitting portion 31*f*, that is, making a transmittivity of light from the light emitting portion 41 of the second light transmitting portion 31*h* lower than a transmittivity of the light from the light emitting portion 41 of the first light transmitting portion 31*f*. According to this example, the light interception pattern 31*k* is formed by a light interception portion 31*m* in a shape of a skewed line inclined to the longitudinal direction of the linear scale 31. Especially, a plurality of the light interception portions 31*m* are formed by subjecting a surface of a base member 31*d* to printing of black color of the like for intercepting light in a shape of a skewed line inclined to the longitudinal direction by, for example, 45°. Further, the light interception pattern 31*k* is formed by a plurality of light interception portions 31*m*. By the light interception pattern 31*k*, the transmitting area of light of the second light transmitting portion 31*h* constitutes a constant rate relative to the transmitting area of light of the first light transmitting portion 31*f*. That is, the transmittivity of light of the second light transmitting portion 31*h* constitutes a constant rate relative to the transmittivity of light of the first light transmitting portion 31*f*. For example, the transmitting area of light of the second light transmitting portion 31*h* becomes 85% of the transmitting area of light of the first light transmitting portion 31*f*. Further, the transmittivity of light of the second light transmitting portion 31*h* may be constituted by, for example, 85% of the transmittivity of light of the first light transmitting portion 31*f*.

Figure 9:
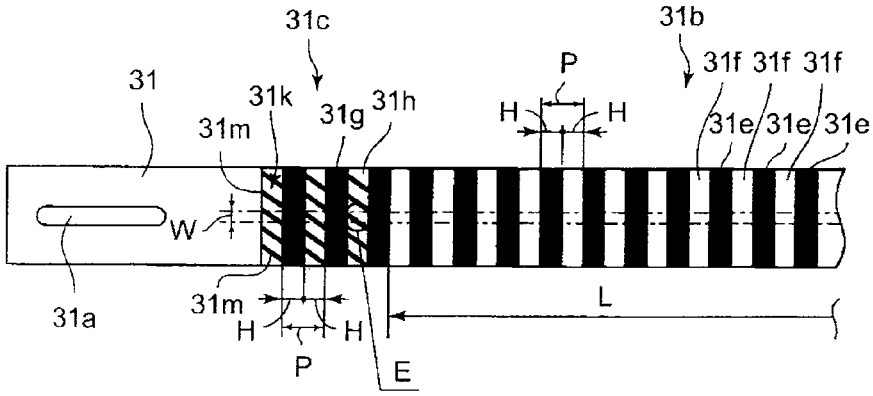
FIG. 9 is a view showing 80 column side of other embodiment of the linear scale of FIG. 3.

Also, as shown by FIG. 9, the linear scale 31 is formed with the plurality (for example, three) of second light transmitting portions 31*h* and the transmitting areas or the transmittivities of the plurality of second light transmitting portions 31*h* are made to be equal. However, it is not necessarily needed that the transmitting areas or the transmittivities of the plurality of second light transmitting portions 31*h* are equal but the transmitting areas or the transmittivities of the second light transmitting portions 31*h* may differ from each other.

Furthermore, other example of a smear detecting pattern 31*c* will be explained in FIG. 10. There is formed a light interception portion 31*m* in a shape of a skewed line inclined to a longitudinal direction of the linear scale 31 on an illustrated lower side of a portion which is not subjected to printing between printed portions of black color. Further, a position detecting pattern 31*b* is constituted by a portion which is not subjected to printing between printed portions of black color and a portion which is not formed with the light interception portion 31*m* (upper side portion of the linear scale 31 in FIG. 10) and the printed portion of black color contiguous thereto in the longitudinal direction of the linear scale. Further, a smear detecting pattern 31*c* is constituted by a portion which is not subjected to printing between printed portions of black color and a portion formed with the light interception portion 31*m* (lower side portion of the linear scale 31 in FIG. 10) and a printed portion of black color contiguous to the portion in the longitudinal direction of the linear scale. That is, according to the embodiment, the position detecting pattern 31*b* and the smear detecting pattern 31*c* are arranged to be contiguous to each other in a short side direction of the linear scale 31. Specifically, the smear detecting pattern 31*c* is arranged on the lower side of the position detecting pattern 31*b*.

In the position detecting pattern 31*b*, the portion which is not subjected to printing between the printed portions of black color constitutes a first light transmitting portion 31*f* for transmitting light from a light emitting portion 41 of the photosensor 32. Further, in the position detecting pattern 31*b*, the printed portion of black color contiguous to the first light transmitting portion 31*f* in the longitudinal direction of the linear scale constitutes a first light interception portion 31*f* for intercepting the light from the light emitting portion 41. That is, the position detecting pattern 31*b* is alternately formed with the first light interception portion 31*e* and the first light transmitting portion 31*f* in the longitudinal direction. Further, the position detecting pattern 31*b* is formed in a range of detecting the carriage 3 which needs to detect the position for printing the printing sheet P. Further, also a width of the first light transmitting portion 31*f* is constituted by a constant width H similar to that of the first light transmitting portion 31*e*.

In the smear detecting pattern 31*c*, the portion which is not subjected to printing between the printed portions of black color constitutes a second light transmitting portion 31*h* for transmitting the light from the light transmitting portion 41. Further, in the smear detecting pattern 31*c*, the printed portion of black color contiguous to the second light transmitting portion 31*h* in the longitudinal direction constitutes a second light interception portion 31*g* for intercepting the light from the light emitting portion 41. That is, the smear detecting pattern 31*c* is alternately formed with the second light interception portion 31*g* and the second light transmitting portion 31*h* in the longitudinal direction. Further, also a width of the second light transmitting portion 31*h* is constituted by the constant width H similar to that of the second light interception portion 31*g*.

The second light transmitting portion 31*h* is formed with a light interception pattern 31*k* for making a transmitting area of the light from the light transmitting portion 41 of the second light transmitting portion 31*h* smaller than a transmitting area of the light from the light emitting portion 41 of the first light transmitting portion 31*f*, that is, making a transmittivity of the light from the light emitting portion 41 of the second light transmitting portion 31 smaller than a transmittivity of the light from the light emitting portion 41 of the first light transmitting portion 31*f* by the light interception portion 31*m*. Further specifically, the light interception portion 31*m* of the embodiment is formed by subjecting printing of black color or the like for intercepting light to a surface of the base member 31*d* in a shape of a skewed line inclined to the longitudinal direction by, for example, 45°. A plurality (according to the embodiment, for example, 2 pieces) of the light interception portions 31*m* are formed by a constant pitch. Further, the light interception pattern 31*k* is formed by the plurality of light interception portions 31*m*. By the light interception pattern 31*k*, the transmitting area of light of the second light transmitting portion 31*h* constitutes a constant rate relative to the transmitting area of light of the first light transmitting portion 31*f*. That is, the transmittivity of light of the second light transmitting portion 31*h* constitutes a constant rate relative to the transmittivity of light of the first light transmitting portion 31*f*. For example, the transmitting area of light of the second light transmitting portion 31*h* becomes 85% of the transmitting area of light of the first light transmitting portion 31*f*. Further, the transmittivity of light of the second light transmitting portion 31*f* may be constituted by 85% of the transmittivity of light of the first light transmitting portion 31*f*.

Figure 10:
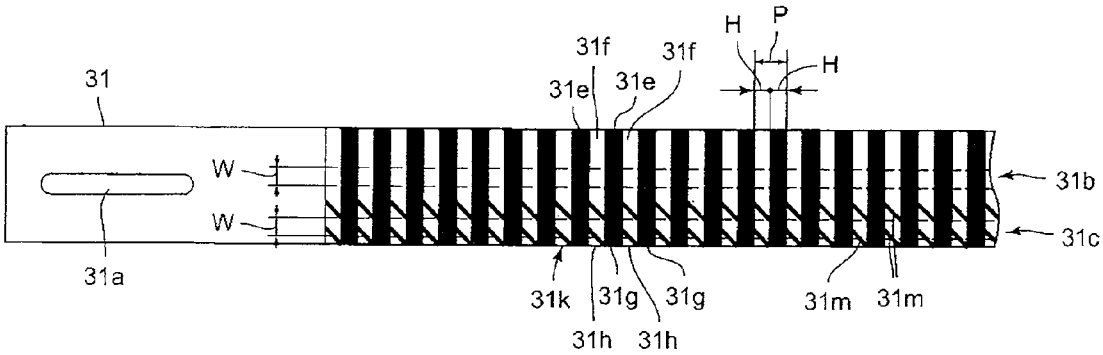
FIG. 10 is a view showing 80 column side of other embodiment of the linear scale of FIG. 3.

Further, according to the embodiment, as shown by FIG. 10, the linear scale 31 is formed with the plurality of second light transmitting portions 31*h* and the transmitting areas or the transmittivities of the plurality of second light transmitting portions 31*h* are made to be equal. However, it is not necessarily needed that the transmitting areas or the transmittivities of the plurality of second light transmitting portions 31*h* are equal but the transmitting areas or the transmittivities of the second transmitting portions 31*h* may differ from each other.

As shown by FIG. 2 and FIG. 3, the photosensor 32 includes a housing substantially in a shape of a parallepiped. According to the photosensor 32, a recess portion 32*a* is formed from one side face (lower face of FIG. 2) of the housing over to a center portion of the housing. A light emitting portion 41 is arranged at one of two faces opposed to each other at the recess portion 32*a* (two faces opposed to each other in a left and right direction of FIG. 2) and a light receiving portion 42 is arranged at other thereof. Further specifically, as shown by FIG. 2 and the like, the light emitting portion 41 is arranged at the face of a side of the carriage 3. Further, a distance between the two faces opposed to each other at the recess portion 32*a* is constituted by, for example, 0.5 mm through 1.5 mm.

Further, as shown by FIG. 2 and the like, the photosensor 32 is fixed to the carriage 3 to interpose the linear scale 31 by the light emitting portion 41 and the light receiving portion 42. Further, according to the linear encoder 33, the light receiving portion 42 receives light emitted from the light emitting portion 41 to the linear scale 31 and transmitted through the first light transmitting portion 31*f* or the second light transmitting portion 31*k* to output a predetermined output signal.

As shown by FIG. 7, the light emitting portion 41 includes a light emitting element 50 and a collimator lens 51 for making light emitted from the light emitting element parallel light. The light emitting element 50 is, for example, a light emitting diode. The light emitting element 50 is supplied with a current by way of a variable resistor 52. Therefore, by the variable resistor 52, an amount of light emitted from the light emitting element 50 can be increased or reduced. According to the embodiment, the variable resistor 52 constitutes light amount controlling means for controlling a light emitting amount from the light emitting portion 41. Further, it is preferable that in an initial state, the light emitting amount from the light emitting element 50 is made to be as low as possible in a range of capable of detecting the position pertinently by the linear encoder 33. Thereby, power consumption at the light emitting portion 41 can be reduced.

As shown by FIG. 7, the light receiving portion 42 includes a board 53, and four of light receiving elements 54 through 57 formed on the board 53. The light receiving elements 54 through 57 are, for example, photodiodes for outputting signals of levels in accordance with light receiving amounts. Further, as shown by FIG. 7, the light receiving portion 42 includes four of a first through a fourth amplifier 58 through 61, a first differential signal generating circuit 63 and a second differential signal generating circuit 64. Further, in the following, when four of the light receiving elements 54 through 58 are differentiatedly designated, theses are designated as the first light receiving element 54, the second light receiving element 55, the third light receiving element 56 and the fourth light receiving element 57.

Four of the light receiving elements 54 through 57 are arranged on the board 53 along a direction of moving the carriage 3. Specifically, the first light receiving element 54 and the third light receiving element 56 are arranged such that phases of level signals outputted from the respectives differ from each other by 180°. Further, the second light receiving element 55 and the fourth light receiving element 57 are arranged such that phases of level signals outputted from the respectives differ from each other by 180°. For example, a pitch of arranging the first light receiving element 54 and the third light receiving element 56, and a pitch of arranging the second light receiving element 55 and the fourth light receiving element 57 are made to be a half of the pitch P of brightness/darkness formed by the first light interception portion 31*e* and the first light transmitting portion 31*f*. Further, the first light receiving element 54 and the second light receiving element 55 are arranged such that the phases of the level signals outputted from the respectives differ from each other by 90°. For example, the first light receiving element 54 and the second light receiving element 55 are arranged by an arrangement pitch of a quarter of the pitch P of brightness/darkness.

Further, when the carriage 3 is moved, the linear scale 31 is relatively moved between the light emitting portion 41 and the light receiving portion 42. In accordance with the relative movement of the linear scale 31, the light receiving elements 54 through 57 output signals of levels in accordance with the light receiving amounts. That is, the light receiving elements 54 through 57 in correspondence with a position of the first light transmitting portion 31*f* or the second light transmitting portion 31*h* output high level signals, and the light receiving elements 54 through 57 in correspondence with a position of the first light interception portion 31*e* or the second light interception portion 31*g* output low level signals. In this way, the light receiving elements 54 through 57 output the level signal changed by a period in accordance with a relative moving speed of the linear scale 31 (moving speed of the carriage 3).

As shown by FIG. 7, four of the first through the fourth amplifiers 58 through 61, the first differential signal generating circuit 62, the second differential signal generating circuit 63 are arranged on the board 53.

The first amplifier 58 is connected with the first light receiving element 54 and the first amplifier 58 outputs a signal constituted by amplifying the level signal outputted from the light receiving element 54. The second amplifier 59 is connected with the second light receiving element 55 and the second amplifier 59 outputs a signal constituted by amplifying the level signal outputted by the second light receiving element 55. The third amplifier 60 is connected with the third light receiving element 56 and the third amplifier 60 outputs a signal constituted by amplifying the level signal outputted by the third light receiving element 56. The fourth amplifier 61 is connected with the fourth light receiving element 57 and the fourth amplifier 48 outputs a signal constituted by amplifying the level signal outputted by the fourth light receiving element 57.

The first amplifier 58 and the third amplifier 60 output the amplified level signals to the first differential signal generating circuit 62. A level signal amplified by the first amplifier 58 is inputted to a noninverting input terminal of the first differential signal generating circuit 62, a level signal amplified by the third amplifier 60 is inputted to an inverting input terminal of the first differential signal generating circuit 62. The first differential signal generating circuit 62 outputs a high level when the level of the output signal of the first amplifier 58 inputted to the noninverting input terminal is higher than the level of the output signal of the third amplifier 59 inputted to the inverting input terminal and outputs a low level in an inverse case. That is, as shown by FIG. 11, the first differential signal generating circuit 62 outputs an a phase signal SG1 of a digital waveform having the period T in correspondence with the pitch P of brightness/darkness formed by the first light interception portion 31*e* and the first light transmitting portion 31*f*.

The second amplifier 59 and the fourth amplifier 61 output the amplified level signals to the second differential signal generating circuit 63. The level signal amplified by the second amplifier 59 is inputted to a noninverting input circuit of the second differential signal generating circuit 63, the level signal amplified by the fourth amplifier 61 is inputted to the inverting input terminal of the second differential signal generating circuit 63. The second differential signal generating circuit 63 outputs a high level when the level of the output signal of the second amplifier 59 inputted to the noninverting input terminal is higher than the level of the fourth amplifier 61 inputted to the inverting input terminal and outputs a low level in an inverse case. That is, as shown by FIG. 11, the second differential signal generating circuit 63 outputs a B phase signal of a digital waveform having the period T in correspondence with the pitch P of brightness/darkness formed by the first light interception portion 31*e* and the first light transmitting portion 31*f*. Further, as shown by FIG. 11, phases of the A phase signal SG1 outputted from the first differential signal generating circuit 62 and the B phase signal SG2 outputted from the second differential signal generating circuit 63 are shifted from each other by 90°.

Further, FIG. 11A shows a signal waveform when the carriage 3 is moved from 0 column side to 80 column side, FIG. 11B shows a signal waveform when the carriage 3 is moved from 80 column side to 0 column side. That is, as shown by FIG. 11A, when the B phase signal SG2 is at the low level and the A phase signal SG1 rises (or, when the B phase signal SG2 is at the high level and the A phase signal SG1 falls or the like), the carriage 3 is moved from 0 column side to 80 column side. Further, as shown by FIG. 11B, when the B phase signal SG2 is at the low level and the A phase signal SG1 falls (or, when the B phase signal SG2 is at the high level and the A phase signal SG1 rises or the like), the carriage 3 is moved from 80 column side to 0 column side.

Further, light emitted from the light emitting portion 41 is irradiated to the linear scale 31 by a predetermined width W as shown by FIG. 8, in the short side direction of the linear scale 31 (up and down direction of FIG. 8). Specifically, even when the second light transmitting portion 31*h* is formed with the light interception portion 31*m* in the shape of the skewed line, so far as the second light transmitting portion 31*h* is not smeared, light is irradiated from the light emitting portion 41 to the linear scale 31 by the predetermined width W in the short side direction such that a portion of completely intercepting light from the light emitting portion 41 is not brought about at a portion of the second light transmitting portion 31*h* in the longitudinal direction of the linear scale 31. Therefore, even when the second light transmitting portion 31*h* is formed with the light interception portion 31*m*, in a case in which the linear scale 31 is not smeared and the carriage 3 is moved at a constant speed, when the photosensor 32 passes a portion of the linear scale 31 formed with the smear detecting pattern 31*c*, the linear encoder 33 outputs the A phase signal SG1 and the B phase signal SG2 of a period the same as that when the photosensor 32 passes a portion of the linear scale 31 formed with the position detecting pattern 31*b*.

(Outline Operation of Printer)

According to the printer 1 constituted as described above, the carriage 3 driven by the CR motor 4 is reciprocally moved in the main scanning direction MS while feeding the printing sheet P taken to the inner portion of the printer 1 from the hopper 11 by the sheet feeding roller 12 and the separating pad 13 in a sub scanning direction SS by the PF drive roller 6 driven to rotate by the PF motor 5. When the carriage 3 is reciprocally moved, ink drops are delivered from the printing head 2 to print the printing sheet P. Further, when printing the printing sheet P is finished, the printing sheet P is discharged to outside of the printer 1 by the sheet discharge drive roller 15 or the like.

When the carriage 3 is moved, the A phase signal SG1 and the B phase signal SG2 are outputted from the linear encoder 33. The outputted A phase signal SG1 and the outputted B phase signal SG2 are inputted to a predetermined processing circuit (for example, ASIC or the like) of the control portion 37. By utilizing the inputted A phase signal SG1 and the inputted B phase signal SG2 from the linear encoder 33, the predetermined processing circuit of the control portion 37 detects a position, a speed and a moving direction of the carriage 3 (that is, detects a rotational position, a rotational direction and a rotational speed of the CR motor 4). Further, the printer 1 is controlled based on a result of detection. That is, the rotational speed of the CR motor 4 is controlled or the like.

(Operation of Printer in Detecting Smear of Linear Scale)

Figure 12:
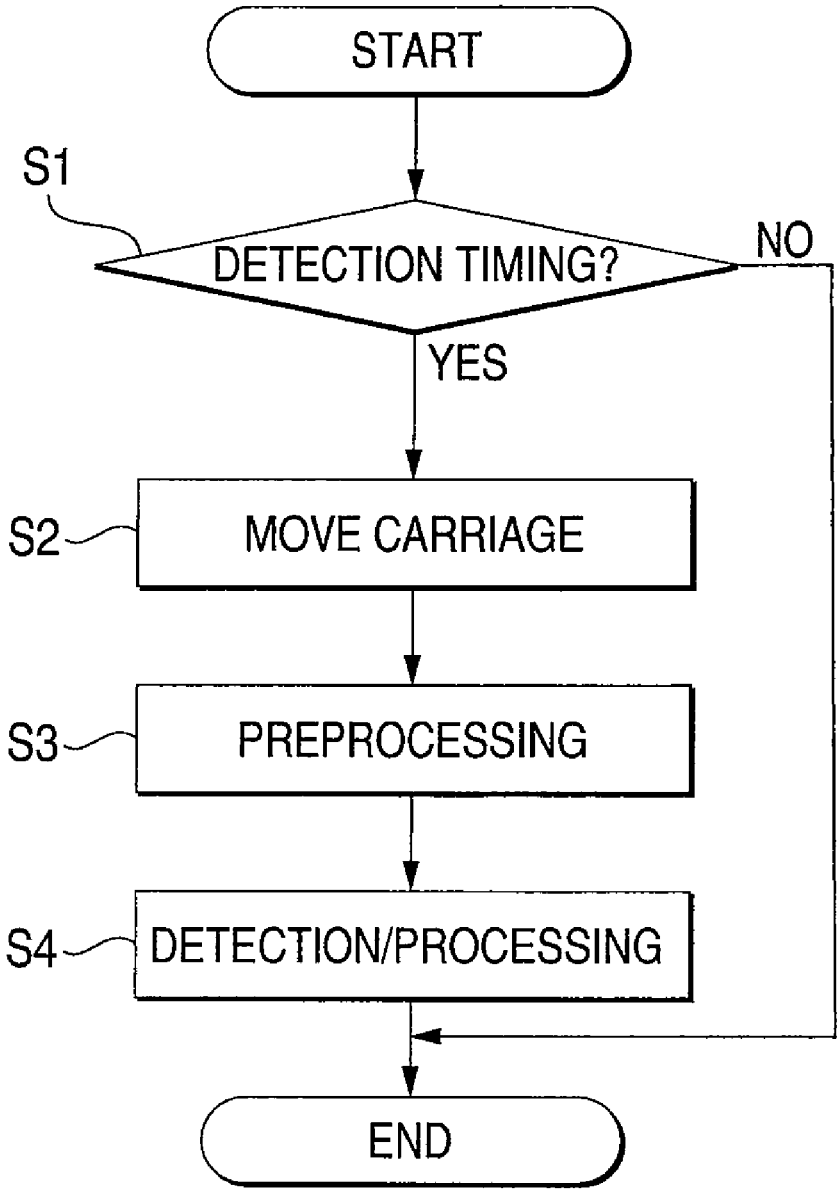
FIG. 12 is a flowchart showing a series of operation of the printer when smear of the linear scale of FIG. 3 is detected.
Figure 13:
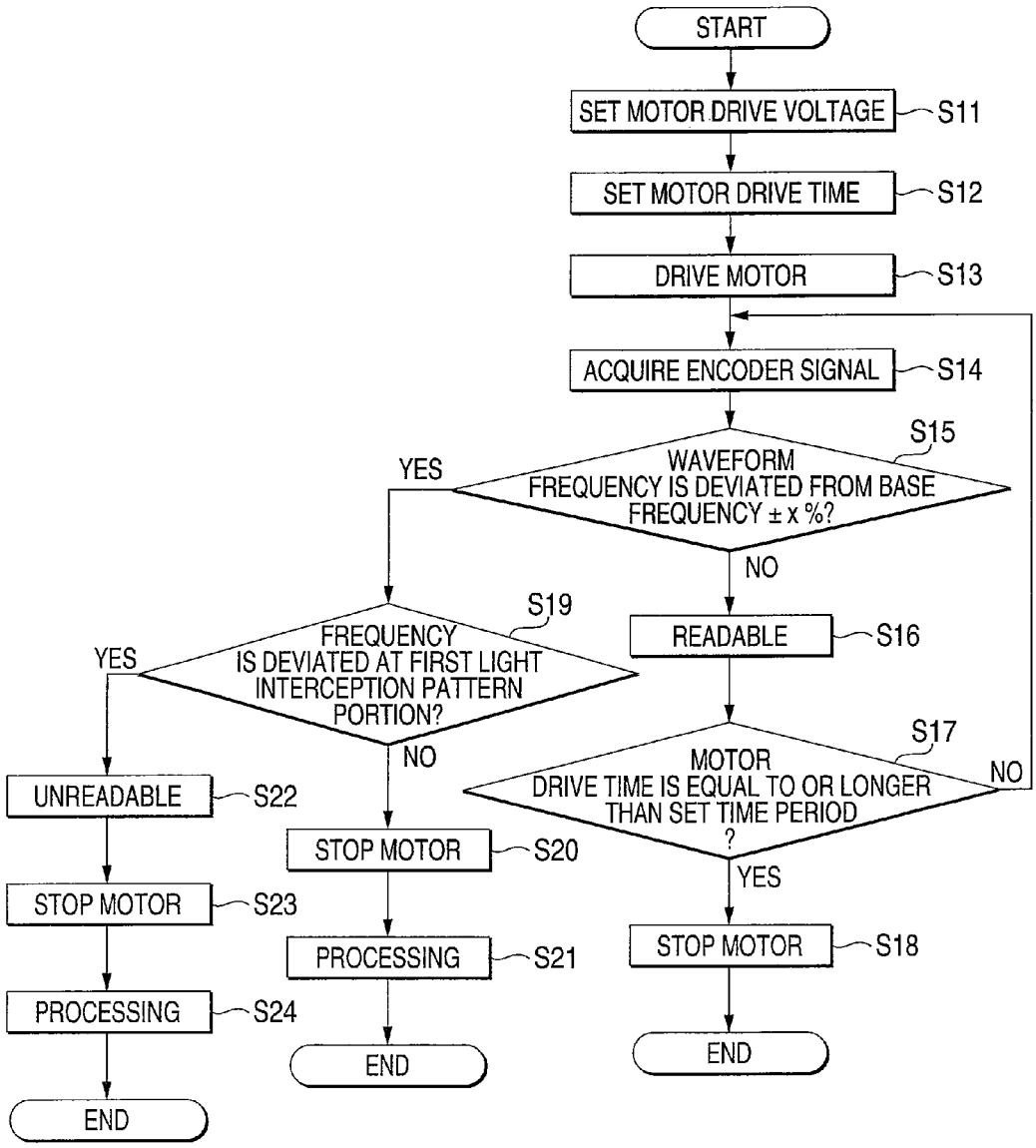
FIG. 13 is a flowchart showing an example of operation of detecting smear of the linear scale of FIG. 3.
Figure 15:
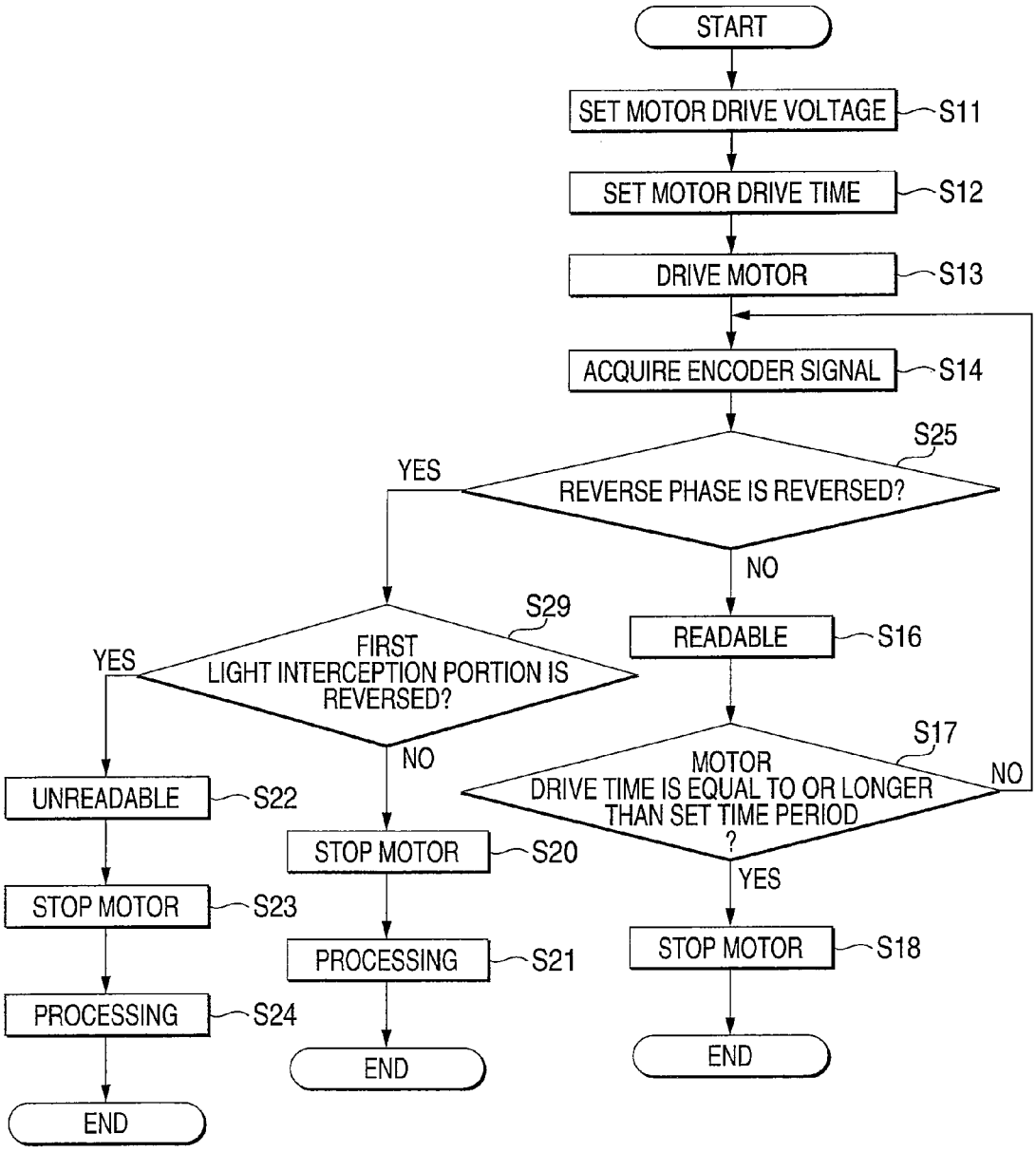
FIG. 15 is a flowchart showing other example of operation of detecting smear of the linear scale of FIG. 3.

FIG. 12 is a flowchart showing a series of operation of the printer 1 in detecting smear of the linear scale 31 of FIG. 3. FIG. 13 is a flowchart showing an example of operation of detecting smear of the linear scale 31 of FIG. 3. FIG. 15 is a flowchart showing other example of operation of detecting smear of the linear scale 31 of FIG. 3. FIG. 17 illustrates diagrams showing an example of a signal waveform outputted from the linear encoder 33 when the linear scale 31 of FIG. 3 is smeared. FIG. 18 is a partially enlarged view enlarging to show E portion of FIG. 8.

When ink drops are delivered from the printing head 2 in order to print the printing sheet P, portions of the ink drops are constituted by a mist-like form to bring about ink mist floating in air when ink drops are delivered from the printing head 2. Therefore, the ink mist is floated at inside of the printer 1 and adhered to the linear scale 31 as smear. When the linear scale 31 is smeared by the ink mist, the position, the speed or the like of the carriage 3 cannot pertinently be detected and therefore, in the printer 1, smear of the linear scale 31 is detected. An explanation will be given of a series of operation of the printer 1 in detecting smear of the linear scale 31 as follows.

As shown by FIG. 12, first, the control portion 37 determines whether a timing of detected smear of the linear scale 31 is constituted (step S1). The timing of detecting smear of the linear scale 31 is, for example, after one sheet of the printing sheet P has been finished to be printed, or when a power source is inputted to the printer 1. When the timing of detecting smear of the linear scale 31 is after finishing to print one sheet of the printing sheet P, a number of times of detection can be increased, and smear of the linear scale 31 can be detected at a pertinent timing. Further, when the timing of detecting smear of the linear scale 31 is when the power source is inputted to the printer 1, smear of the linear scale 31 can be detected by initial operation of the printer 1 in starting, it is not necessary to carry out operation of detecting smear of the linear scale 31 separately. Therefore, loss time by operation of detecting smear of the linear scale 31 can be nullified.

Further, the timing of detecting smear of the linear scale 31 may be constituted after an elapse of a constant time period t1 after inputting the power source of the printer 1, further, thereafter, may be every time after an elapse of a constant time period t2. In this case, the constant time period t1 and the constant time period t2 may be the same or differ from each other. Further, the timing of detecting smear of the linear scale 31 may be constituted after finishing to print a constant number of sheets n1 of the printing sheets P after inputting the power source, further, thereafter, may be every time after finishing to print a constant number of sheets n2 of the printing sheet P. In this case, the constant number of sheets n1 and the constant number of sheets n2 may be the same or differ from each other. Furthermore, according to the timing of detecting smear of the linear scale 31, the timing of detecting smear of the linear scale 31 may be determined by utilizing both of an elapse of time period and a number of printing sheets such as an earlier one of either of an elapse of a constant time period t1 after inputting the power source of the printer 1, or finish printing a constant number of sheets n1 of the printing sheets P, or an earlier one of either of an elapse of a constant time period t2 or finish printing a constant number of sheets n2 of the printing sheets P thereafter. Further, when the detection timing is determined by the number of printing sheets, a constant number of sheets n1 or n2 may be determined by conversion of a number of sheets when a sheet of A4 size is printed without margin.

When it is determined that the detection timing is not constituted at step S1, smear of the linear scale 31 is not detected, the printer 1 is, for example, brought into a standby state or prints a successive one of the printing sheet P. On the other hand, when it is determined that the detection timing is constituted at step S1, the carriage 3 is moved to the home position or a predetermined position (step S2).

Thereafter, predetermined preprocessing is carried out (step S3). At step S3, the scale lifting mechanism 44 moves up the linear scale 31 such that the light from the light emitting portion 41 which has been irradiated to the position detecting pattern 31*b* is irradiated to the smear detecting pattern 31*c*. Further specifically, for example, the light from the light emitting portion 41 is irradiated to a range of the predetermined width W on the lower side of FIG. 10. Also, at step S3, for example, an amount of light emitted from the light emitting element 50 is increased or reduced by adjusting the variable resistor 52. When as described later, by the ink mist adhered to the second light transmitting portion 31*h*, there is brought about a portion of intercepting light from the light emitting portion 41 over a range of the predetermined width W at a portion of the second light transmitting portion 31*h* in a longitudinal direction of the linear scale 31, or when light from the light emitting portion 41 is blocked over the range of the predetermined width W at the second light transmitting portion 31*h*, it is detected that the linear scale 31 is smeared. Therefore, in a case in which the amount of light emitted from the light emitting element 50 is large, even when the second light transmitting portion 31*h* is adhered with the ink mist, so far as a degree of smear of the second light transmitting portion 31*h* is not large, smear of the linear scale 31 is not detected. Further, in a case in which the amount of light emitted from the light emitting element 50 is small, even when the degree of smear of the second light transmitting portion 31*h* is small, smear of the linear scale 31 is detected. In this way, by increasing or decreasing the amount of light emitted from the light emitting element 50, the degree of smear of the linear scale 31 can be detected. Further, the preprocessing at step S3 is not necessarily needed but may be omitted.

When the preprocessing at step S3 has been finished, detection of smear of the linear scale 31 and a processing as necessary are actually carried out (step S4). At step S4, as shown by FIG. 13, first, a drive voltage of the CR motor 4 is set (step S11). Specifically, a constant drive voltage is set such that the carriage 3 after having been finished to be accelerated is moved substantially at the constant speed. Further, a time period of driving the CR motor 4 is set (step S12). Specifically, the time period of driving the CR motor 4 is set such that the photosensor 32 fixed to the carriage 3 disposed at the home position or the predetermined location passes a portion of the smear detecting pattern 31*c* of the linear scale 31 substantially at the constant speed. For example, when the carriage 3 is disposed at the home position, there is set a time period of driving the CR motor 4 until the carriage 3 returns to the home position again after reciprocally moving between 0 column side and 80 column side.

Thereafter, the CR motor 4 is driven by the drive voltage and the drive time period set as described above (step S13). The carriage 3 is moved by the CR motor 4 and the photosensor 32 is moved relative to the linear scale 31. By the relative movement, the linear encoder 33 outputs, for example, the A phase signal SG1 and the B phase signal SG2 having the period T. The A phase signal SG1, the B phase signal SG2 constituting an output signal of the linear encoder 33 are inputted to the control portion 37. That is, the control portion 37 acquires the output signal of the linear encoder 33 (step S14).

Thereafter, the control portion 37 determines whether the linear scale 31 is smeared (step S15). When the ink mist is adhered to the linear scale 31, as shown by, for example, FIG. 18, adhered portions D1, D2, D3 of the ink mist are brought about also at the second light transmitting portion 31*h*. Further, by the adhered portions D1, D2 and the light interception portion 31*m*, at the second light transmitting portion 31*h*, a portion of intercepting light from the light emitting portion 41 is brought about over the range of the predetermined width W at a portion thereof in the longitudinal direction of the linear scale 31. Or, by adhering the ink mist, light from the light emitting portion 41 is blocked at the second light transmitting portion 31*h*. When the portion of intercepting light from the light emitting portion 41 is brought about at the portion in the longitudinal direction of the linear scale 31 over the range of the predetermined width W, or light from the light emitting portion 41 is blocked over the range of the predetermined width W of the second light transmitting portion 31*h*, a variation is brought about in the period of the A phase signal SG1 or the B phase signal SG2 outputted from the linear encoder 33. According to the embodiment, when a predetermined variation is brought about in the period the A phase signal SG1 or the B phase signal SG2 outputted from the linear encoder 33, it is determined that the portion of intercepting light from the light emitting portion 41 is brought about over the range of the predetermined width W at the portion in the longitudinal direction of the linear scale 31, or light from the light emitting portion 41 is blocked at the second light transmitting portion 31*h*. Further, under the state, it is determined that the linear scale 31 is smeared.

Further specifically, at step S15, it is determined whether the period (or frequency) of the A phase signal SG1 or the B phase signal SG2 when the photosensor 32 passes a portion formed with the smear detecting pattern 31*c* is deviated from a range of ±x % (for example, ±15%) of a basis period T (or frequency). When the base of A phase signal SG1 or the B phase signal SG2 is not deviated from the range of ±x % of the period T constituting the base, even at the portion formed with the smear detecting pattern 31*c*, an accurate position can be detected, (that is, accurate reading can be carried out) by the linear encoder 33 (step S16). That is, in this case, at the second light transmitting portion 31*h*, the portion of intercepting light from the light emitting portion 41 is not brought about over the range of the predetermined width W at the portion in the longitudinal direction of the scale 31, further, when light from the light emitting portion 41 is not blocked over the range of the range of the predetermined width W at the second light transmitting portion 31*h* and therefore, it is determined that the linear scale 31 is not smeared. Further, since the linear scale 31 is not smeared, it is determined that the position can pertinently be detected by the linear encoder 33.

When it is determined that the linear scale 31 is not smeared, it is determined whether a time period of driving the CR motor 4 is equal to or longer than a set time period (step S17). When the time period of driving the CR motor 4 is less than the set time period, the operation returns to step S14 and the control portion 37 acquires the output signal of the linear encoder 33. Further, when the time period of driving the CR motor 4 is equal to or longer than the set time period, the CR motor 4 is stopped (step S18). For example, the CR motor 4 is stopped in a state in which the carriage 3 is disposed at the home position and detection of smear of the linear scale 31 at step S4 is finished.

Figure 17A:
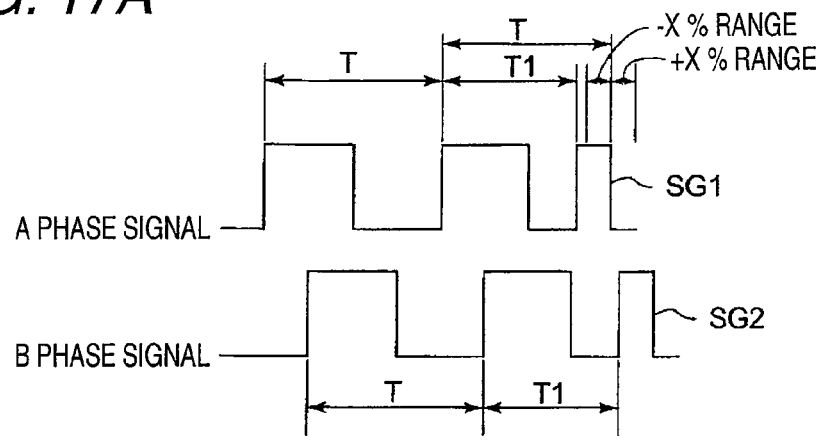
FIG. 17 illustrates an example of a signal waveform outputted from the linear encoder when smear is brought about at the linear scale of FIG. 3.
Figure 17A:
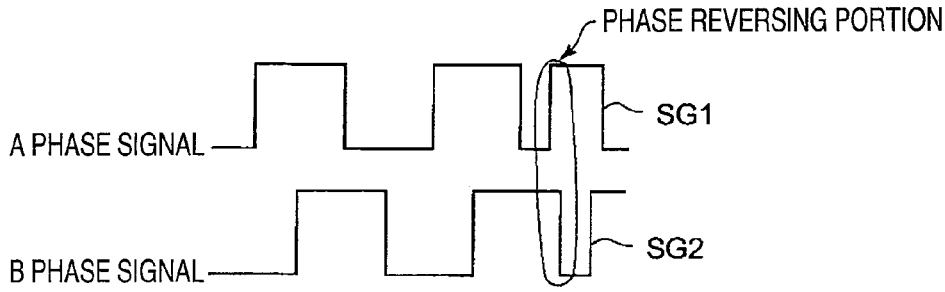
Figure 18:
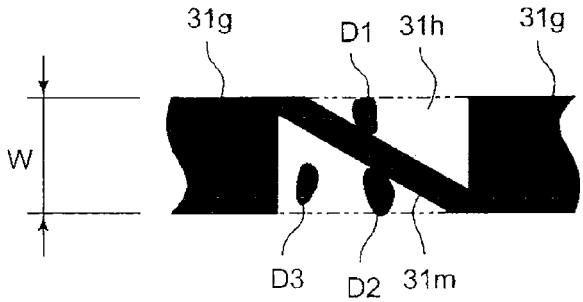
FIG. 18 is a partial enlarged view enlarging to show E portion of FIG. 8.

Meanwhile, for example, as shown by FIG. 17A, when the period T1 of the A phase signal SG1 or the B phase signal SG2 is deviated from the range of ±x % of the period T, as shown by FIG. 18, it seems that the portion of intercepting light from the light emitting portion 41 is brought about over the range of the predetermined width W at the portion in the longitudinal direction of the linear scale 31 at the second light transmitting portion 31*h* by the adhered portions D1, D2 and the light interception portion 31*m*. In this case, according to the embodiment, it is determined that the period T1 of the A phase signal SG1 or the B phase signal SG2 at a portion of the smear detecting pattern 31*c* formed with the first light interception pattern 31*k*1 and having the largest transmitting area and the highest transmittance (that is, a portion by which it is difficult to block light the most) is deviated from the range of ±x % of the period T (step S19). That is, according to the embodiment, when the period T1 of the A phase signal SG1 or the like at the portion formed with the first light interception pattern 31*k*1 is deviated from the range of ±x % of the period T, it is determined that the linear scale 31 is smeared and there is a high possibility of erroneously detecting the position by the linear encoder 33 under a state as it is. Further, even when the period T1 of the A phase signal SG1 of the like at the portion formed with the second light interception pattern 31*k*2 and/or the third light interception pattern 31*k*3 is deviated from the range of ±x % of the period T, it is determined that a possibility of erroneously detecting the position by the linear encoder 33 is very low.

When the period T1 of the A phase signal SG1 or the like at the portion formed with the first light interception pattern 31*k*1 is not deviated from the range of ±x % of the period T, that is, when the period T1 of the A phase signal SG1 or the like at the portion formed with the second light interception pattern 31*k*2 and/or the third light interception pattern 31*k*3 is deviated from the range of ±x % of the period T, for example, in the state in which the carriage 3 is disposed at the home position, the CR motor 4 is stopped (step S20), and a predetermined processing is carried out (step S21). At step S21, for example, a number of printing sheets at the time point is confirmed. Or, at step S21, when the timing of detecting smear of the linear scale 31 is present at every predetermined time period, it is confirmed how much time has elapsed. Specifically, the control portion 37 calculates the number of printing sheets or the printing timer period.

Further, at step S21, for example, the amount of light emitted from the light emitting element 50 is increased by adjusting the variable resistor 52 based on a result of detection by the linear encoder 31. Specifically, when the period T1 of the A phase signal SG1 or the like only at a portion formed with the third light interception pattern 31*k*3 is deviated from the range of ±x % of the period T, the degree of smear of linear scale 31 is not large and therefore, the amount of light emitted from the light emitting element 50 is increased by a comparatively low increase rate. Further, when the period T1 of the A phase signal SG1 or the like at a portion formed with the second light interception pattern 31*k*2 is deviated from the range of ±x % of the period T, the degree of smear of the linear scale 31 becomes large and therefore, the amount of light emitted from the light emitting element 50 is increased by an increase rate larger than that in the case in which the period T1 of the A phase signal SG1 or the like only at the portion formed with the third light interception pattern 31*k*3 is deviated from the range of ±x % of the period T. In this way, the amount of light emitted from the light emitting element 50 is increased in steps based on a result of detection by the linear encoder 31.

Further, at step S21, for example, the scale lifting mechanism 44 moves down the linear scale 31. Further specifically, the portion of the linear scale 31 having the predetermined width W irradiated with the light from the light emitting portion 41 (refer to FIG. 10) is relatively moved from a range which has been used for detecting the position (for example, an upper side range having the predetermined width W in FIG. 10) to further upper side. Since the linear scale 31 is attached to the support frame 16 by constituting the height direction by the short side direction of the linear scale 31, the ink mist brought about by ejecting ink from the printing head 2 is adhered to the lower side portion of the linear scale 31 and smear is made to be easy to be brought about at a lower side portion of the linear scale 31. Therefore, by moving down the linear scale 31 by the scale lifting mechanism 44, the position of the carriage 3 can be detected by utilizing the upper side portion of the linear scale 31 which is less smeared. As a result, according to the printer 1, printing by the predetermined number of sheets or predetermined time period can further be carried out.

Furthermore, at step S21, for example, the liner scale 31 is cleaned. The erroneous detection of the liner encoder 33 can be prevented by the cleaning of the liner scale 31.

When the processing at step S21 has been finished, detection of smear of the linear scale 31 and the processing at step 4 is finished.

Further, when the period T1 of the A phase signal SG1 or the like at the portion formed with the first light interception pattern 31*k*1 is deviated from the range of ±x % of the period T, at the portion formed with the smear detecting pattern 31*c*, the position cannot be detected accurately (that is, accurate reading cannot be carried out) by the linear encoder 33 (step S22). That is, in this case, it is determined that the linear scale 31 is smeared. Further, since the linear scale 31 is smeared, it is determined that there is a high possibility of detecting the position erroneously by the linear encoder 33 in a state as it is. When it is determined that the linear scale 31 is smeared, the CR motor 4 is stopped (step S23).

Here, as described above, according to the embodiment, when the period T1 of the A phase signal SG1 or the like at the portion formed with the first light interception pattern 31*k*1 is deviated from the range of ±x % of the period T, it is determined that the linear scale 31 is smeared. However, it may be determined that the linear scale 31 is smeared when the period T1 of the A phase signal SG1 or the like at the portion formed with the second light interception pattern 31*k*2 or the third light interception pattern 31*k*3 is deviated from the range of ±x % of the period T.

Further, when the portion of intercepting light from the light emitting portion 41 is brought about over the range of the predetermined width W at the portion in the longitudinal direction of the linear scale 31 at the second light transmitting portion 31*h* by the adhered portions D1, D2 and the light interception portion 31*m* as shown by FIG. 18, the period T1 of the A phase signal SG1 or the B phase signal SG2 becomes shorter than the period T as shown by FIG. 17A. In contrast thereto, when the second light transmitting portion 31*h* is blocked over the range of the predetermined width W by the ink mist, the period of the A phase signal SG1 or the B phase signal SG2 becomes longer than the period T.

When the CR motor 4 is stopped at step S23, the printer 1 carries out the predetermined processing (step S24). For example, it is confirmed how many sheets of the printing sheets P are printed, the linear scale 31 is smeared, or when the timing of detecting smear of the linear scale 31 is present at every predetermined time period, how much time the printing is carried out, the linear scale 31 is smeared. Specifically, the control portion 37 calculates a number of printing sheets or a printing time period until the linear scale 31 is smeared. By the confirmation, the number of printing sheets or the printing time period until the linear scale 31 is smeared can be grasped.

Further, at step S24, for example, a display apparatus (not illustrated) of a liquid crystal display apparatus or the like attached to the main body chassis 8 of the printer 1 is displayed with an attention message stating that the linear scale 31 is smeared, an error message owing to smear of the linear scale 31 or the like. By displaying the message, smear of the linear scale 31 can be informed to a user, and a failure in operation of the printer 1 by erroneous detection by the linear scale 33 can be prevented.

Further, at step S24, for example, by stopping to operate the printer 1, the printer 1 is made to be unable to be used. By making the printer 1 unable to be used, the failure in operating the printer 1 by the erroneous detection by the linear scale 33 can be prevented, and injury or the like of a user by wild run of the carriage 3 or the like can be prevented. Further, at step S24, the control portion 37 may carry out predetermined setting to stop operating the printer 1 after further printing by a predetermined time period thereafter, or after printing a predetermined number of sheets.

Furthermore, at step S24, for example, the control portion 37 sets an upper limit of a speed of moving the carriage 3. Even when the linear scale 31 is smeared and the amount of light transmitting through the first light transmitted portion 31*f* and received by the light receiving portion 42 is reduced or the like, when the speed of moving the carriage 3 is slow to some degree, the erroneous detection by the linear encoder 33 can be avoided. Therefore, by setting the upper limit of the speed of moving the carriage 3, even when the linear scale 31 is smeared, the erroneous detection by the linear encoder 33 can be prevented. As a result, the printer 1 can further print by the predetermined number of sheets or the predetermined time period. Further, at step S24, an upper limit of a speed of feeding the printing sheet P by the PF drive roller 6 may be set.

Further, at step S24, for example, an amount of light from the light emitting element 50 is increased by adjusting the variable resistor 52. By increasing the amount of light emitted from the light emitting element 50, even when the linear scale 31 is smeared, the printer 1 can further print by the predetermined number of sheets or the predetermined time period. In this case, the amount of light emitted from the light emitting element 50 can be adjusted by the variable resistor 52 and therefore, the amount of light emitted from the light emitting element 50 can easily be increased. Further, an increase rate of the amount of light emitted from the light emitting element 50 in this case becomes larger than an increase rate of a light emitting amount when the period T1 of the A phase signal SG1 or the like at the portion formed with the second light interception pattern 31*k*2 is deviated from the range of ±x % of the period T.

Further, at step S24, for example, the scale lifting mechanism 44 moves down the linear scale 31. That is, a portion of the linear scale 31 having the predetermined width W irradiated with light from the light emitting portion 41 (refer to FIG. 8) is relatively moved to an upper side. The linear scale 31 is attached to the support frame 16 by constituting the height direction by the short side direction and therefore, the ink mist brought about by ejecting ink from the printing head 2 is adhered to a lower side portion to make the lower side portion easy to be smeared. Therefore, by moving down the linear scale 31 by the scale lifting mechanism 44, the position of the carriage 3 can be detected by utilizing an upper side portion of the linear scale 31 which is less smeared. As a result, the printer 1 can print by the predetermined number of sheets or the predetermined time period. Further, the linear scale 31 may be moved down based on a result of detection by the linear encoder 33 by operating to move down the linear scale 31 also at S21.

Furthermore, at step S24, for example, the linear scale 31 is cleaned. By the cleaning, erroneous detection by the liner encoder 33 can be prevented.

When the above-described processing at step S24 has been finished, detection of smear of the linear scale 31 and the processing at step S4 is finished.

Further, in the above-described example, it is determined whether the linear scale 31 is smeared by determining whether the period (frequency) of the A phase signal SG1 or the B phase signal SG2 when the photosensor 32 passes the portion formed with the smear detecting pattern 31*c* is deviated from the range of ±x % of the period T (frequency) constituting the base at step S15 and determining whether the period T1 of the A phase signal SG1 or the like at the portion formed with the first light interception pattern 31*k*1 is deviated from the range of ±x % of the period T. Otherwise, for example, it may be determined whether the linear scale 31 is smeared by determining whether the phases of the A phase signal SG1 and the B phase signal SG2 are reversed when the photosensor 32 passes the portion formed with the smear detecting pattern 31*c* (step S25) and determining whether the phases are reversed at the portion formed with the first light interception pattern 31*k*1 (step S29) as in a flowchart shown in FIG. 15. Further, also in this case, it may be determined that the linear scale 31 is smeared when the phases are reversed at the portion formed with the second light interception pattern 31*k*2 or the third light interception pattern 31*k*3.

Specifically, it may be determined whether the linear scale 31 is smeared as follows. That is, for example, as shown by FIG. 17B, in moving the carriage 3 from 0 column side to 80 column side, when the A phase signal SG1 which has risen when the B phase signal SG2 is at the low level, rises when the B phase signal SG2 is at the high level (that is, the phases of the A phase signal SG1 and the B phase signal SG2 are reversed) as shown by FIG. 18, there is brought about a portion of intercepting light from the light emitting portion 41 over the range of the predetermined width W at the portion in the longitudinal direction of the linear scale 31 by the adhered portions D1, D2 and the light interception portion 31*m*. Further, when the portion of intercepting light is brought about at the second light transmitting portion 31*h* formed with the first light interception pattern 31*k*1, at the portion formed with the smear detecting pattern 31*c*, the position cannot accurately be determined (that is, accurate reading cannot be carried out) by the linear encoder 33 (step S22). In this case, it is determined that the linear scale 31 is smeared and it is determined that there is a high possibility of erroneously detecting the position by the linear encoder 33 in a state as it is.

Further, it may be determined whether the linear scale 31 is smeared by a combination of step S15 and step S19 as well as step S25 and step S29. That is, it may be determined whether the linear scale 31 is smeared by determining whether the period of the A phase signal SG1 or the B phase signal SG2 when the photosensor 32 passes the portion formed with the smear detecting pattern 31*c* is deviated from the range of ±x % of the period T constituting the base and determining whether the phases of the A phase signal SG1 and the B phase signal SG2 when the photosensor 32 passes the portion formed with the smear detecting pattern 31*c* are reversed.

Figure 14:
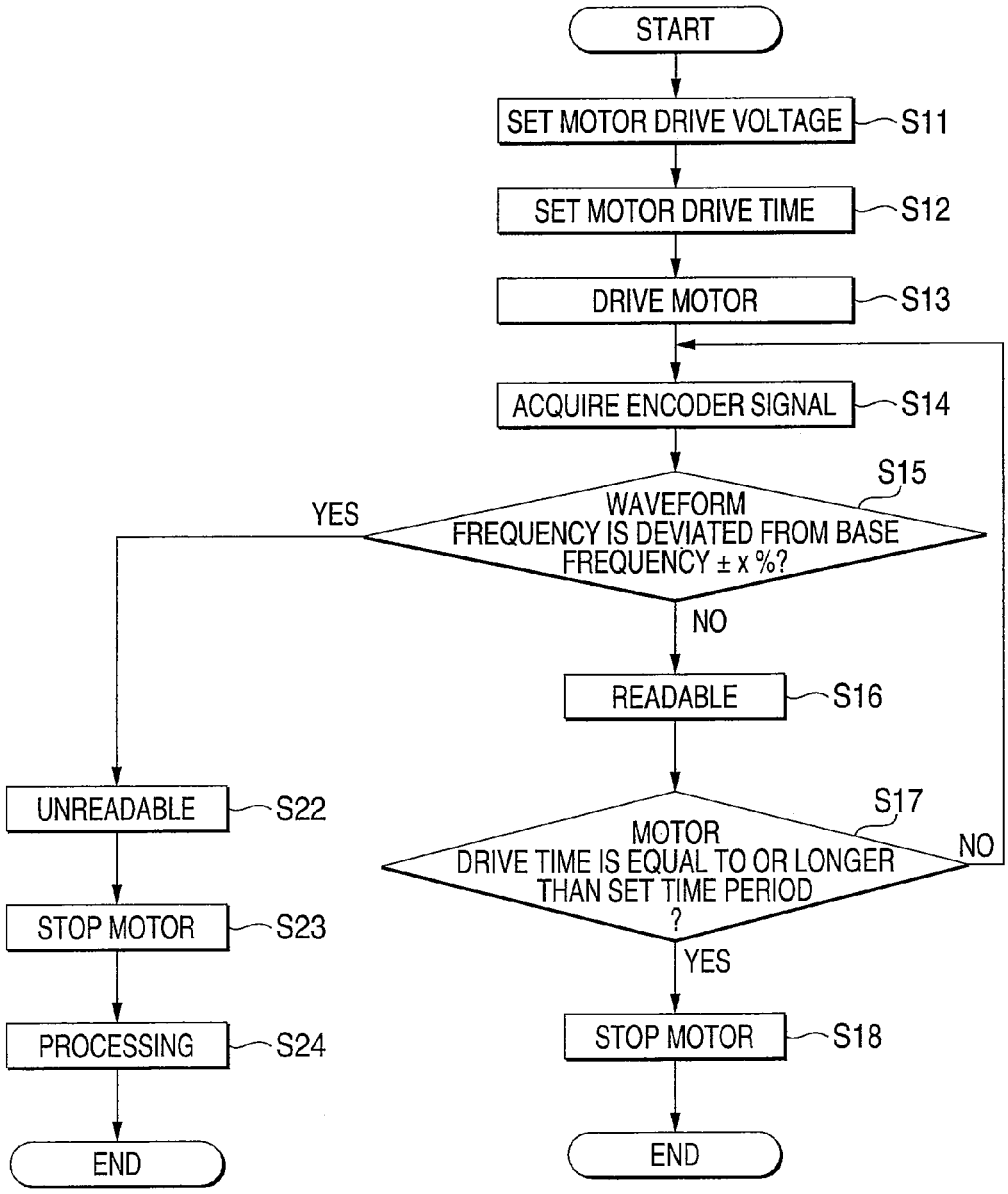
FIG. 14 is a flowchart showing other example of operation of detecting smear of the linear scale of FIG. 3.

FIG. 14 shows a flow chart showing a modified example of the operation shown in FIG. 13. The operation in FIG. 14 is different from the operation in FIG. 13 in that if it is determined that the period (or frequency) of the A phase signal SG1 or the B phase signal SG2 when the photosensor 32 passes the portion formed with the smear detecting pattern 31*c* is deviated from the range of ±x % (for example, ±15%) of the basis period T (or frequency) at the step S15 (YES) in FIG. 14, it is determined that at the portion formed with the smear detecting pattern 31*c*, the accurately position cannot be detected by the linear encoder 33 (step S22) without performing the processes at steps S19 through S21 in FIG. 13. The processes in FIG. 14 appended with same step numbers as the processes in FIG. 13 are performed as same as the processes in FIG. 13. Therefore, a detailed explanation thereof will be omitted.

Figure 16:
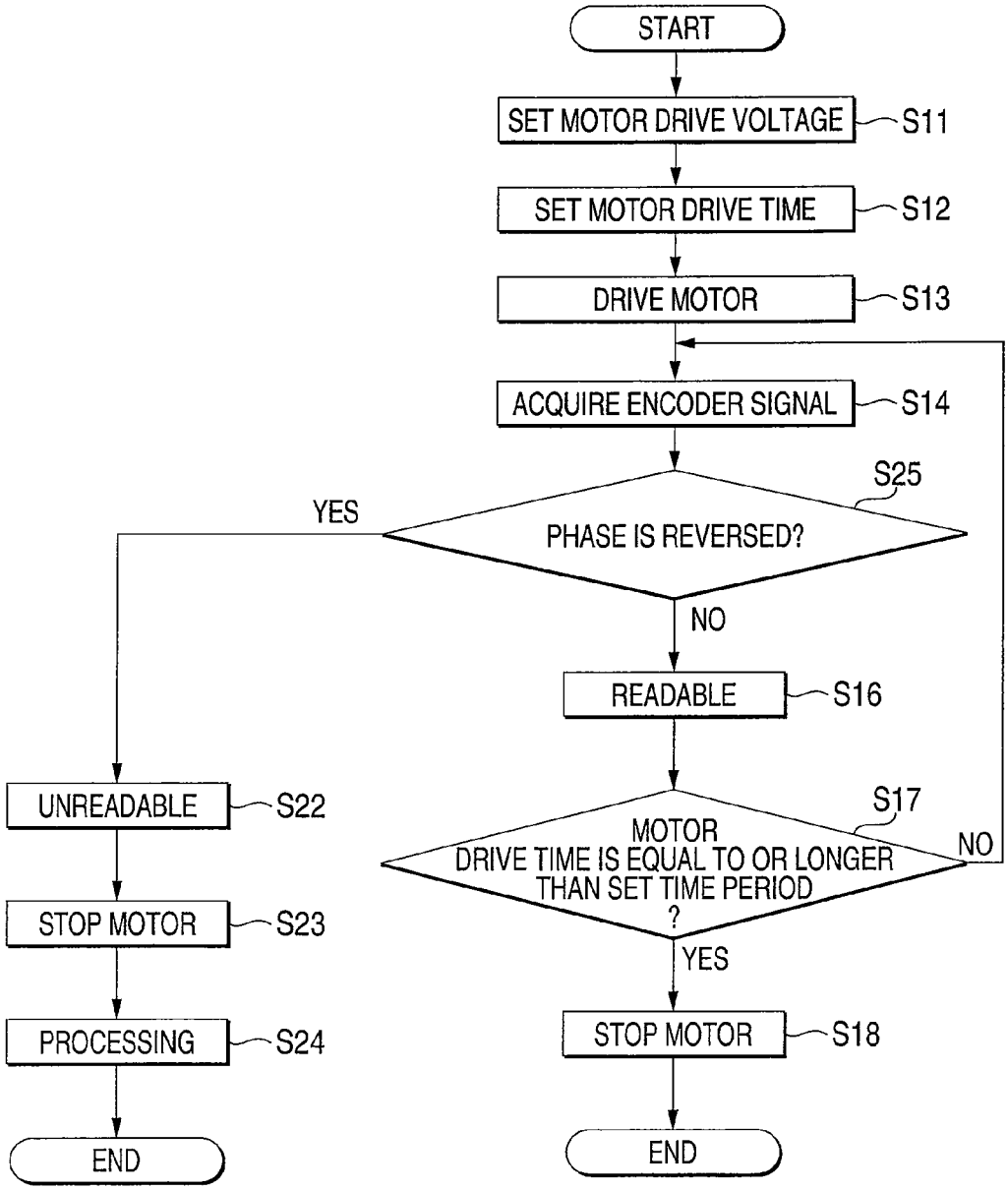
FIG. 16 is a flowchart showing other example of operation of detecting smear of the linear scale of FIG. 3.

FIG. 16 shows a flow chart showing a modified example of the operation shown in FIG. 15. The operation in FIG. 16 is different from the operation in FIG. 15 in that if it is determined that whether the phases of the A phase signal SG1 and the B phase signal SG2 are reversed when the photosensor 32 passes the portion formed with the smear detecting pattern 31*c* (step S25) at the step S15 (YES) in FIG. 14, it is determined that at the portion formed with the smear detecting pattern 31*c*, the accurately position cannot be detected by the linear encoder 33 (step S22) without performing the processes at steps S29, S20, S21 in FIG. 15. The processes in FIG. 16 appended with same step numbers as the processes in FIG. 15 are performed as same as the processes in FIG. 15. Therefore, a detailed explanation thereof will be omitted.

Main Effect of the Embodiment

According to the embodiment, the linear scale 31 includes the smear detecting pattern 31*c* alternately formed with the second light transmitting portion 31*h* and the second light interception portion 31*g* in addition to the position detecting pattern 31*b* for detecting the position of the carriage 3. Therefore, smear of the linear scale 31 can be detected by using the A phase signal SG1 or the B phase signal SG2 from the linear encoder 33 when the photosensor 32 passes the portion formed with the smear detecting pattern 31*c*. Further, by detecting smear of the linear scale 31, for example, there can be carried out various processings for preventing erroneous operation of the printer 1 which can be brought about by a failure in detecting the position by the linear encoder 33, or various processings for printing by a predetermined number of sheets or a predetermined time period even after detecting that the linear scale 31 is smeared. Further, by detecting smear of the linear scale 31, presence or absence of a necessity of cleaning the linear scale 31 can be confirmed.

Further, according to the embodiment, the position detecting pattern 31*b* and the smear detecting pattern 31*c* are arranged to be contiguous to each other in the short side direction of the linear scale 31. Therefore, smear of the linear scale 31 can be detected without effecting an influence on detection of the position of the carriage 3 which is carried out by moving the photosensor 32 in the longitudinal direction of the linear scale. Further, the linear encoder 33 can be downsized in the longitudinal direction of the linear scale 31. Therefore, also the printer 1 can be downsized in the longitudinal direction of the linear scale 31.

According to the embodiment, the smear detecting pattern 31*c* is arranged on the outer side of the position detecting pattern 31*b* in the longitudinal direction of the linear scale 31. Therefore, smear of the linear scale 31 can be detected without effecting an influence on detection of the position of the carriage 3. Further, smear of the linear scale 31 can be detected by a simple constitution of moving the carriage 3 moved from 0 column side to 80 column side in printing the printing sheet P further in the longitudinal direction of the linear scale 31.

According to the embodiment, the second light transmitting portion 31*h* is formed with the light interception pattern 31*k* for making the transmitting area of light from the light emitting portion 41 of the second light transmitting portion 31*h* smaller than the transmitting area of light from the light emitting portion 41 of the first light transmitting portion 31*f*, that is, making the transmittivity of light from the light transmitting portion 41 of the second light transmitting portion 31*h* smaller than the transmittivity of light from the light emitting portion 41 of the first light transmitting portion 31*f*. Therefore, when the ink mist is adhered to the linear scale 31 as smear, at the second light transmitting portion 31*h*, in comparison with the first light transmitting portion 31*f*, the portion of intercepting light is made to be easy to be produced at the portion in the longitudinal direction of the linear scale 31 over the range of the predetermined width W. Further, at the second light transmitting portion 31*h*, in comparison with the first light transmitting portion 31*f*, light is made to be easy to be blocked. For example, as shown by FIG. 14, by the adhered portions D1, D2 and the light interception portion 31*m*, the portion of intercepting light from the light emitting portion 41 is made to be easy to be produced at the portion of the linear scale 31 in the longitudinal direction over the range of the predetermined width W. Therefore, at the first light transmitting portion 31*f* used for detecting the position of the carriage 3, light is blocked at a portion or a total in the longitudinal direction of the linear scale 31 over the range of the predetermined width W, before bringing about erroneous detection at the linear encoder 33, smear of the linear scale 31 can be detected by the A phase signal SG1 or the B phase signal SG2 from the linear encoder 33 when the photosensor 32 passes the portion formed with the smear detecting pattern 31*c*.

According to the embodiment, the transmitting area of light of the second light transmitting portion 31*h* constitutes the constant rate relative to the transmitting area of light of the first light transmitting portion 31*f*. That is, the trasmittivity of light of the second light transmitting portion 31*h* constitutes the constant rate relative to the transmittivity of light of the first light transmitting portion 31*f*. Therefore, a detection limit of the linear encoder 31 can be recognized. That is, by investigating the rate of the transmitting area or the transmittivity of light of the second light interception portion 31*h* when smear is detected by the linear encoder 31 and erroneous detection is brought about at the linear encoder 31, from the rate of the transmitting area or the transmittivity of light of the second light transmitting portion 31*h*, there can be recognized the detection limit of the linear encoder 31 of by what degree of smear is brought about, erroneous detection is brought about by the linear encoder 31.

According to the embodiment, the light interception pattern 31*k* is formed by the light interception portion 31*m* in the shape of the skewed line inclined to the longitudinal direction of the linear scale 31. Therefore, smear of the linear scale 31 can simply and pertinently be detected. That is, in a case in which the light interception pattern is formed by a light interception portion in parallel with the longitudinal direction of the linear scale 31, when positions of the portion of the predetermined width W irradiated with light from the light emitting portion 41 (refer to FIG. 9) and the light interception portion in the short side direction of the linear scale 31 are shifted from each other, relative to the first light transmitting portion 31*f*, the transmitting area of light of the second light transmitting portion 31*h* cannot be reduced or the transmittivity of light cannot be made to be low. Further, when the light interception pattern is formed by a light interception portion orthogonal to the longitudinal direction of the linear scale, the light interception portion becomes a portion in the longitudinal direction for intercepting light. Therefore, at the second light transmitting portion 31*h*, it is difficult to form a portion of intercepting light by smear owing to the ink mist at a portion in the longitudinal direction over the range of the predetermined width W. Further, in a case in which the photosensor 32 passes the portion formed with the smear detecting pattern 31*c*, signals having periods different from those of the A phase signal SG1 and the B phase signal SG2 when the photosensor 32 passes the portion formed with the position detecting pattern 31*b* are outputted. Therefore, a processing at a control portion 37 for detecting smear of the linear scale 31 becomes complicated. From the above-described, when the light interception pattern 31*k* is formed by the light interception portion 31*m* in the shape of the skewed line, smear of the linear scale 31 can simply and pertinently be detected.

According to the embodiment, when smear of the linear scale 31 is detected, the light emitting amount from the light emitting element 50 is increased. Therefore, even when the linear scale 31 is smeared as described above, at the printer 1, printing by the predetermined number of sheets or the predetermined time period can further be carried out by a simple constitution.

According to the embodiment, the smear detecting pattern 31*c* is arranged on the lower side of the position detecting pattern 31*b*. According to the printer 1, the linear scale 31 is arranged by constituting the height direction by the short side direction of the linear scale 31 and therefore, smear is made to be easy to be brought about at the lower side portion of the linear scale 31. Therefore, when the smear detecting pattern 31*c* is arranged on the lower side of the of the position detecting pattern 31*b*, at the first light transmitting portion 31*f*, light is blocked over the range of the predetermined width W at a portion or a total in the longitudinal direction of the linear scale 31, before bringing about erroneous detection of the linear encoder 33, smear of the linear scale 31 can firmly be detected by the A phase signal SG1 or the B phase signal SG2 from the linear encoder 33 when the photosensor 32 passes the portion formed with the smear detecting pattern 31*c*.

According to the embodiment, when smear of the linear scale 31 is detected, the scale lifting mechanism 44 moves down the linear scale 31 by the variable resistor 52. Therefore, as described above, the position of the carriage 3 can be detected by utilizing an upper side portion of the linear scale which is less smeared. As a result, according to the printer 1, printing by the predetermined number of sheets or the predetermined time period can further be carried out.

According to the embodiment, the linear scale 31 includes the smear detecting pattern 31*c* in addition to the position detecting pattern 31*b* for detecting the position of the carriage 3. Therefore, smear of the linear scale 31 can be detected by using the A phase signal SG1 or the B phase signal SG2 from the linear encoder 33 when the photosensor 32 passes the portion formed with the smear detecting pattern 31*c*. Further, by detecting smear of the linear scale 31, for example, there can be carried out various processings for preventing erroneous operation of the printer 1 which can be brought about the failure in detecting the position by the linear encoder 33 owing to smear of the linear scale 31, there can be carried out various processings for further printing by the predetermined number of sheets or the predetermined time period even after detecting that smear is brought about by the linear scale 31, or there can be confirmed presence or absence of an necessity of cleaning the linear scale 31.

Further, according to the embodiment, the second light transmitting portion 31*h* is formed with the light interception pattern 31*k* for making the transmitting area and the transmittivity of light of the second light transmitting portion 31*h* smaller than the transmitting area and the transmittivity of light of the first light transmitting portion 31*f*. Therefore, when the ink mist is adhered to the linear scale 31 as smear, at the second light transmitting portion 31*h*, in comparison with the first light transmitting portion 31*f*, the portion of intercepting light is made to be easy to be produced over the range of the predetermined width W at the portion in the longitudinal direction of the linear scale 31. Further, at the second light transmitting portion 31*h*, in comparison with the first light transmitting portion 31*f*, light is made to be easy to be blocked. Therefore, at the first light transmitting portion 31*f* used for detecting the position of the carriage 3, light is blocked over the range of the predetermined width W at a portion or a total in the longitudinal direction of the linear scale 31. Therefore, before the erroneous detection by the linear encoder 33 is brought about, smear of the linear scale 31 can be detected by the A phase signal SG1 or the like of the linear encoder 33 when the photosensor 32 passes the portion formed with the linear detecting pattern 31*c*.

Further, according to the smear detecting pattern 31*c* of the embodiment, the transmitting area or the transmittivity of the second light transmitting portion 31*h* is changed by changing the first through the third light interception patterns 31*k*1 through 31*k*3. Therefore, at the second light transmitting portion 31*h* formed with the third light interception pattern 31*k*3, light is blocked at a comparatively early stage by smear of the linear scale 31, at the second transmitting portion 31*h* formed with the first light interception pattern 31*k*1, light is blocked at a comparatively later stage. Therefore, the degree of smear brought about at the linear scale 31 can be detected by detecting at which light interception pattern 31*k* of the first through the third light interception patterns 31*k*1 through 31*k*3 a disturbance is brought about in the period of the A phase signal SG1 or the like at the portion formed therewith (that is, at which light interception pattern 31*k*, the portion of intercepting light is brought about at the second light transmitting portion 31*h* formed therewith).

Further, a change over time of the smear brought about at the linear scale 31 can be grasped by confirming the number of printing sheets or the printing time period when the disturbance is brought about in the period of the A phase signal SG1 or the like at the portion formed with the first through the third light interception patterns 31*k*1 through 31*k*3 as in the embodiment. As a result, the time period, the number of printing sheets or the like until bringing about erroneous detection finally by the linear encoder 33 can be predicted. Further, when the disturbance is brought about assumedly in the period of the A phase signal SG1 or the like at the portion formed with the second light interception pattern 31*k*2 and at that occasion, the erroneous detection is brought about by the linear encoder 33, there can be recognized the detection limit of the linear encoder of how much degree of smear is brought about, the erroneous detection is brought about by the linear encoder 33.

According to the smear detecting pattern 31*c* of the embodiment, the light interception pattern 31*m* is changed in the longitudinal direction of the linear scale 31. Therefore, the degree of smear brought about at the linear scale 31 can be detected by the simple constitution of utilizing movement of the carriage 3 moving from 0 column side to 80 column side in printing the printing sheet P.

According to the embodiment, the light interception pattern 31*k* is formed by the light interception portion 31*m* in the shape of the skewed line inclined to the longitudinal direction of the linear scale 31. Here, in a case in which the light interception pattern is formed by a light interception portion in parallel with the longitudinal direction of the linear scale, when positions of the portion of the predetermined width W (refer to FIG. 8) irradiated with light from the light emitting portion 41 and the light interception portion are shifted from each other in the short side direction of the linear scale 31, relative to the first light transmitting portion 31*f*, the transmitting area of light of the second light transmitting portion 31*f* cannot be reduced or the transmittivity of light cannot be reduced. Further, when the light interception pattern is formed by a light interception portion orthogonal to the longitudinal direction of the linear scale, the light interception portion becomes a portion in the longitudinal direction of intercepting light. Therefore, at the second light transmitting portion 31*h*, it is difficult to form a portion of intercepting light by smear caused by the ink mist at the portion in the longitudinal direction over the range of the predetermined width W. Further, when the photosensor 32 passes the portion formed with the smear detecting pattern 31*c*, a signal having a period different from that of the A phase signal SG1 when the photosensor 32 passes the portion formed with the position detecting pattern 31*b* is outputted. Therefore, a processing at the control portion 37 for detecting smear of the linear scale 31 becomes complicated. According to the above-described, when the light interception pattern 31*k* is formed by the light interception portion 31*m* in the shape of the skewed line, smear of the linear scale 31 can simply and pertinently be detected.

According to the embodiment, the amount of light emitted from the light emitting element 50 is increased based on the detection result by the linear encoder 33. That is, according to the embodiment, when the period T1 of the A phase signal SG1 or the like at the portion formed with the third light interception pattern 31*k*3 is deviated from the range of ±x % of the period T, the amount of light emitted from the light emitting element 50 is increased by the predetermined increase rate, thereafter, when the period T1 of the A phase signal SG1 or the like at the portion formed with the second light interception pattern 31*k*2 is deviated from the range of ±x % of the period T, the amount of light emitted from the light emitting element 50 is further increased by the predetermined increase rate, thereafter, when the period T1 of the A phase signal SG1 or the like at the portion formed with the first light interception pattern 31*k*1 is deviated from the range of ±x % of the period T, the amount of light emitted from the light emitting element 50 is further increased by the predetermined increase rate. Therefore, the amount of light emitted from the light emitting element 50 can be restrained while ensuring the light amount necessary for detecting the position of the carriage 3. Therefore, pertinent position detection and a reduction in power consumption can simultaneously be realized.

Other Embodiment

Although the above-described embodiment is an example of a preferable embodiment of the invention, the invention is not limited thereto but can variously be modified or changed within the range not deviated from the gist of the invention.

Figure 19:
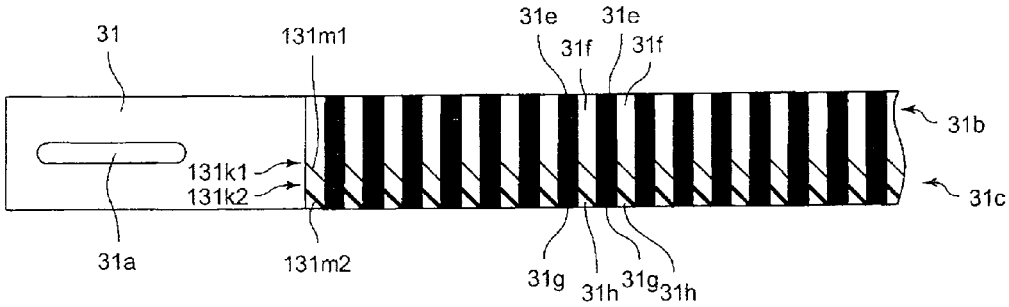
FIG. 19 is a view showing 80 column side of a linear scale according to other embodiment.

According to the above-described embodiment, the smear detecting pattern 31*c* is formed on 80 column side of the linear scale 31 to be contiguous to the outer side of the position detecting pattern 31*b*. Otherwise, for example, as shown by FIG. 19, the position detecting pattern 31*b* and the smear detecting pattern 31*c* may be arranged to be contiguous to each other in the short side direction of the linear scale 31. In this case, smear of the linear scale 31 can be detected without effecting an influence on detection of the position of the carriage 3. Further, the linear encoder 33 can be downsized in the longitudinal direction of the linear scale 31. Particularly, as shown by FIG. 19, when the smear detecting pattern 31*c* is arranged on the lower side of the position detecting pattern 31*b*, smear is easy to be brought about at the lower side portion of the linear scale 31. Therefore, when the smear detecting pattern 31*c* is arranged on the lower side of the position detecting pattern 31*b*, at the first light transmitting portion 31*f*, light is blocked over the range of the predetermined width W at a portion or a total in the longitudinal direction of the linear scale 31, before bringing about erroneous detection by the linear encoder 33, smear of the linear scale 31 can firmly be detected by the A phase signal SG1 or the like from the linear encoder 33 when the photosensor 31 passes the portion formed with the smear detecting pattern 31*c*. Further, the smear detecting pattern 31*c* may be formed on the upper side of the position detecting pattern 31*b*, and the smear detecting patterns 31*c* may be formed on both sides in the up and down direction of the position detecting pattern 31*b*.

Further, as shown by FIG. 19, when the position detecting pattern 31*b* and the smear detecting pattern 31*c* are arranged to be contiguous to each other in the short side direction of the linear scale 31, the second light transmitting portion 31*h* may be formed with a first and a second light interception pattern 131*k*1, 131*k*2 having transmitting areas and transmittivities different from each other of light from the light transmitting portion 41 in the short side direction of the linear scale 31. Specifically, by a first light interception portion 131*m*1 in a shape of a skewed line inclined to the longitudinal direction, the first light interception pattern 131*k*1 may be formed, and by a second light interception portion 131*m*2 in parallel with the first light interception portion 131*m*1 and having a width wider than that of the first light interception portion 131*m*1 the second light interception pattern 131*k*2 may be formed in this order from the upper side. In this case, the linear encoder 33 can be downsized in the longitudinal direction of the linear scale.

Further, when the linear scale 31 is constituted as shown by FIG. 19, the scale lifting mechanism 44 may move up the linear scale 31 such that light from the light emitting portion 41 which has irradiated to the position detecting pattern 31*b* is irradiated to the smear detecting pattern 31*c* in the step S3. Further, the degree of smear brought about at the linear scale 31 can be detected similar to the above-described embodiment by detecting smear of the linear scale 31 by changing the amount of moving up the linear scale 31 by the scale lifting mechanism 44 such that light from the light emitting portion 41 is irradiated to the portion formed with the first light interception pattern 131*k*1, or irradiated to the portion formed with the second light interception pattern 131*k*2.

Figure 20:
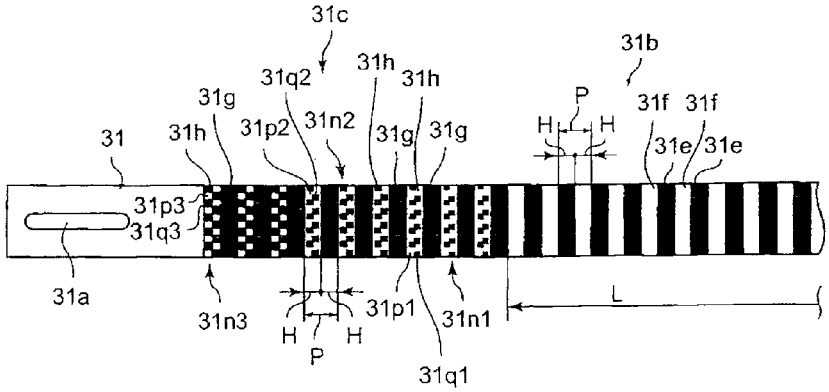
FIG. 20 is a view showing 80 column side of a linear scale according to other embodiment.

Further, in the above-described embodiment, the second light transmitting portion 31*h* is formed with the first through the third light interception patterns 31*k*1 through 31*k*3 by pluralities of the first through the third light interception portions 31*m*1 through 31*m*3 in the shape of the skewed line. Otherwise, for example, as shown by FIG. 20, a first through a third light interception pattern 31*n*1 through 31*n*3 may be formed by a first through a third light interception portion 31*q*1 through 31*q*3 in a rectangular shape arranged in a checker pattern along with a first through a third light transmitting portion 31*p*1 through 31*p*3 in a rectangular shape. That is, the first through the third light interception patterns 31*n*1 through 31*n*3 gradually reducing transmitting areas and the transmittivities of light of the second light transmitting portion 31*h* may be formed by the first through the third light interception portions 31*q*1 through 31*q*3 arranged in the checker pattern and gradually increasing the areas along with the first through the third light transmitting portions 31*p*1 through 31*p*3 gradually reducing the areas. In this case, the light interception pattern 31*m* is easily formed. Further, macroscopically, light from the light emitting portion 41 is blocked in the shape of the skewed line by the first through the third light interception portions 31$q$1 through 31$q$3 and therefore, an effect similar to that when the first through the third light interception patterns 31$k$1 through 31$k$3 are formed by the first through the third light interception portions 31$m$1 through 31$m$3 in the shape of the skewed line can be achieved.

Figure 21:
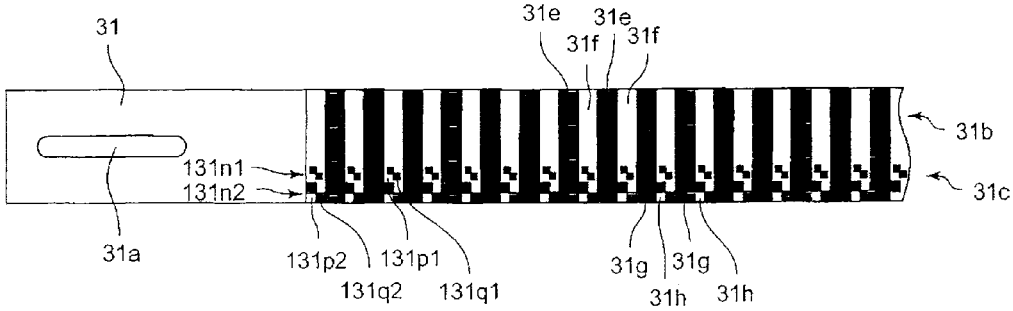
FIG. 21 is a view showing 80 column side of a linear scale according to other embodiment.

Similarly, in place of the first light interception portion 131$m$1, the second light interception portion 131$m$2 in the shape of the skewed line shown in FIG. 19, as shown by FIG. 21, a first light interception portion 131$n$1, a second light interception portion 131$n$2 may be formed by a first through a third light interception portions 131$q$1, 131$q$2 arranged in the checker pattern and gradually increasing the areas along with a first, a second light transmitting portions 131$p$1, 131$p$2 gradually increasing the areas.

Figure 22:
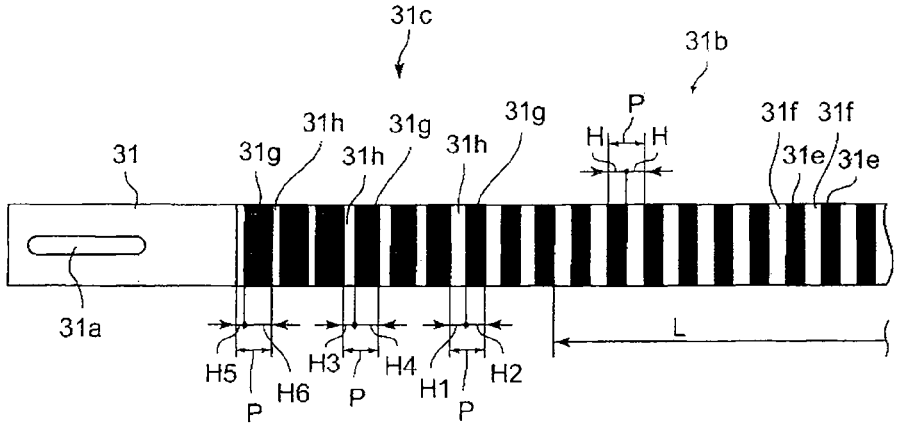
FIG. 22 is a view showing 80 column side of a linear scale according to other embodiment.
Figure 23:
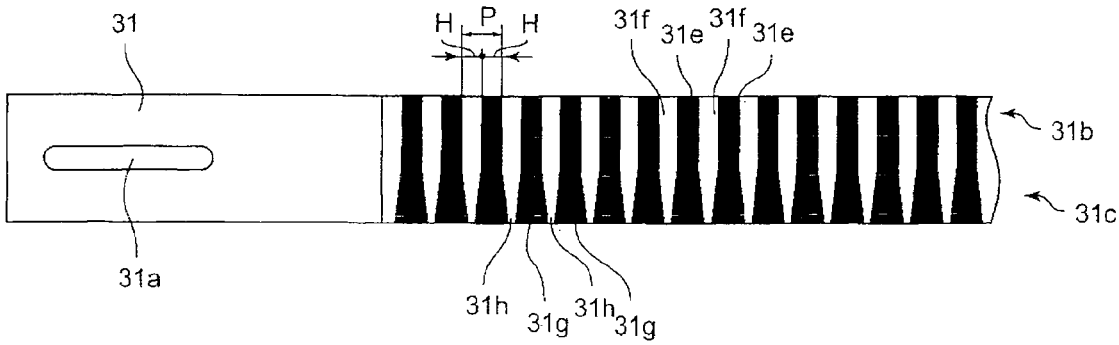
FIG. 23 is a view showing 80 column side of a linear scale according to other embodiment.

Further, as shown by FIG. 22, widths W1 through W3 of the second light transmitting portions 31$h$ may be formed to be narrower than the width H of the first light transmitting portion 31$f$ and at the smear detecting pattern 31$c$, the widths H1 through H3 of the second light transmitting portions 31$h$ may be changed. For example, the smear detecting pattern 31$c$ may be formed such that the width H1 of first three of the second light transmitting portions 31$h$, the width H3 of next three of the second light transmitting portions 31$h$ and the width H5 of final three of the second light transmitting portions 31$h$ are gradually narrowed in this order from 0 column side to 80 column side. In this case, for example, the width H2 of first three of the second light interception portions 31$g$, the width H4 of next three of the second light interception portions 31$g$ and the width H6 of final three of the second light interception portions 31$g$ may be formed to gradually widen from 0 column side to 80 column side. Further, in this case, for example, all of a sum of the width H1 and the width H2, a sum of the width H3 and the width H4 and a sum of the width H5 and the width H6 constitute the pitch P of brightness/darkness. Further, when the width H1 through H3 of the second light transmitting portions 31$h$ are formed to be narrower than the width H of the first light transmitting portion 31$f$, the second light transmitting portion 31$h$ may not be formed with the light interception pattern as shown by FIG. 22 or may be formed with the light interception pattern.

When the linear scale 31 is constituted as shown by FIG. 22, by the ink mist adhered to the linear scale 31, at the second light transmitting portion 31$h$, in comparison with the first light transmitting portion 31$f$, light is made to be easy to be blocked. Therefore, at the first light transmitting portion 31$f$ used for detecting the position of the carriage 3, light is blocked over the range of the predetermined width W by a portion or a total in the longitudinal direction of the linear scale 31, before bringing about erroneous detection by the linear encoder 33, smear of the linear scale 31 can be detected by the A phase signal SG1 or the like from the linear encoder 33 when the photosensor 32 passes the portion formed with the smear detecting pattern 31$c$. Further, at the smear detecting pattern 31$c$, the widths H1 through H3 of the second light transmitting portions 31$h$ are changed and therefore, the degree of smear brought about at the linear scale 31 can be detected. Further, by detecting the degree of smear of the linear scale, a change over time of smear brought about at the linear scale 31 can be grasped and the detection limit of the linear encoder 33 can be recognized. Further, since the widths H1 through H3 of the second light transmitting portion 31$h$ are changed in the longitudinal direction of the linear scale 31, the degree of smear brought about the linear scale 31 can be detected by a simple constitution of utilizing operation of the carriage 3.

Further, also when the position detecting pattern 31$b$ and the smear detecting pattern 31$c$ are arranged to be contiguous to each other in the short side direction of the linear scale 31, as shown by FIG. 11, the width of the second light transmitting portion 31$h$ may be formed to be narrower than the width H of the first light transmitting portion 31$f$ and the width of the second light transmitting portion 31$h$ may continuously be changed in the short side direction of the linear scale 31.

As shown by FIG. 8 and FIG. 19 through FIG. 23, according to the above-described linear scale 31, when the position detecting pattern 31$b$ and the smear detecting pattern 31$c$ are contiguous to each other in the longitudinal direction of the linear scale 31, the transmitting area or the like of the second light transmitting portion 31$h$ is changed or the widths H1 through H3 of the second light transmitting portions 31$h$ are changed in the longitudinal direction. Further, when the position detecting pattern 31$b$ and the smear detecting pattern 31$c$ are contiguous to each other in the short side direction of the linear scale 31, the transmitting area or the like of the second light transmitting portion 31$h$ is changed or the width of the second light transmitting portion 31$h$ is changed in the short side direction. Otherwise, for example, when the position detecting pattern 31$b$ and the smear detecting pattern 31$c$ are contiguous to each other in the longitudinal direction, the transmitting area or the like of the second light transmitting portion 31$h$ may be changed or the width of the second light transmitting portion 31$h$ may be changed in the short side direction, when the position detecting pattern 31$b$ and the smear detecting pattern 31$c$ are contiguous to each other in the short side direction, the transmitting area or the like of the second light transmitting portion 31$h$ may be changed or the width of the second light transmitting portion 31$h$ may be changed in the longitudinal direction.

Further, in the above-described embodiment, the pitch P of brightness/darkness formed by the second light transmitting portion 31$h$ and the second light interception portion 31$g$ are the same as the pitch P of brightness/darkness formed by the first light transmitting portion 31$f$ and the first light interception portion 31$e$. Otherwise, for example, the pitch of brightness/darkness formed by the second light transmitting portion 31$h$ and the second light interception portion 31$g$ may differ from the pitch P of brightness/darkness formed by the first light transmitting portion 31$f$ and the first light interception portion 31$e$.

Figure 24:
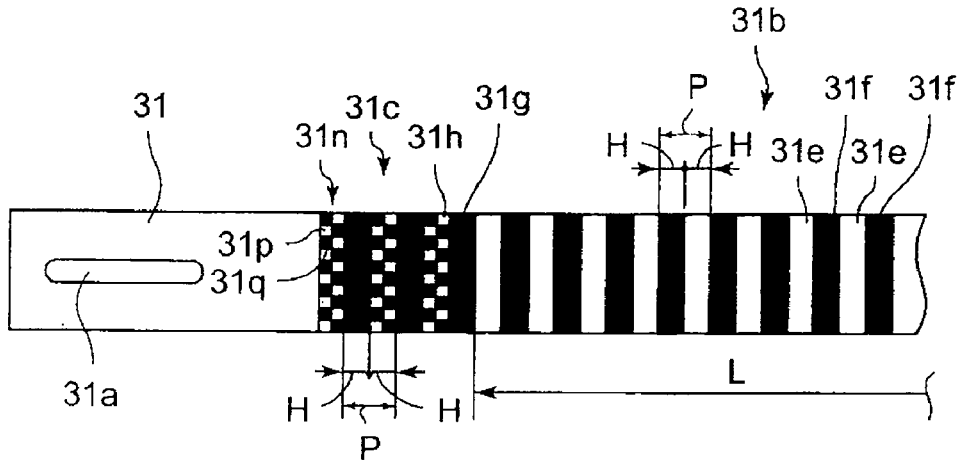
FIG. 24 is a view showing 80 column side of a linear scale according to other embodiment.
Figure 25:
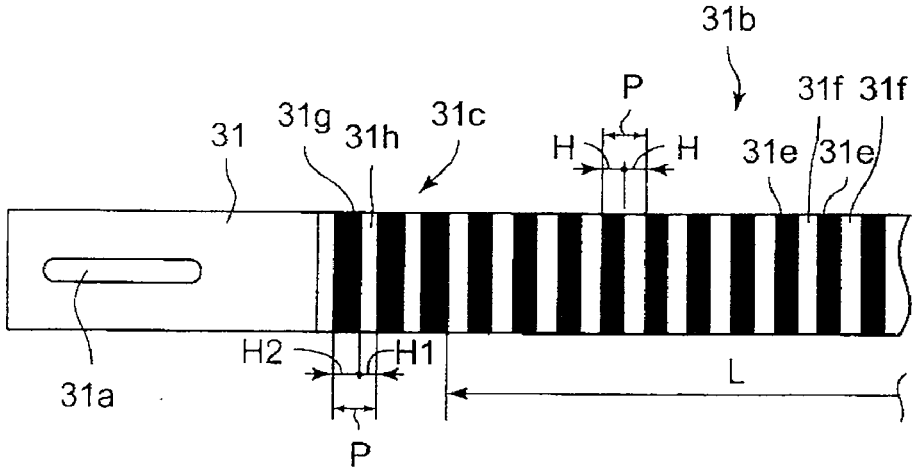
FIG. 25 is a view showing 80 column side of a linear scale according to other embodiment.

Further, for example, as shown by FIGS. 24 and 25, a light interception pattern 31$n$ may be formed by a light interception portion 31$q$ in a rectangular shape arranged in a checker pattern along with a light transmitting portion 31$p$ in a rectangular shape. In this case, the light interception pattern 31$n$ is formed easily. Further, macroscopically, light from the light emitting portion 41 is blocked in the shape of the skewed lined by the light interception portion 31$q$ and therefore, an effect similar to that when the light interception pattern 31$k$ is formed by the light interception portion 31$m$ in the shape of the skewed line can be achieved.

Figure 26:
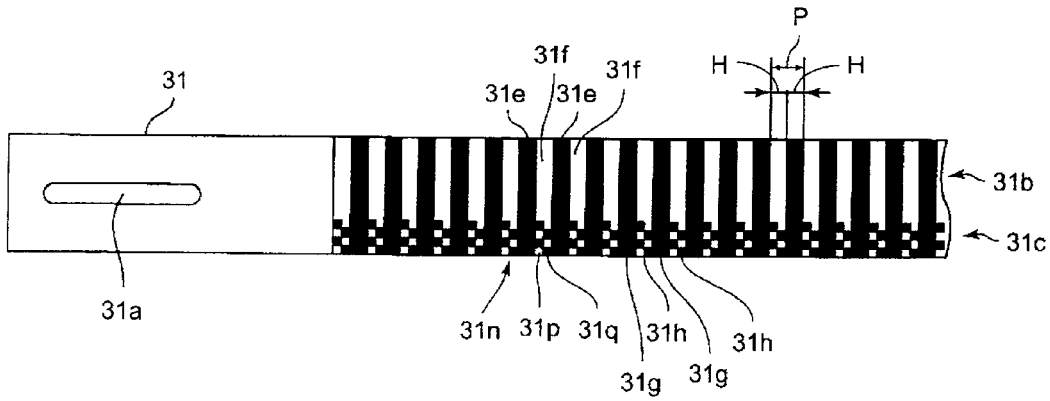
FIG. 26 is a view showing 80 column side of a linear scale according to other embodiment.
Figure 27:
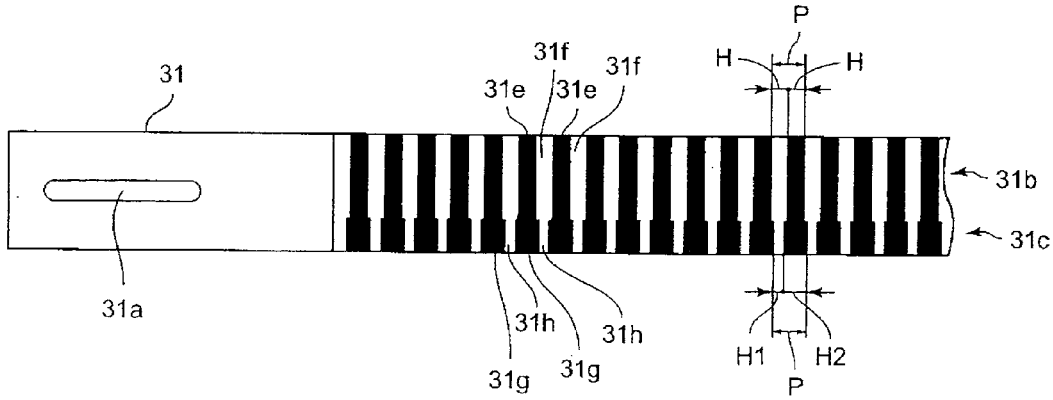
FIG. 27 is a view showing 80 column side of a linear scale according to other embodiment.

Further, as shown by FIGS. 26 and 27, a width H1 of the second transmitting portion 31$h$ may be formed to be narrower than the width H of the first light transmitting portion 31$f$. In this case, by the ink mist adhered to the linear scale 31, at the second light transmitting portion 31$h$, in comparison with the first light interception portion 31$f$, light is made to be easy to be blocked. Therefore, at the first light transmitting portion 31$f$ used for detecting the position of the carriage 3, light is blocked at a portion or a total in the longitudinal direction of the linear scale 31 over the range of the predetermined width W, before bringing about erroneous detection by the linear encoder 33, smear of the linear scale 31 can be detected by the A phase signal SG1 or the B phase signal SG2 from the linear encoder 33 when the photosensor 32 passes the portion formed with the smear detecting pattern 31*c*.

Further, when the width H1 of the second light transmitting portion 31*h* is formed to be narrower than the width H of the first light transmitting portion 31*f*, as shown by FIGS. 26 and 27, the second light transmitting portion may not be formed with the light interception pattern, or may be formed with light interception patterns 31*k*, 31*n*. Further, when the width H1 of the second light transmitting portion 31*h* is formed to be narrower than the width H of the first light transmitting portion 31*f*, for example, the second light interception portion 31*g* is formed by a width H2, as shown by FIGS. 26 and 27, a sum of the width H1 of the second light transmitting portion 31*h* and the width H2 of the second light interception portion 31*g* becomes the same as the pitch P of brightness/darkness formed by the first light transmitting portion 31*f* and the first light interception portion 31*e*.

Further, according to the above-described embodiment, the pitch P of brightness/darkness formed by the second light transmitting portion 31*h* and the second light interception portion 31*g* is the same as the pitch P of brightness/darkness formed by the first light transmitting portion 31*f* and the first light interception portion 31*e*. Otherwise, for example, the pitch of brightness/darkness formed by the second light transmitting portion 31*h* and the second light interception portion 31*g* may differ from the pitch P of brightness/darkness formed by the first light transmitting portion 31*f* and the first light interception portion 31*e*.

Further, although according to the above-described embodiment, the smear detecting pattern 31*c* is formed on 80 column side of the linear scale 31, the smear detecting pattern 31*c* may be formed on 0 column side of the linear scale 31 and on the outer side of the position detecting pattern 31*b* in the main scanning direction MS. Further, the smear detecting pattern 31*c* may be formed on the upper side or the lower side of the position detecting pattern 31*b*. In this case, in a state of moving up and down the linear scale 31 by the scale lifting mechanism 44, by moving the carriage 3, the A phase signal SG1 or the B phase signal SG2 when the photosensor 32 passes the portion formed with the smear detecting pattern 31*c* can be acquired. Further, it can be detected whether the linear scale 31 is smeared from the acquired A phase signal SG1 or B phase signal SG2.

Furthermore, although according to the above-described embodiment, the printer 1 includes the scale lifting mechanism 44, it is not necessary that the printer 1 includes the scale lifting mechanism 44 but the linear scale 31 may be fixed to the support frame 16.

Figure 28:
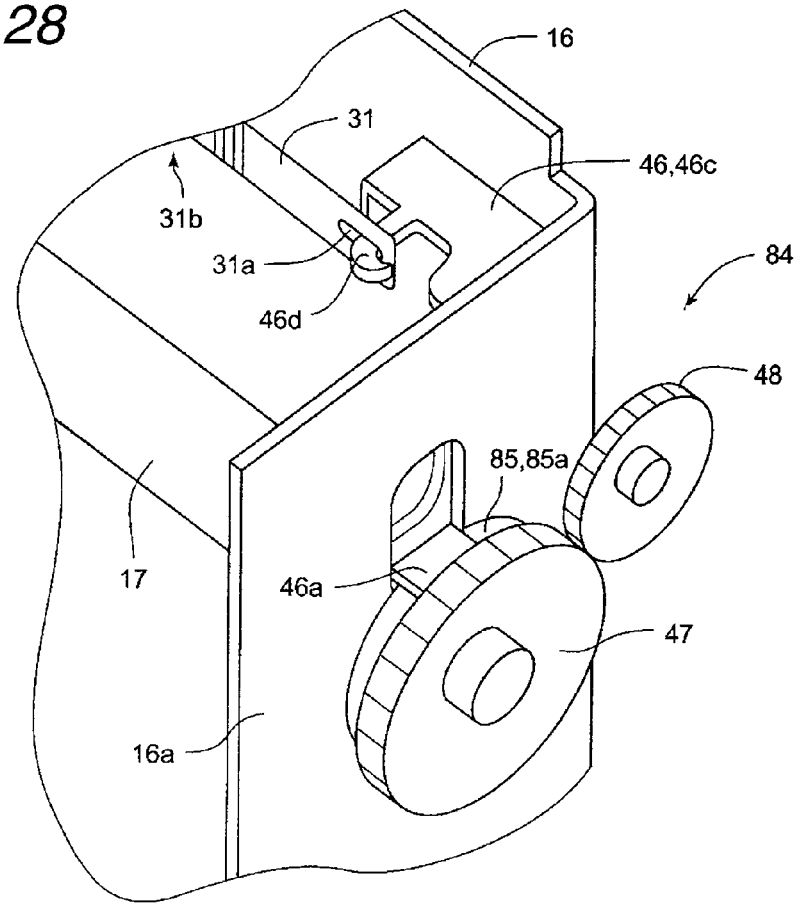
FIG. 28 is an outline perspective view showing a state of attaching one end portion of a linear scale according to other embodiment.

Furthermore, the constitution of the scale lifting mechanism is not limited to the constitution of the scale lifting mechanism 44 but as in a scale lifting mechanism 84 shown in FIG. 28, an eccentric cam 85 in correspondence with the eccentric cam 45 and the driven gear 47 may integrally be formed and the eccentric cam 85 and the driven gear 47 integral with each other may rotatably be attached to a front end of the guide shaft 17 on the outer side of the one side face 16*a*. In this case, as shown by FIG. 28, the attaching bracket 46 is formed with the contact portion 46*a* to rise from the base portion 46*b* to the outer side of the printer 1 to be brought into contact with a cam face 85*a* of the eccentric cam 85. Further, the cam face 85*a* is formed similar to the cam face 45*a*. Further, in this case, the guide shaft 17 is not rotated. Further, in FIG. 28, constitutions common to constitutions illustrated in FIG. 5 are attached with the same notations.

Further, according to the embodiment, when the position detecting pattern 31*b* and the smear detecting pattern 31*c* are arranged to be contiguous to each other in the short side direction of the linear scale 31, in detecting smear of the linear scale 31, at step S3, the scale lifting mechanism 44 moves up the linear scale 31. Otherwise, for example, when the printer 1 is provided with a gap adjusting mechanism for adjusting a gap between a nozzle face (lower face of FIG. 2) of the printing head and the platen 7, at step S3, the gap adjusting mechanism may move down the photosensor 32 attached to the carriage 3 along with the carriage 3 and light from the light emitting portion 41 which has been irradiated to the position detecting pattern 31*b* may be irradiated to the smear detecting pattern 31*c*. An explanation will be given of an outline constitution of the gap adjusting mechanism 70.

Figure 29:
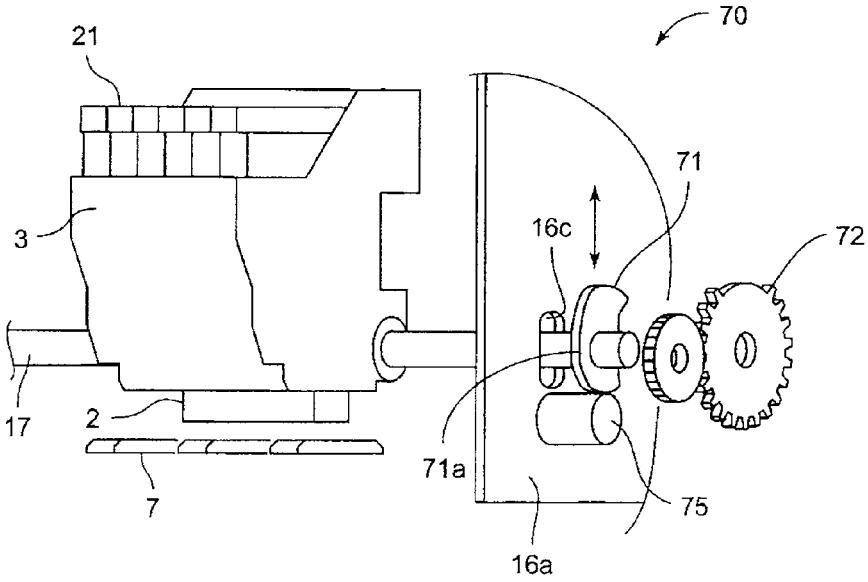
FIG. 29 is a view showing a part of a gap adjusting mechanism according to the embodiment.
Figure 30:
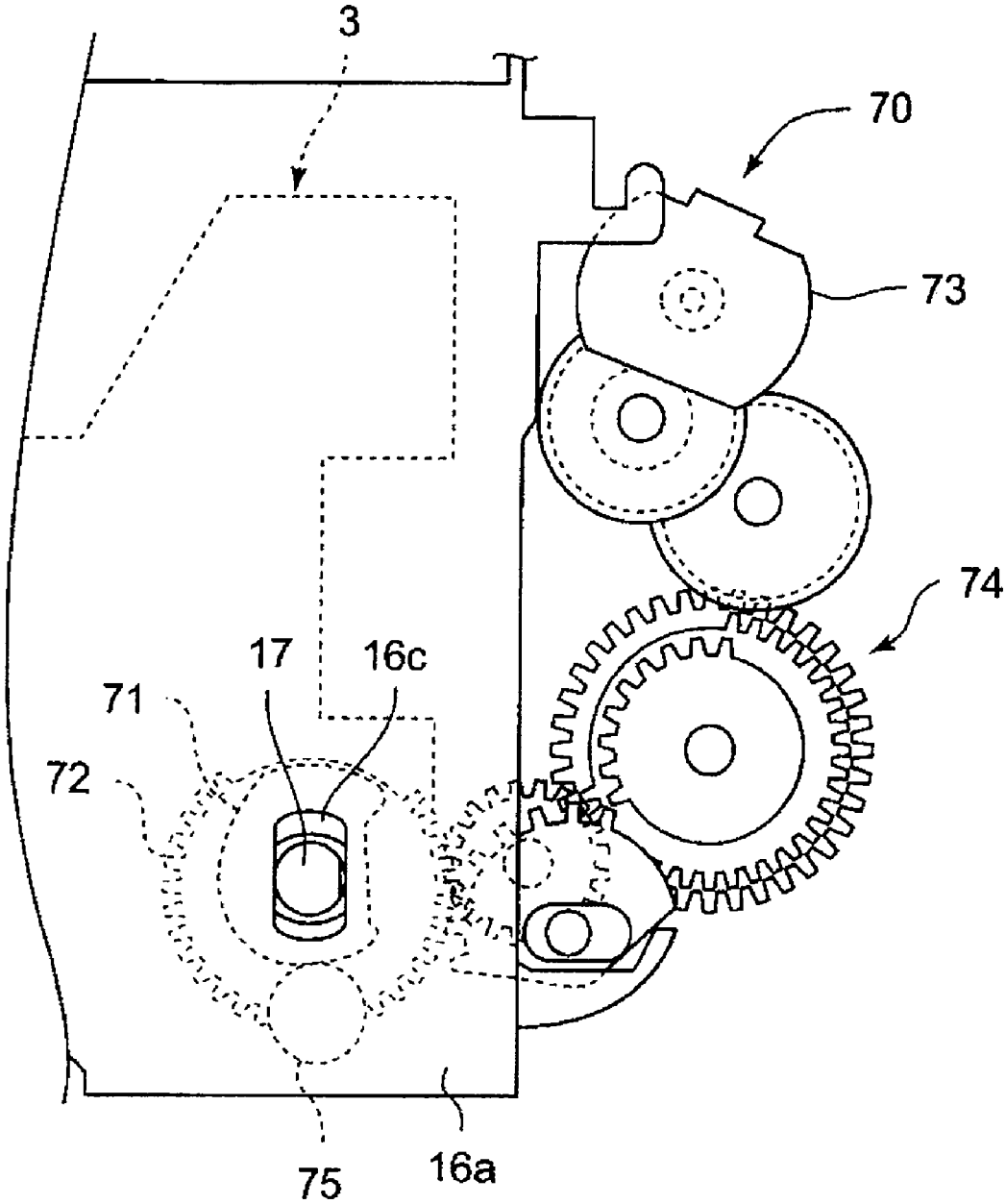
FIG. 30 is a side elevational view showing a part of the gap adjusting mechanism of FIG. 29.
Figure 31:
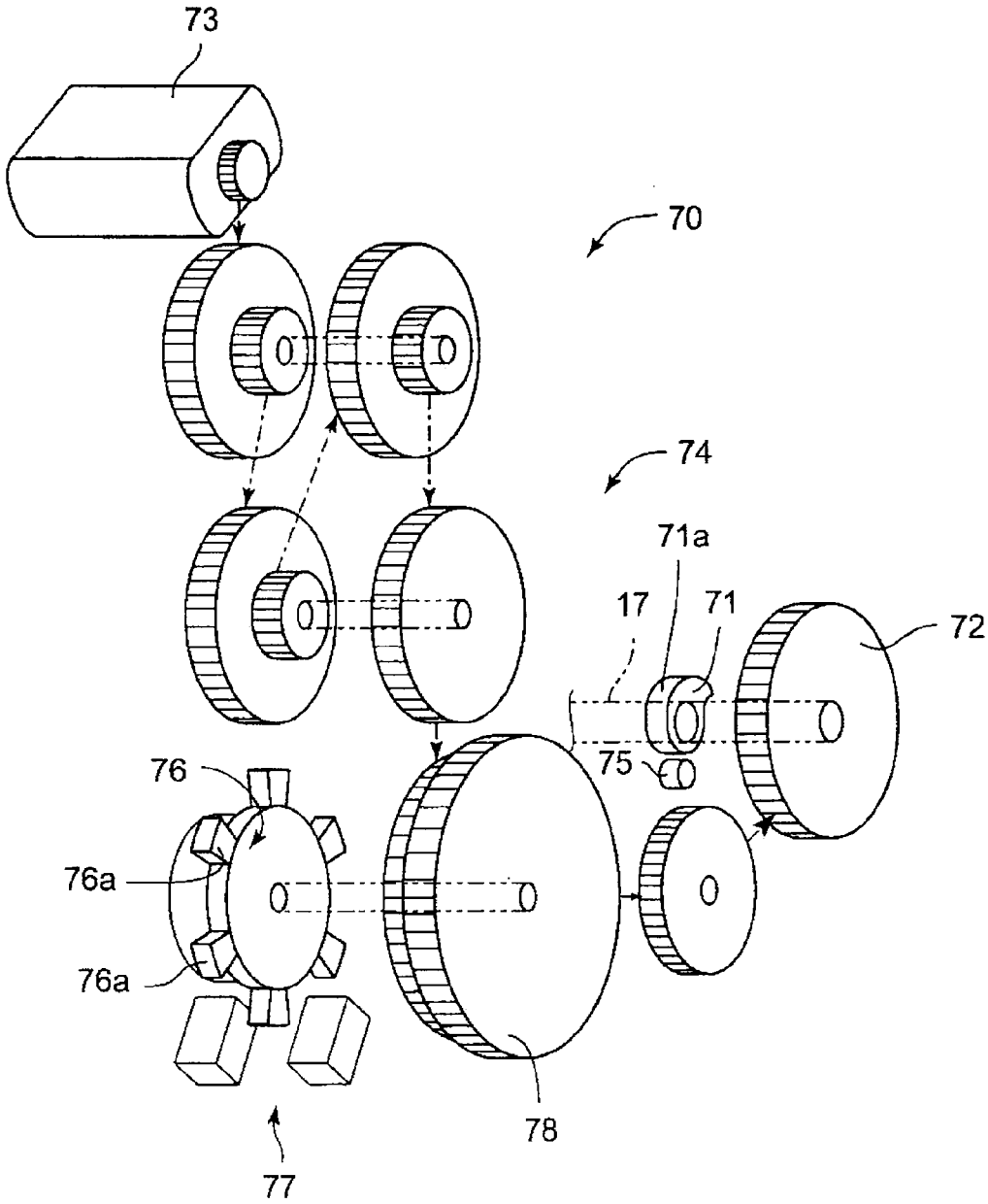
FIG. 31 is a exploded perspective view showing a part of the gap adjusting mechanism of FIG. 29.

The gap adjusting mechanism 70 is constructed by a constitution of moving up and down the guide shaft 17 relative to the support frame 17 by a cam mechanism. The gap adjusting mechanisms 70 are provided on both sides of a side of the one side face 16*a* and a side of the other side face 16*b* of the support frame 17. In the following, the constitution of the gap adjusting mechanism 70 will be explained by taking an example of the gap adjusting mechanism 70 provided on the side of the one side face 16*a* of the support frame 16. As shown by FIG. 29 through FIG. 31, the gap adjusting mechanism 70 includes an eccentric cam 71 fixed to an end portion side on 0 column side of the guide shaft 17, a first driven gear 72 fixed to an end portion on 0 column side of the guide shaft 17, a gear train 74 for transmitting power of a drive motor 73 to the first driven gear 72, a fixing pin 75 which is fixed to the one side face 16*a* and with which a cam face 71*a* of the eccentric cam 71 is brought into contact, a detecting plate 76 and a photosensor 77 for detecting a rotational position of the eccentric cam 71, and a second driven gear 78 connected to the gear train 74 for rotating the detecting plate 76.

As shown by FIG. 29, the one side face 16*a* of the support frame 16 is formed with a through hole 16*c* in a shape of a long hole prolonged in an up and down direction. The guide shaft 17 is inserted into the through hole 16*c*. Further, the end portion of the guide shaft 17 projected from the one side face 16*a* is fixed with the eccentric cam 71 and the first driven gear 72 from an inner side in this order. The fixing pin 75 is fixed to a lower side of the through hole 16*c* and the cam face 71*a* of the eccentric cam 71 is brought into contact therewith by a predetermined contact force by a weight of the carriage 3 and the like. Further, the cam face 71*a* of the eccentric cam 71 is formed such that a radius relative to a center of rotation is changed in steps. For example, the radius of the cam face 71*a* relative to the center of rotation of the eccentric cam 71 is changed in 5 stages in a circumferential direction such that the gap between the nozzle face of the printing head 2 and the platen 7 can be adjusted by 5 stages.

As shown by FIG. 31, the detecting plate 76 is formed in a shape of a circular disk and is provided with a plurality of detecting portion 76*a* extended to the outer side in the circumferential direction. Further, there is constructed a constitution in which the photosensor 77 detects the detecting portion 76*a*. Further, the detecting plate 76 is fixed to the second driven gear 78 by way of a predetermined shaft or the like and is rotated integrally with the second driven gear.

According to the gap adjusting mechanism 70 constituted as described above, when the drive motor 73 is rotated, a drive force of the drive motor 73 is transmitted to the first driven gear 72, and the guide shaft 17 and the eccentric cam 71 are rotated along with the first driven gear 72. When the eccentric cam 71 is rotated, a distance between the guide shaft 17 constituting the center of rotation of the eccentric cam 71 and the fixing pin 75 with which the cam face 71*a* of the eccentric cam 71 is brought into contact is varied, and the guide shaft 17 is moved up and down relative to the support frame 16. That is, the carriage 3 is moved up and down. Further, also the second driven gear 78 is transmitted with the drive force of the drive motor 73 by way of the gear train 74 and the detecting plate 76 is rotated integrally with the driven gear 78. Further, the rotational position of the eccentric cam 71 is detected.

Further, as a preprocessing at step S3 in detecting smear of the linear scale 31 according to the above-described mode, the linear scale 31 may be moved in parallel to the side of the light emitting portion 41 or the side of the light receiving portion 42 in the sub scanning direction SS. As described above, the light receiving portion 41 includes the collimator lens 51. However, light emitted from the light emitting portion 41 does not become complete parallel light. Therefore, in a case in which the linear scale 31 is proximate to the light receiving portion 42, pertinent detection by the light receiving portion 42 is made to be easy to be carried out. Therefore, in a case in which the linear scale 31 is moved to the side of the light emitting portion 41, even when the degree of smear of the second light transmitting portion 31*h* is small, a variation is easy to be brought about in the period of the A phase signal SG1 or the B phase signal SG2 outputted from the linear encoder 33. That is, smear of the linear scale 31 is made to be easy to be detected. Further, when the linear scale 31 is moved to the side of the light receiving portion 42, the variation is difficult to be brought about in the period of the A phase signal SG1 or the B phase SG2 outputted from the linear encoder 33 when the degree of smear of the second light transmitting portion 31*h* is not large. That is, smear of the linear scale 31 is difficult to be detected. In this way, by moving the linear encoder 31 to the side of the light emitting portion 41 or the side of the light receiving portion 42 at step S3, the degree of smear of the linear scale 31 can be detected.

Furthermore, according to the above-described embodiment, the A phase signal SG1 constituting the digital signal is generated from the difference between the output signal from the first amplifier 58 and the output signal from the third amplifier 60, and the B phase signal SG2 constituting the digital signal is generated from the difference between the output signal from the second amplifier and the output signal from the fourth amplifier 61. Otherwise, for example, as shown by FIG. 32(A), the A phase signal or the like constituting the digital signal may be generated by setting the predetermined threshold C to the output signal of the amplifier of the first amplifier 58 or the like. That is, the digital signal may be generated by outputting the high level signal when a value of the output signal is larger than the threshold C and outputting a low level signal when the value of the output signal is smaller than the threshold C. In this case, smear of the linear scale 31 may be detected as follows.

An amount of light emitted from the light emitting portion 41 and transmitted through the first light transmitting portion 31*f* is larger than an amount of light transmitted through the second light transmitting portion 31*h*. Therefore, when the ink mist is not adhered to the linear scale 31, for example, as shown by FIG. 32(A), when the photosensor 32 passes the portion formed with the position detecting pattern 31*b*, the signal SG11 is outputted from the amplifier, when the photosensor 32 passes the portion formed with the smear detecting pattern 31*c*, the signal SG12 at a level lower than that of the signal SG11 is outputted from the amplifier. Further, the digital signal SG13 shown in FIG. 32(B) is generated from the signal SG11 and the threshold C, and the digital signal SG14 shown in FIG. 32(C) is generated from the signal SG12 and the threshold C. Here, the larger the amount of transmitting light emitted from the light emitting portion 41 through the linear scale 31, the longer the period of the high level of the digital signal and therefore, the period T11 of the high level of the digital signal SG13 becomes longer than the period T12 of the high level of the digital signal SG14. Further, when smear is brought about at the linear scale 31, a rate of the period T12 to the period T11 becomes, for example, 80%.

Here, when the ink mist is uniformly attached to the linear scale 31, the levels of the signals SG11, SG12 outputted from the amplifier become low by the same degree. For example, as shown by FIG. 32(D), the level becomes low from the signal SG11 to the signal SG21, and the level becomes low from the signal SG12 to the signal SG22. Further, as shown by FIG. 32(E), the period T11 of the high level of the digital signal SG23 generated from the signal SG11 and the threshold C becomes shorter than the period T11. Further, as shown by FIG. 32(F), the period T22 of the high level of the digital signal SG24 becomes shorter than the period T12.

Figure 32:
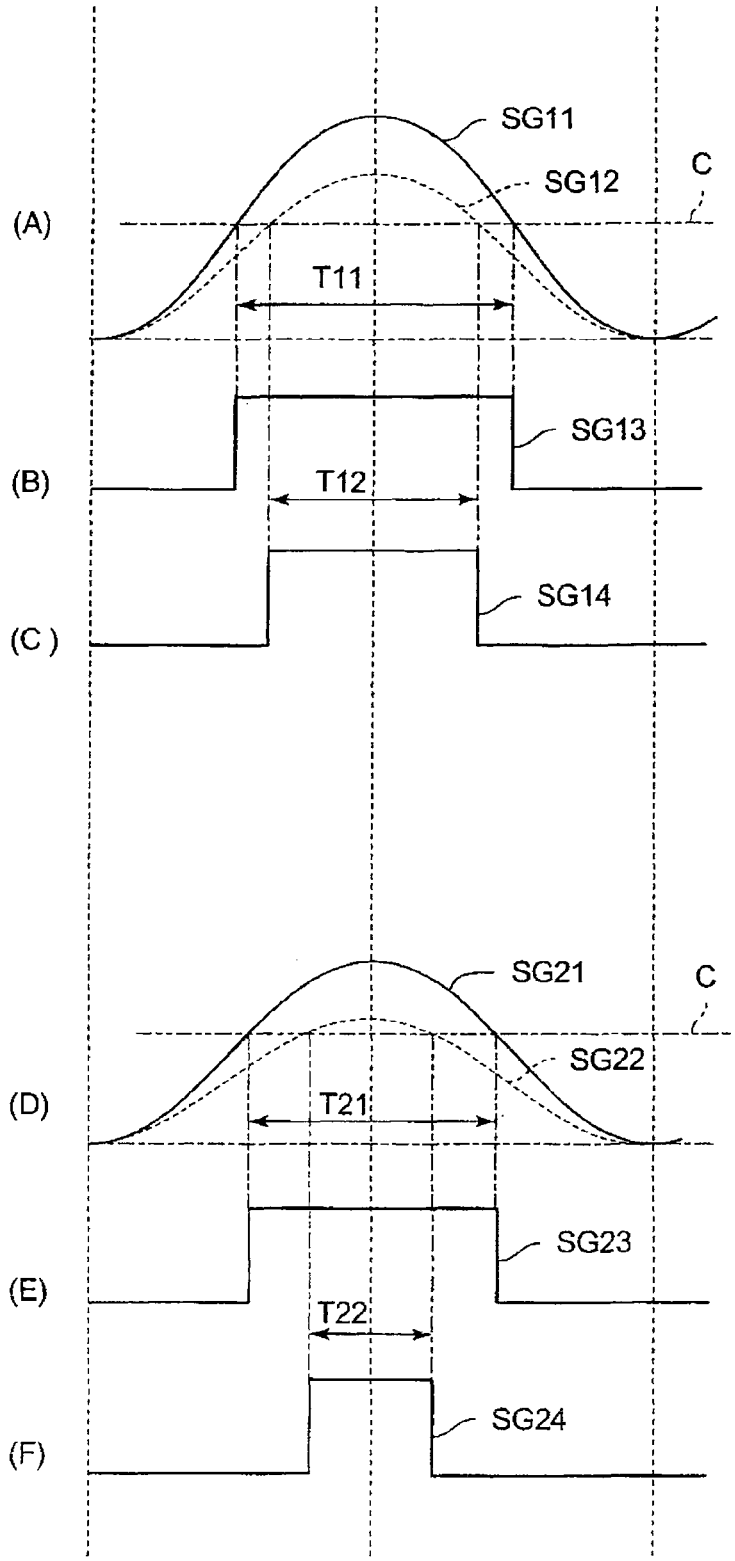
FIG. 32 illustrates diagrams for explaining a method of detecting smear of a linear scale according to other embodiment.

In this case, as shown by FIG. 32, the rate of the period T22 to the period T21 becomes lower than the rate of the period T12 to the period T11. For example, whereas the light of the period T12 to the period T11 is 80%, the rate of the period T22 to the period T21 becomes 50%. Therefore, it can be determined that smear is brought about at the linear scale 31 when the rate of the period (for example, period T22) of the high level of the digital signal based on the smear detecting pattern 31*c* to the period (for example, period T21) of the high level of the digital signal based on the position detecting pattern 31*b* becomes equal to or smaller than a predetermined value. When the digital is generated by setting the predetermined threshold C to the output signal of the amplifier as described above, smear of the linear scale 31 can be detected by the above-described method. Further, smear of the linear scale 31 can also be detected from a rate of reducing the period of the high level of the digital signal based on the smear detecting pattern 31*c* to that of the initial state.

(Rotary Encoder)

An explanation will be given of a position detecting device provided with a rotary encoder, and a printer 110 as a liquid ejecting apparatus using the position detecting device according to the other embodiment of the invention in reference to FIG. 33 through FIG. 47 as follows. Further, although the printer 110 of the embodiment is a printer of an ink jet type, such an ink jet type printer may be an apparatus adopting any ejecting method so far as the apparatus is an apparatus capable of printing by ejecting ink.

Further, in the following explanation, a lower side indicates a side of installing the printer 110, an upper side indicates a side of being remote from the installed side. Further, a direction of moving a carriage 131 mentioned later is designated as a main scanning direction, and a direction orthogonal to the main scanning direction and a direction of carrying a printing object P is designated as a sub scanning direction. Further, an explanation will be given by constituting a side of supplying the printing object P as a sheet feeding side (rear end side), and constituting a side of discharging the printing object P as a sheet discharging side (this side).

Figure 33:
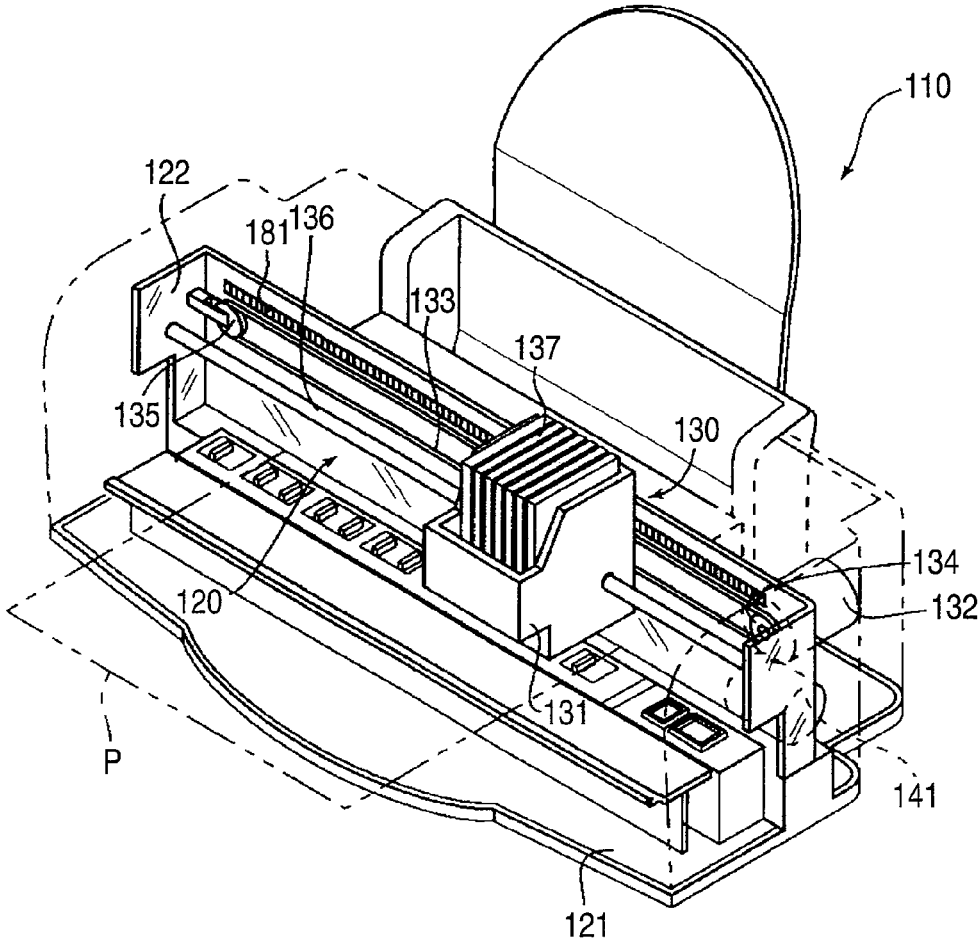
FIG. 33 is a perspective view showing a constitution of a printer according to an embodiment of the invention.

As shown by FIG. 33, the printer 110 constitutes essential constituent elements by a cabinet portion 120, a carriage driving mechanism 130, a sheet carrying mechanism 140, a rotary encoder 150 constituting a position detecting device, a sensor position switching mechanism 170 constituting the position detecting device, a linear encoder 180 capable of constituting the position detecting device, and a control portion 190.

Figure 34:
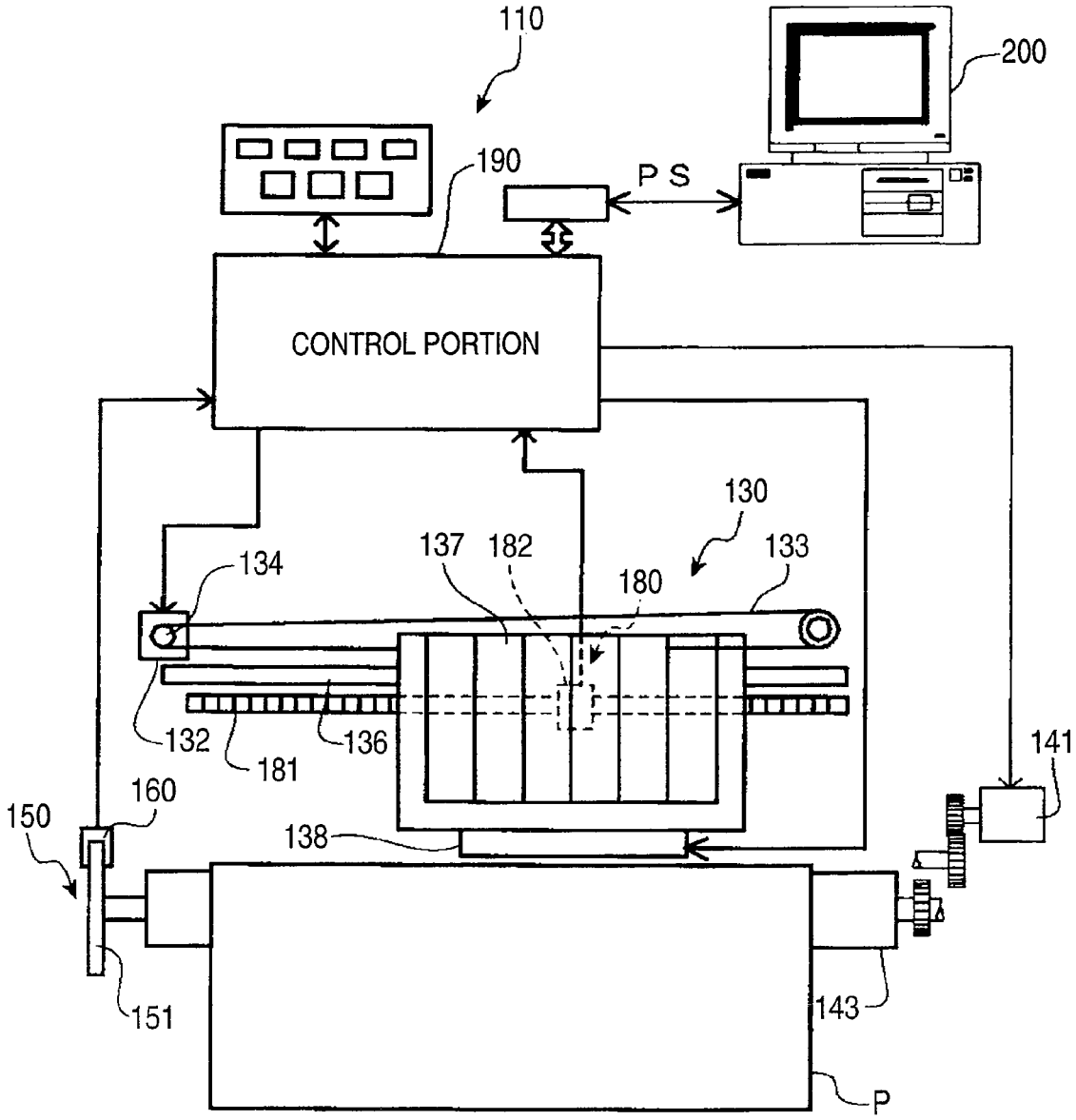
FIG. 34 is an outline view showing a constitution of the printer.

Among these, the cabinet portion 120 includes a chassis 121 installed at an installing face, and a support frame 122 erected from the chassis 121 in an upper direction. Further, the carriage driving mechanism 130 includes the carriage 131, a carriage motor (CR motor 132), a belt 133, a gear pulley 134, a driven pulley 135 and a carriage shaft 136. Among these, the carriage 131 is made to be mountable with respective colors of ink cartridges 37. Further, as shown by FIG. 34, a lower face of the carriage 131 is provided with a printing head 138 as a liquid delivery portion capable of delivering an ink drop. Further, the belt 133 is an endless belt, and a portion thereof is fixed to a back face of the carriage 131. The belt 133 is expanded by the gear pulley 134 and the driven pulley 135. Further, the carriage 131 and the printing head 138 correspond to a detected object.

The printing head 138 is provided with nozzle rows, not illustrated, in correspondence with respective inks, and a nozzle constituting the nozzle row is arranged with a piezoelectric element, not illustrated. By operating the piezoelectric element, an ink drop can be delivered from a nozzle disposed at an end portion of an ink path. Further, the printing head 138 is not limited to a piezoelectric drive type using a piezoelectric element but there may be adopted, for example, a heater type of heating ink by a heater and utilizing a force of a produced bubble, a magnetorestrictive type using a magnetorestrictive element, a mist type controlling mist by an electric field or the like. Further, as ink charged to the cartridge 137, any kind of ink of dye species ink/pigment species ink or the like may be mounted.

Figure 35:
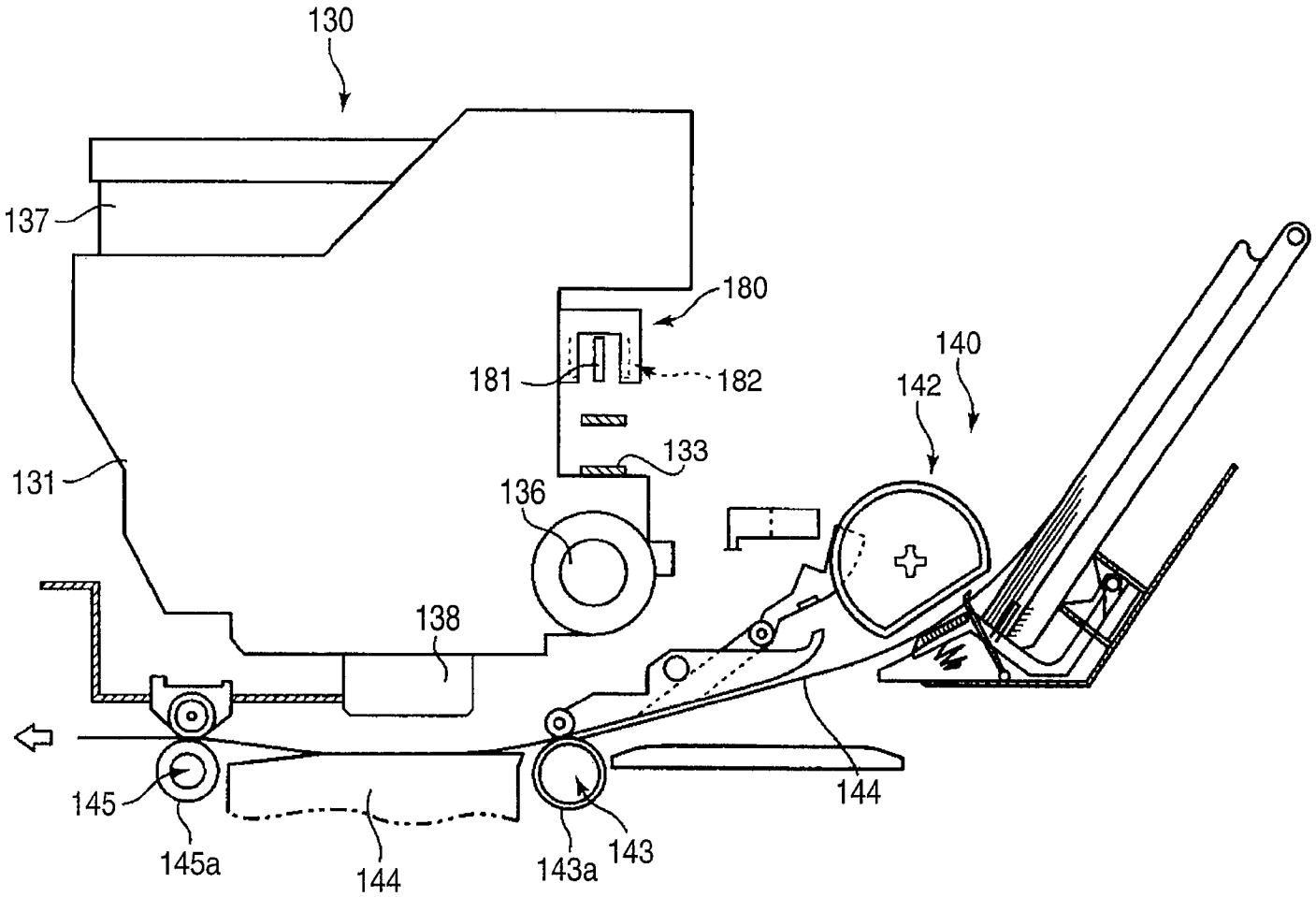
FIG. 35 is a sectional view of one side of a portion with regard to sheet feeding of the printer.

As shown by FIG. 35, the sheet carrying mechanism 140 includes a PF motor 141 (refer to FIG. 34 and the like) for carrying the printing object P or the like, and a sheet feeding roller 142 in correspondence with feeding ordinary sheet or the like. Further, a sheet discharge side of the sheet feeding roller 142 is provided with a pair of PF rollers 143 for carrying/pinching the printing object P. Further, a sheet discharge side of the pair of PF rollers 143 is arranged with a platen 144 and the printing head 138 to be opposed to each other in an up and down direction. The platen 144 supports the printing object P carried to a lower side of the printing head 138 by the pair of PF rollers 143 from the lower side. Further, a sheet discharge side of the platen 144 is provided with a pair of sheet discharge rollers 145 similar to the pair of PF rollers 143. A sheet discharge driving roller 145*a* of the pair of sheet discharge rollers 145 is transmitted with a drive force from the PF motor 141 along with a PF driving roller 143*a*.

Further, as shown by FIG. 34, the rotary encoder 150 can be made to function as position detecting device, and includes a rotary scale 151, the sensor position switching mechanism 170, and a photosensor 160.

Among these, the rotary scale 151 is provided in a shape of a circular disk, and is attached to an end portion side of the shaft by way of an attaching hole 151*a* provided at a center portion thereof. The shaft constitutes the PF drive roller 143*a*. Therefore, when the PF motor 141 is driven, the rotary scale 151 is rotated in synchronism with the shaft. The rotary scale 151 is constituted by a transparent member 152 in a shape of, for example, a circular disk. Although as a material of the transparent member 152, there is PET (polyethylene terephthalate), other transparent materials can variously be applied.

Figure 36:
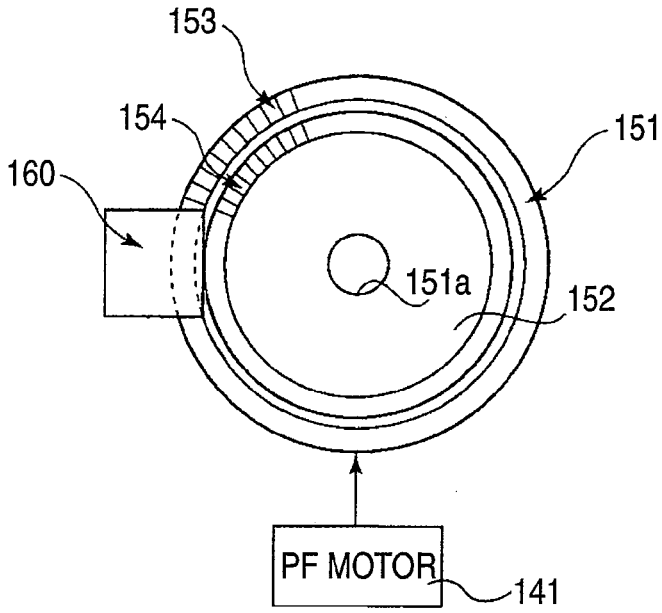
FIG. 36 is a side view showing a shape of a rotary encoder.

Further, as shown by FIG. 36, the rotary scale 151 is provided with a position detecting pattern 153 in a ring-like shape and a smear detecting pattern 154 in a ring-like shape. Among these, the position detecting pattern 153 includes a first light transmitting portion 153*a* for transmitting light and a first light interception portion 153*b* for intercepting transmittance of light. Among these, the first light interception portion 153*b* is a portion formed by subjecting printing of black color having a black color and a thickness to a degree of not transmitting light to a surface of the transparent member 152. Further, the first light transmitting portion 153*a* is a portion which is not subjected to printing of black color and is made to be able to transmit light emitted by a light emitting portion 162 mentioned later.

Here, according to the embodiment, the first light transmitting portion 153*a* and the first light interception portion 153*b* are formed by the same width dimension, that is, the same pitch. Further, although the width dimensions of the first light transmitting portion 153*a* and the first light interception portion 153*b* may not necessarily be the same, it is necessary that a pitch of alternately repeating the first light transmitting portion 153*a* and the first light interception portion 153*b* (hereinafter, referred to as mask pitch M) stay the same in all of the position detecting pattern 153 in a peripheral direction.

Further, the smear detecting pattern 154 is provided on an inner diameter side of the position detecting pattern 153. Also the smear detecting pattern 154 includes a second light transmitting portion 154*a* for transmitting light and a second light interception portion 154*b* for intercepting transmittance of light similar to the position detecting pattern 153. Further, the smear detecting pattern 154 is provided on further inner diameter side by being remote from the position detecting pattern 153 by a constant distance.

Figure 37:
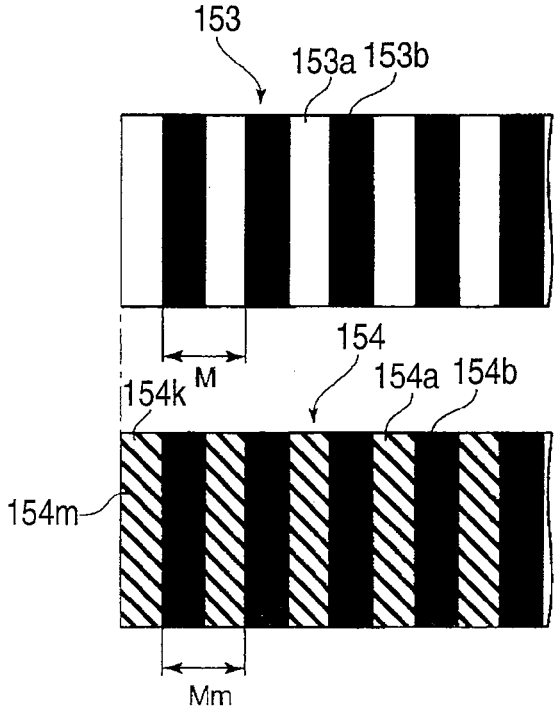
FIG. 37 is a view showing a state of enlarging a rotary scale in a plane view thereof.

Here, the second light transmitting portion 154*a* of the smear detecting pattern 154 is provided such that a transmitting area and a transmittance of light are smaller than those of the first light transmitting portion 153*a* of the position detecting pattern 153. As a constitution of reducing the transmittance of light of the light transmitting portion 153*a*, as shown by FIG. 37, there is a case of providing a light interception pattern 154*k* to the second light transmitting portion 154*a*. Here, in a state shown in FIG. 37, the light interception pattern 154*k* is constituted by a number of light interception portions 154*m* in a shape of a skewed line inclined relative to a tangential line direction of the rotary scale 151. By presence of the light interception portion 154*m*, the transmitting area of light and the transmittance of light of the second light transmitting portion 154*a* become smaller than the transmitting area of light and the transmittivity of light of the first light transmitting portion 153*a*. Further, a light amount of light transmitting through the second light transmitting portion 154*k* becomes smaller than a light amount of light transmitting through the first light transmitting portion 153*a*.

Further, a mask pitch Mm constituted by the second light transmitting portion 154*a* and the second light interception portion 154*b* is made to be equal to the mask pitch M constituted by the first light transmitting portion 153*a* and the first light interception portion 153*b* (refer to FIG. 37). However, the mask Mm may be constituted to differ from the mask pitch M.

Figure 39:
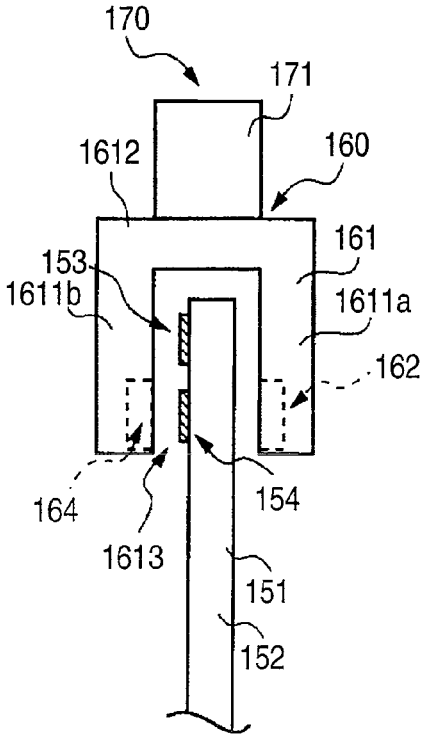
FIG. 39 is a front view showing constitutions of the rotary scale and a photosensor.

Further, the photosensor 160 is a sensor of a light projecting and receiving type and includes a housing 161 as shown by FIG. 39. The housing 161 includes two attaching portions 1611*a*, 1611*b* opposed to each other and includes a connecting portion 1612 for connecting the two attaching portions 1611*a*, 1611*b* on a side of end portions of the attaching portions 1611*a*, 1611*b*. Thereby, the housing 161 is provided with a space portion 1613 surrounded by the two attaching portions 1611*a*, 1612*b* and the connecting portion 1612 to construct a constitution capable of disposing the rotary scale 151 at the space portion 1613. Further, the space portion 1613 is provided with a length dimension (recess depth) capable of dealing with also switching between the position detecting pattern 153 on an outer diameter side and the smear detecting pattern 154 on an inner diameter side.

Figure 40:
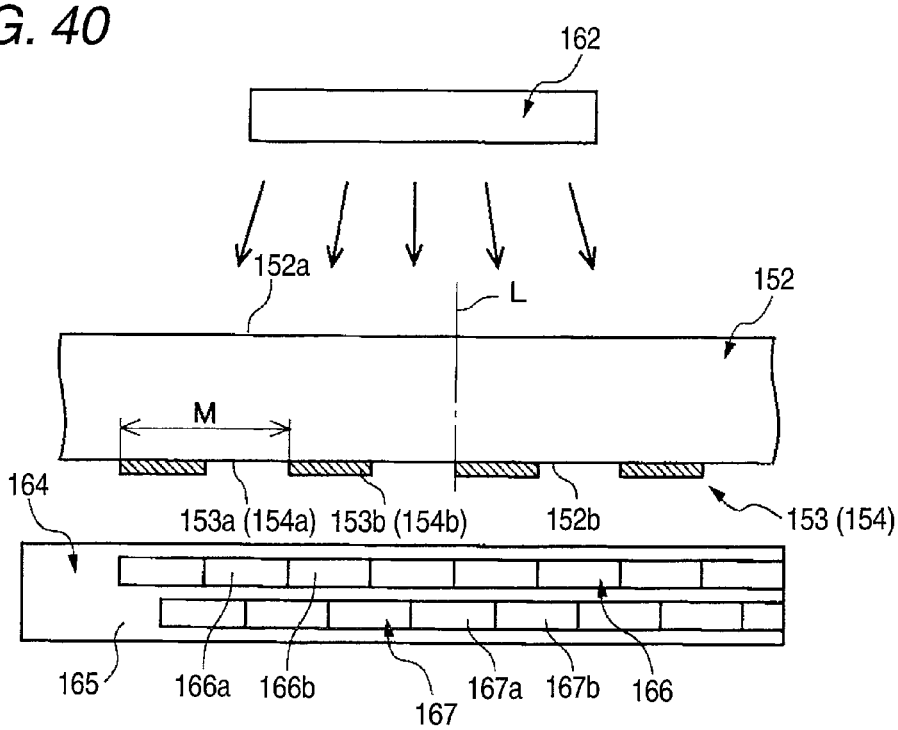
FIG. 40 is a schematic view showing a relationship between a transparent member of the rotary scale and the photosensor.

Further, the light emitting portion 162 is attached to the attaching portion 611*a* on one side and a light receiving portion 164 is attached to the attaching portion 611*b* on other side. As shown by FIG. 39 and FIG. 40, the light emitting portion 162 and the light receiving portion 164 are arranged in a state of being opposed to each other by interposing the rotary scale 151. Further, the rotary scale 151 is arranged between a collimator lens 163 and the light receiving portion 164 in a state of being noncontact therewith. Here, the light emitting portion 162 includes a light emitting element 1620 of, for example, a light emitting diode and light produced by the light emitting element 1620 is emitted to the rotary scale 151.

The light emitting element 1620 is supplied with a current by way of a variable resistor 1621 constituting light amount controlling means. Therefore, a light emitting amount from the light emitting element 1620 can be increased and reduced by the variable resistor 1621. According to the embodiment, the variable resistor 1621 constitutes the light amount controlling means for controlling the light emitting amount from the light emitting portion 162. Further, in an initial state, it is preferable to make the light emitting amount from the light emitting element 1620 as low as possible in a pertinent range of capable of detecting a position by the rotary encoder 150. Thereby, power consumption at the light emitting portion 162 can be reduced.

Figure 41:
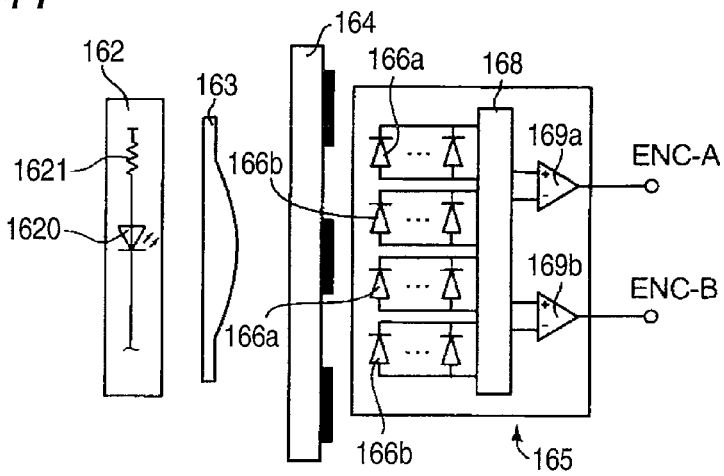
FIG. 41 is a view showing a circuit constitution of the rotary encoder.

Further, as shown by FIG. 40 and FIG. 41, the light receiving portion 164 includes a board 165, a first light receiving element row 166 and a second light receiving element row 167 provided on the board 165, in the first light receiving element row 166, pluralities of light receiving elements 166*a*, 166*b* are aligned in one row, and also in the second light receiving element row 167, pluralities of light receiving elements 166*a*, 166*b* are aligned similarly. The light receiving elements 167*a* through 167*b* include light receiving elements capable of converting received light into an electric signal in accordance with a light amount thereof such as, for example, a phototransistor, a photodiode, a photo IC or the like. The light receiving elements 166*a* through 167*b* are provided by two per one pitch of the position detecting/smear detecting patterns 154, 155 constituted by the light transmitting portions 153*a*, 154*a* and the light interception portions 153*b*, 154*b*. Further, according to the embodiment, the first light receiving element row 166 and the second light receiving element row 167 are arranged to be shifted from each other by ¼ pitch. That is, a phase difference between the first light receiving element row 166 and the second light receiving element row 167 becomes 90 degrees.

Further, when width dimensions of the light transmitting portions 153*a*, 154*a* and the light interception portions 153*b*, 154*b* are equal to each other as in the embodiment, there is established an arrangement relationship in which one of the light receiving elements 166*a* through 167*b* corresponds to each of the light transmitting portions 153*a*, 154*a*/light interception portions 153*b*, 154*b*.

Further, as shown by FIG. 41, the pluralities of light receiving elements 166*a* through 167*b* are connected to a signal amplifying circuit 168, by the signal amplifying circuit 168, signals of analog waveforms in accordance with light amounts outputted from the light receiving elements 166*a* through 167*b* are amplified and thereafter outputted to a first comparator 169*a* and a second comparator 169*b*. Further, the first comparator 169*a* and the second comparator 169*b* output digital signals in a pulse waveform based on the analog signals outputted from the respective light receiving element rows 166, 167 by way of the signal amplifying circuit 168.

Figure 42:
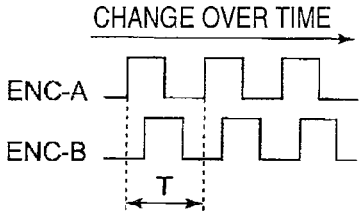
FIG. 42 is a diagram showing an output pulse of the encoder.

Here, a + side of terminal of the first comparator 169*a* is connected with the light receiving element 66*a* of the first light receiving element row 166 and a − side terminal is connected with the light receiving element 166*b* of the same first light receiving element row 166. Further, also the second comparator 169*b* is similarly connected with the light receiving elements 167*a*, 167*b* of the second light receiving element row 167. Further, for example, when a level of the analog signal inputted to the + side terminal is higher than a level of the analog signal inputted to the − side terminal, a high level signal is outputted, and in an inverse case, a low level signal is outputted. Thereby, it is possible to output pulse signals (ENC-A, ENC-B) as shown by FIG. 42 in correspondence with detecting the light transmitting portions 153*a*, 154*a*/the light interception portions 153*b*, 154*b*.

Further, the pulse ENC-A is outputted from the first comparator 169*a* in correspondence with the first light receiving element row 166, and the pulse ENC-B the phase of which is shifted by 90 degrees is outputted from the second comparator 169*b* in correspondence with the second light receiving element row 167 arranged to be shifted by ¼ pitch.

Figure 43:
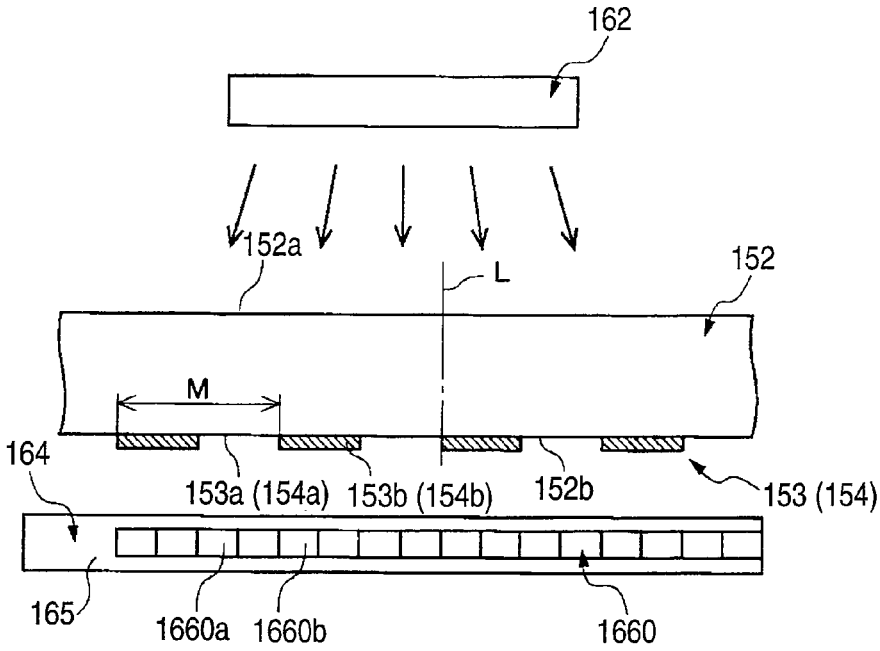
FIG. 43 is a schematic view showing a modified example of a relationship between the rotary scale and the photosensor.

Further, there may be adopted a constitution shown in FIG. 43 in which a single light receiving element row 1660 is present without adopting the above-described constitution. In this case, a light receiving element 660*a* is connected to a terminal of either of + side or − side of the first comparator 169*a*, and a light receiving element 660*b* is connected to a terminal of either of + side or − side of the second comparator 169*b*.

Figure 38:
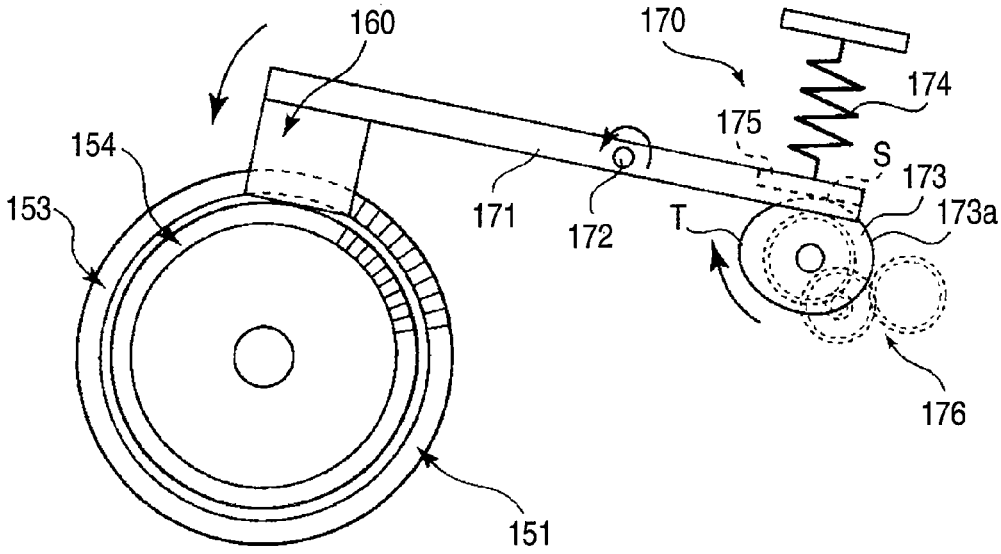
FIG. 38 is a side view showing a constitution of a sensor position switching mechanism.

Next, the sensor switching mechanism 170 will be explained. As shown by FIG. 38, the sensor position switching mechanism 170 is means for switching a position of the photosensor 160 opposed to the rotary scale 151. The sensor position switching mechanism 170 includes an arm 171, a pivoting shaft 172, an eccentric cam 173, and a pressing spring 174.

Among these, the arm 171 is attached with the photosensor 160 on one end side thereof. Further, the arm 171 is axially supported by the pivoting shaft 172 at a middle portion thereof. That is, the arm 171 is pivotably provided centering on the pivoting shaft 172. The pivoting shaft 172 is attached to a fixed portion of the printer 110 such as the chassis 121 or the support frame 122. Further, the pivoting shaft 172 is present at a portion proximate to other end side of the center of the arm 171.

Further, the other end side of the arm 171 is provided with a projected piece 175. The projected piece 175 is a portion projected in a direction orthogonal to a longitudinal direction of the arm 171 and a portion pressed with the eccentric cam 173 and the pressing spring 174. Either face of the projected piece 175 is pressed with the eccentric cam 173. The eccentric cam 173 is a member in which a distance from a center of rotation thereof to a cam face 173*a* is changed in accordance with a rotational angle. Further, according to the embodiment, the cam face 173*a* of the eccentric cam 173 is provided with a first region S in correspondence with the position detecting pattern 153 on the outer diameter side of the rotary scale 151 and a second region T in correspondence with the smear detecting pattern 154 on the inner diameter side. That is, when the first region S is brought into contact with the projected piece 175, the photosensor 160 is brought into a state of detecting the position detecting pattern 153. Further, when the second region T is brought into contact with the projected piece 175, the photosensor 160 is brought into a state of detecting the smear detecting pattern 154.

Further, a face of the projected piece 175 on a side opposed to the face pressed by the eccentric cam 173 is pressed with the pressing spring 174. The pressing spring 174 is a member for firmly pressing the projected piece 175 to the cam face 173*a* when the projected piece 175 is brought into contact with either region of the first region S or the second region T.

The pressing spring 174 is attached to a fixed portion of the printer 110 such as the chassis 121 or the support frame 122 similar to the pivoting shaft 172.

Further, the eccentric cam 173 is transmitted with a drive force from a motor by way of a gear train 176 for transmitting the drive force. Further, as the motor, a motor separately independent from the above-described respective motors may be used, or a constitution of distributing the drive force of the PF motor 141 may be adopted. Further, when the constitution of distributing the drive force of the PF motor 141 is adopted, for example, it is necessary to adopt a mechanism of capable of switching mesh/nonmesh of portions of gears of the gear train 176 and it is necessary to adopt a constitution by which the eccentric cam 173 is not rotated in carrying the printing object P.

Figure 44:
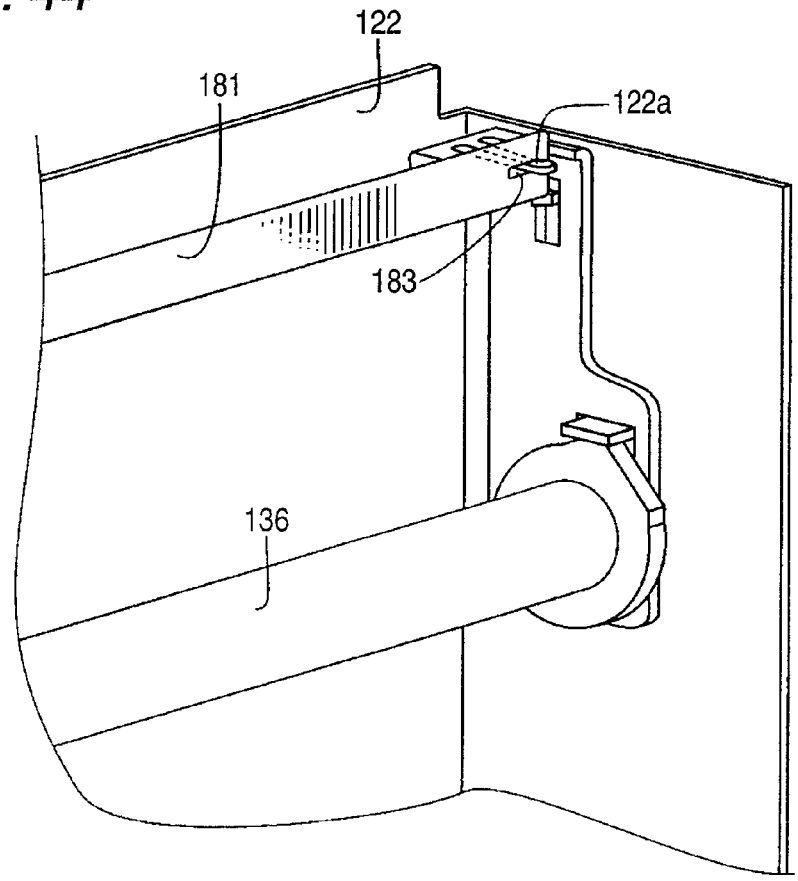
FIG. 44 is an outline view showing a constitution of a linear encoder.

Further, as shown by FIG. 44, the linear encoder 180 includes a linear scale 81 in an elongated state and includes a photosensor 182 similar to the rotary encoder 150 (refer to FIG. 35). The linear scale 181 is provided in a linear shape and is provided with slender locking holes 183 as shown by FIG. 44 at both end portions thereof. The locking hole 183 is inserted with a locking claw 122*a* fixed to the support frame 122 and the linear scale 81 is supported in an expanded state by the locking claw 122*a*. Further, otherwise, the linear encoder 180 is constructed by a constitution similar to that of the rotary encoder 150 and therefore, a detailed explanation thereof will be omitted.

Further, as shown by FIG. 34, the control portion 190 is inputted with respective output signals of an encoder signal outputted from the rotary encoder 150 or the linear encoder 180, a printing signal from a computer 200 and the like. Further in details, the control portion 190 includes CPU, ROM, RAM, ASIC, a DC unit, a driver and the like. Further, the control portion 190 can govern to control to drive the CR motor 132, the printing head 138, the PF motor 141 and the like.

An explanation will be given as follows of operation carried out by the rotary encoder 150 when the printer 110 is operated by using the above-described constitution.

When the rotary encoder 150 is operated and light is emitted from the light emitting portion 162, the light emitting portion 162 emits light to the rotary scale 151. The emitted light is made to be incident on the collimator lens 163 and although light transmitting through the collimator lens 163 is processed to be constant parallel light, the light is not complete parallel light. Further, at the light receiving element 167 disposed on an end portion side of the light receiving element row 166, after passing through the collimator lens 163, light reaches a surface 152*a* of the transparent member 152 and a predetermined rate of light is not reflected by the surface 152*a* but travels through inside of the transparent member 152 as it is. Further, at a back face 52*b* of the transparent member 152, light reaches the second light transmitting portion 154*a* or the second light interception portion 154*b*.

Here, when an ink drop is delivered from the printing head 138 to the printing object P, a small ink drop is delivered from the printing head 138, at this occasion, there is brought about ink mist in which a portion of the small ink drop is floated. The ink mist floats at inside of the printer 110 and is gradually adhered to the rotary scale 151 or the like as smear. In this case, at the printer 110, smear of the rotary scale 151 is detected at predetermined timings. An explanation will be given as follows of a series of operation of the printer 110 in detecting smear of the rotary scale 151.

Figure 45:
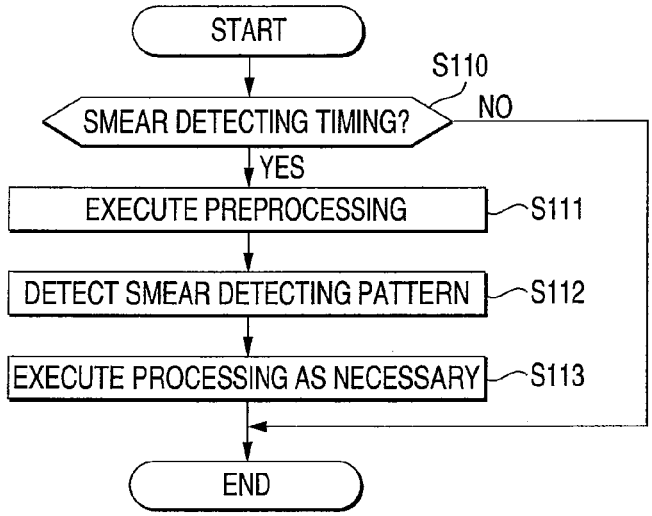
FIG. 45 is a diagram showing a flow of an operation of the printer including smear detection.

As shown by FIG. 45, first, the control portion 190 determines whether a timing of detected smear of the rotary scale 151 is constituted (step S10). The timing of detecting smear of the rotary scale 151 is constituted after finishing to print one sheet or a predetermined number of sheets of the printing sheets P, or when a power source of the printer 110 is inputted. Further, the timing of detecting smear of the rotary scale 151 may be constituted after an elapse of a constant time period t1 after inputting the power source of the printer 110, further, thereafter, may be constituted after an elapse of a constant time period t2. Further, the timing of detecting smear of the rotary scale 151 may be constituted after finishing to print a constant number of sheets of n1 of the printing objects P after inputting the power source, further, thereafter, may be constituted after finishing to print a constant number of sheets of n2 of the printing objects P.

When it is determined at step S10 that the detecting timing is not constituted (case of No), smear of the rotary scale 151 is not detected, the printer 110 is brought into, for example, a standby state, or prints the successive printer object P. On the other hand, when it is determined that the detecting timing is constituted at step S110 (case of Yes), a predetermined preprocessing is carried out (S111). Here, the preprocessing refers to a processing of operating to switch a state of detecting the position detecting pattern 153 by the photosensor 160 to a state of detecting the smear detecting pattern 153 by operating the sensor position switching mechanism 170. At this occasion, by driving the motor, the eccentric cam 173 is driven to rotate, to switch a state in which the projected piece 175 is brought into contact with the first region S to a state in which the projected piece 175 is brought into contact with the second region T, thereby, the photosensor 160 is moved to the inner diameter side of the rotary scale 151.

Thereafter, the smear detecting pattern 154 is detected (S112). The detection is carried out based on a processing flow shown in FIG. 46 mentioned later.

When the detection at step S112 has been finished, a processing as necessary is carried out in accordance with an actual degree of smear of the rotary scale 151 (S113). At S13, various processings are conceivable and therefore, the processings are enumerated as follows.

As an example of the processing, a voltage of driving the PF motor 141 is set. Further specifically, the drive voltage is set such that a speed of moving the photosensor 160 is made to be slower than the moving speed when the ink mist is not adhered. Thereby, when there is a concern of erroneous detection at the rotary encoder 150 by adhering a constant or more of ink mist to the rotary scale 151, a concern after the detection can be reduced.

Further, as other processing, it is confirmed by printing what remaining number of sheets of the printing object P, a limit of reading the rotary scale 151 is reached. Further specifically, a number of sheets of printing or a time period of printing to reach the limit of reading the rotary scale 151 is calculated by the control portion 190. By confirmation/calculation, the number of sheets of printing or the time period of printing until bringing about smear at the rotary scale 151 can be grasped.

Further, as other processing, a predetermined message is displayed on a display apparatus (not illustrated) of a liquid crystal display or the like separately attached to the printer 110. As a predetermined message, there is displayed an attention sage stating that the rotary scale 151 is near to the reading limit, or has reached the reading limit, an error message owing to smear of the rotary scale 151, or a message stating that the rotary scale 151 needs to be cleaned. By displaying the messages, a user can be informed that smear is brought about at the rotary scale 151, and a failure in operating the printer 110 by erroneous detection by the rotary scale 151 can be prevented.

Further, as other processing, the printer 110 is made to be unable to be used by stop operating the printer 110. By making the printer 110 unable to be used, a failure of operating the printer 110 is prevented from being brought about by erroneous detection by the rotary scale 151, and the printer 110 can be prevented from being destructed or the like by an abnormality in feeding sheets. Further, as other processing, the control portion 190 controls such that the printer 110 stops operating after further executing printing of a predetermined time period, or further executing a predetermined number of sheets after detecting smear.

Further, as other processing, a control of restraining the speed of rotating the rotary scale 151 is carried out by setting an upper limit in the speed of rotating the PF motor 141. Thereby, the speed of rotating the rotary scale 151 is made to be slow and even when the rotary scale 151 is smeared to some degree, erroneous detection by the photosensor 160 can be prevented. Further, by preventing the erroneous detection, the printer 110 can print by a predetermined number of sheets or by a predetermined time period.

Further, as other processing, a control of increasing an amount of emitting light from the light emitting element 1620 is carried out by adjusting the variable resistor 1621. By increasing the amount of emitting light of the light emitting element 1620, even when the rotary scale 151 is more or less smeared, so far as the degree of smear is not so large, the printer 110 can print further by a predetermined number of sheets or by a predetermined time period. Further, the amount of emitting light of the light emitting element 1620 may be increased in steps by the variable resistor 1621 by a rate of increase to a degree of capable of further printing by a predetermined number of sheets or by a predetermined time period. In this case, power consumption by the light emitting portion 162 can be reduced.

Further, as other processing, a position of detecting the position detecting pattern 153 is shifted by operating the sensor position switching mechanism. For example, the sensor position switching mechanism 170 may be operated to detect the inner diameter side of the position detecting pattern 153. Further, as other processing, smear of the rotary scale 151 is removed by pressing a cleaning member of a sponge or the like.

Figure 46:
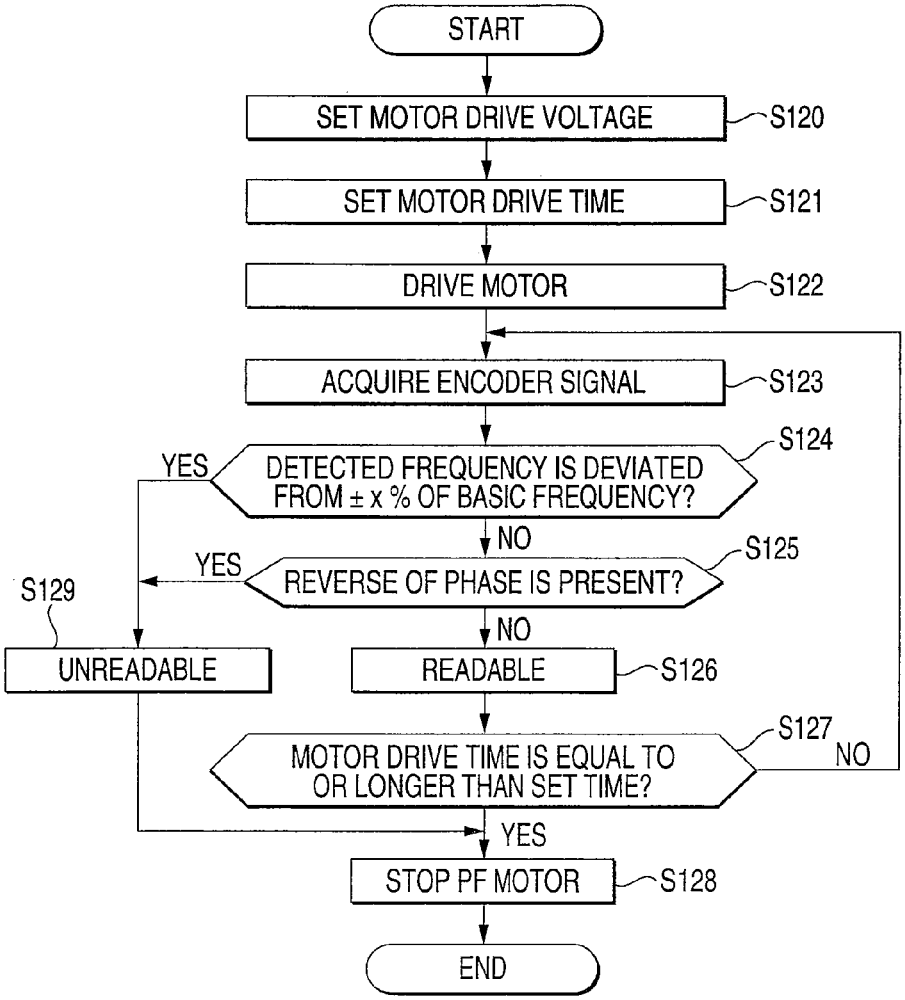
FIG. 46 is a diagram showing a flow of a processing when the smear detection is carried out.
Figure 47:
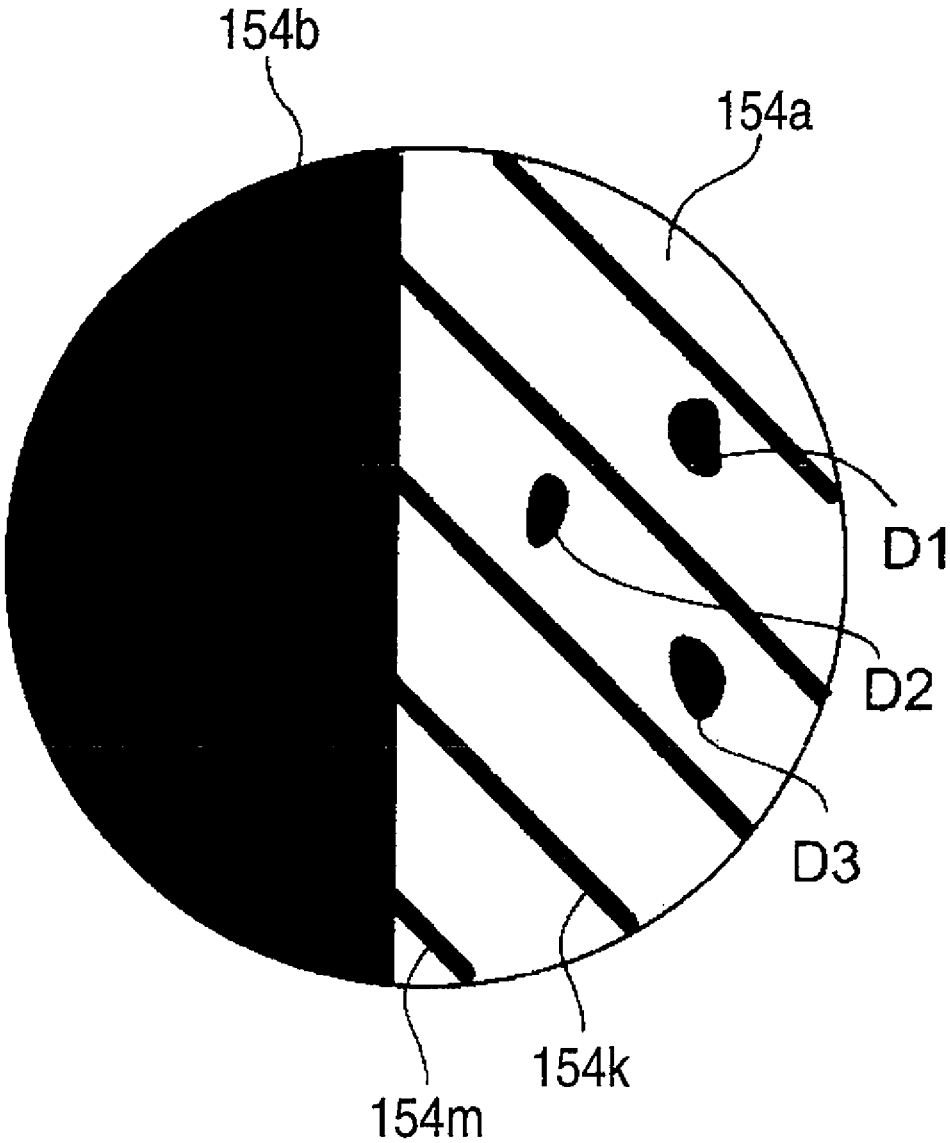
FIG. 47 is a view enlarging to show a portion adhered with mist in a smear detecting pattern.

Next, an explanation will be given of a processing flow for detecting smear in the smear detecting pattern 154 in reference to FIG. 46. As shown by FIG. 46, first, a voltage of driving the PF motor 141 is set (S120). Further specifically, a drive voltage in correspondence with a rotational speed for detection is applied to the PF motor by a control instruction from the control portion 190 in correspondence with the driving. Successively, a time period of driving the PF motor is set (S121). In this case, the PF motor 141 is driven for detecting smear.

Next, the PF motor 141 is driven by the set drive voltage and the set drive time period (S122). The rotary scale 151 is rotated by driving the PF motor and the photosensor 160 fixed to the arm 171 is moved relative to the rotary scale 151. By the relative movement, the rotary encoder 150 outputs an A phase signal ENC-A and a B phase signal ENC-B having a period of, for example, T. The A phase signal ENC-A and the B phase signal ENC-B constituting the output signals of the rotary encoder 150 are inputted to the control portion 190. That is, the control portion 190 acquires the output signals of the rotary encoder 150 (S123).

Thereafter, the control portion 190 determines whether the rotary scale 151 is smeared (S124). When ink mist is deposited on the rotary scale 151 by a predetermined amount and the ink mist grows to a predetermined size, as shown by, for example, FIG. 47, portions D1, D2, D3 of adhering the ink mist are brought about at the second light transmitting portion 154*a*. Further, light transmitting through the second light transmitting portion 154*a* is blocked by the adhered portions D1, D2 and the light interception portion 154*m*. When the adhered portion (portion of intercepting light) is brought about, the period of the A phase signal ENC-A or the B phase signal ENC-B outputted from the rotary encoder 150 is varied. According to the embodiment, when the period of the A phase signal ENC-A or the B phase signal ENC-B outputted from the rotary encoder 150 is varied by a predetermined amount, it is determined that an adhered portion (portion of intercepting light) is brought about at the light emitting portion 162. Further, under the state, it is determined that smear of a constant amount or more is brought about at the rotary scale 151.

Further specifically, it is determined that the period (or frequency) of the A phase signal ENC-A or the B phase signal ENC-B when the photosensor 160 passes through the smear detecting pattern 154 is deviated from a range of ±x % (for example, ±15%) of a period of T (or frequency) constituting the base. When it is determined that the period is not deviated from the range of ±x % in the determination (case of No), successively, it is determined whether the phases of the outputted A phase signal ENC-A and the outputted B phase signal ENC-B are reversed (S125).

Further, when the determination is No at S125, the detected period is not deviated from the range of ±x % of the period T and the phases are not reversed and therefore, it is determined that an accurate position of the rotary encoder can be detected (that is, accurate reading can be carried out) in the smear detecting pattern 154 (step S126). That is, a sufficient size or amount of the adhering portion (portion of intercepting light) is not formed at the second light transmitting portion 154*a*, it is determined that the degree of smear is within an allowable range, and it is determined that position can be detected by the rotary encoder 150.

Successively, it is determined whether a time period of driving the PF motor 141 is equal to or longer than a set time period (step S127). When the time period of driving the PF motor 141 is less than the set time period, the operation returns to S123 to continue determination/processing at and after S123. Further, when the time period of driving the PF motor 141 is equal to or longer than the set time period, the PF motor 141 is stopped (step S128). Further, the photosensor 160 is moved to the outer diameter side by operating the sensor position switching mechanism 170 before or after stopping the PF motor 141. By the movement, the photosensor 160 is brought into the state of being opposed to the position detecting pattern 153 from the state of being opposed to the smear detecting pattern 154.

As described above, detection of smear is finished, thereafter, there is brought about a normal state of capable of detecting a pitch of feeding the rotary encoder 150.

Further, when the period of T1 of the A phase signal ENC-A or the B phase signal ENC-B is deviated from the range of ±x % of the period T at the step of S124 (case of Yes), or the phases of the A phase signal ENC-A and the B phase signal ENC-B are reversed (case of No), the operation is processed such that the second light transmitting portion 154*a* is formed with the sufficient side or amount of adhering portion (portion intercepting light). That is, the operation is processed such that accurate position cannot be detected by the rotary encoder 150 (S129). Also in this case, the operation proceeds to the step of S128 and stops the PF motor 141.

Further, a processing thereafter after having been processed at S129 is similar to that described at the step of S128 mentioned above.

According to the printer 110 having such a constitution, the rotary scale 151 is provided with the smear detecting pattern 154 alternately formed with the second light transmitting portion 154*a* and the second light interception portion 154*b* in addition to the position detecting pattern 153. Here, the state of detecting the position detecting pattern 153 by the photosensor 160 and the state of detecting the smear detecting pattern 154 are made to be able to be switched by moving the photosensor 160 by the sensor position switching mechanism 170. Therefore, when switched to the state of detecting the smear detecting pattern 154 by the photosensor 160, smear of the rotary scale 151 can be detected from a result of detection of light emitted from the light emitting portion 162 and transmitted through the second light transmitting portion 154*a* at the light receiving portion 164. Further, both of position detection and smear detection can be carried out by the single rotary scale 151. Further, by detecting smear, for example, presence or absence of a necessity of cleaning the rotary scale 151 can be confirmed or there can taken a measure for preventing erroneous operation of the printing head 138 which can be brought about by a failure in detecting the position owing to smear of the rotary scale 151.

Further, the smear detecting pattern 154 is disposed on the inner diameter side of the rotary scale 151 of the position detecting pattern 153. Therefore, although in the normal position detection, the photosensor 160 detects the position detecting pattern 153 disposed on the outer diameter side, in detecting smear, the photosensor 160 detects the smear detecting pattern 154 disposed on the inner diameter side. Thereby, the inner diameter side of the rotary scale 151 can effectively be utilized for detecting smear.

Further, by providing the sensor position switching mechanism 170, when the eccentric cam 173 is rotated, the distance between the cam face 173*a* brought into contact with the other end side of the arm 171 and the center of rotation is changed. Thereby, the arm 171 can be pivoted centering on the pivoting shaft 172, and the position of the photosensor 160 opposed to the rotary scale 151 can be switched.

Further, the second light transmitting portion 154*a* is formed with the light interception pattern 154*k*. Therefore, when the rotary scale 151 is smeared, at the second light transmitting portion 154*a*, in comparison with the first light transmitting portion 153*a*, the light amount of the transmitting light is reduced. Therefore, before bringing about erroneous detection by the photosensor 160 or the like, from a detection result at the light receiving portion 164 of light transmitted through the second light transmitting portion 154*a*, the degree of smear of the rotary scale 151 can be detected.

Further, as shown by FIG. 37, the light interception pattern 154*k* can be formed by the light interception portion 154*m* in the shape of the skewed line inclined to the tangential line direction of the rotary scale 151. When constituted in this way, smear of the rotary scale 151 can simply and pertinently be detected. Here, in a case in which the light interception pattern 154*k* is formed by a light interception portion along the tangential line direction of the rotary scale 151, when an optical axis of the light emitting portion 162 is varied along a diameter direction of the rotary scale 151, it is not possible to make the transmitting area of light of the second light transmitting portion 154*a* small or make the transmittivity of light low relative to those of the first light transmitting portion 153*a*. Further, when the light interception pattern 154*k* is formed by a light interception portion along a diameter direction of the rotary scale 151, it is difficult to determine a portion thereof constituting a boundary with the second light interception portion 154*b* and there is a concern of bringing about erroneous detection at the position detecting pattern 153. In contrast thereto, when the light interception portion 154*a* is formed skewedly, there is not brought about a drawback as in a case in which the light interception portion 154*m* is along the tangential direction or the diameter direction, and smear of the rotary scale 151 can simply and pertinently be detected.

Further, there may be constructed a constitution of providing the variable resistor 1620 for controlling to increase light emitting amount from the light emitting portion 162 when smear of the rotary scale 151 is detected. When constituted in this way, even in a case in which a constant amount or more of smear is brought about at the rotary scale 151, light from the light emitting portion 162 is made to be easy to transmit through the first light transmitting portion 153*a* by a simple constitution of increasing the light emitting amount from the light emitting portion 162. Therefore, service life of the position detecting device constituted by the rotary scale 151 or the like can be prolonged and the position of the printing head 138 can pertinently be detected over a long period of time.

Although the embodiment of the invention has been described as the above, the invention can variously be modified. A description will be given thereof as follows.

According to the above-described embodiment, the light interception pattern 154*k* is formed by the light interception portion 154*m* in a shape of a plurality of skewed lines. Otherwise, for example, as shown by FIG. 48(A), the A phase signal or the like constituting a digital signal may be generated by setting a predetermined threshold C to an output signal of the signal amplifying circuit 168. That is, the digital signal may be generated by outputting a high level signal when a value of the output signal is larger than the threshold C and outputting a low level signal when the value of the output signal is smaller than the threshold C. Smear of the rotary scale 151 in this case may be detected as follows.

An amount of light emitted from the light emitting portion 162 and transmitted through the first light transmitting portion 153*a* is larger than an amount of light transmitting through the second light transmitting portion 154*a*. Therefore, an analog signal SG11 is outputted from the signal amplifying circuit 168 when the photosensor 160 passes the portion formed with the position detecting pattern 153. Further, an analog signal SG12 at a level lower than that of the analog signal SG11 is outputted from the signal amplifying circuit 168 when the photosensor 160 passes through a portion formed with the smear detecting pattern 154 (refer to FIG. 48(A)).

Further, a digital signal SG13 shown in FIG. 48(B) is generated from the analog signal SG11 and the threshold C, and a digital signal SG14 shown in FIG. 48(C) is generated from the analog signal SG12 and the threshold C. Here, the larger the amount of transmitting light emitted from the light emitting portion 162 through the rotary scale 151, the longer the period of the high level of the digital signal and therefore, a period T11 of high level of the digital signal SG13 becomes longer than a period T12 of high level of the digital signal SG14. Further, when the rotary scale 151 is not smeared, a rate of the period T12 to the period T11 becomes, for example, 80%.

Here, when ink mist is uniformly adhered to the rotary scale 151, the levels of the analog signal SG11, the analog signal SG12 outputted from the signal amplifying circuit 168 are reduced by the same degree. For example, as shown by FIG. 48(D), the level is reduced from the analog signal SG11 to an analog signal SG21, and the level is reduced from the analog signal SG12 to an analog signal SG22. Further, as shown by FIG. 48(E), a period T21 of high level of a digital signal SG23 generated by the analog signal SG21 and the threshold C becomes shorter than the period T11. Further, as shown by FIG. 48(F), a period T22 of high level of a digital signal SG24 become shorter than the period T12.

Figure 48:
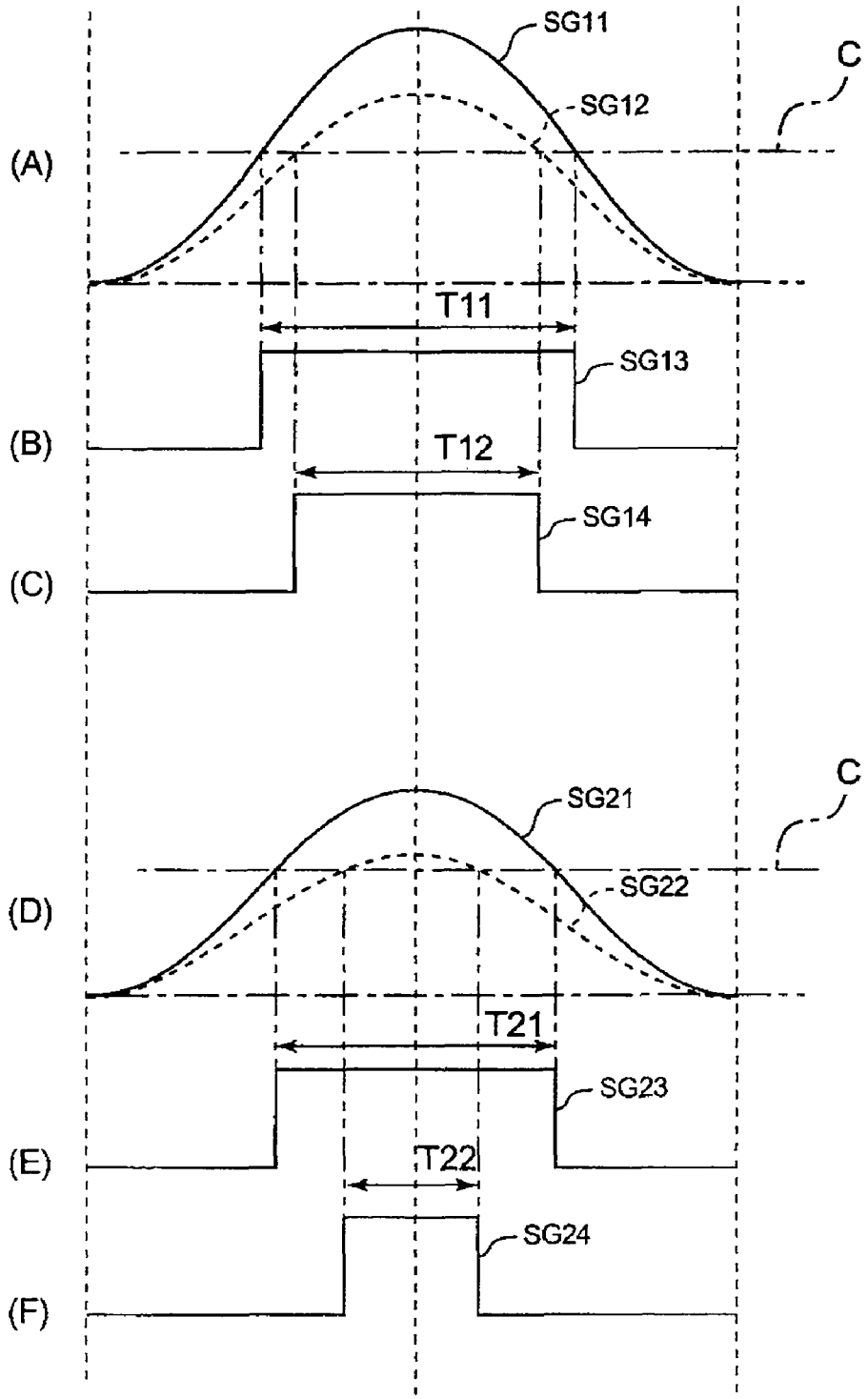
FIG. 48 illustrates explanatory diagrams of a method of detecting smear according to other embodiment of the invention.

In this case, as shown by FIG. 48, a rate of the period T22 to the period T21 becomes smaller than the rate of the period T12 to the period T11. For example, whereas the rate of the period T12 to the period T11 is 80%, the rate of the period T22 to the period T21 becomes 50%. Therefore, it can be determined that the rotary scale 151 is smeared when the rate of the period (for example, period T22) of the digital signal based on the smear detecting pattern 154 to the period (for example, period T21) of high level of the digital signal based on the smear detecting pattern 154 becomes equal to or smaller than a predetermined value when ink mist is adhered to the rotary scale 151. As described above, by setting the predetermined threshold C to the output signal of the signal amplifying circuit 168, when the digital signal is generated, smear of the rotary scale 151 can be detected by the above-described method. Further, smear of the rotary scale 151 can also be detected from a rate of reducing the period of high level of the digital signal based on the smear detecting pattern 154 relative to that in an initial state.

Further, by comparing an initial rate and a rate after a predetermined number of printed sheets or an elapse of a predetermined printing time period, it can be predicted how much service life by adhering ink mist remains.

Figure 49:
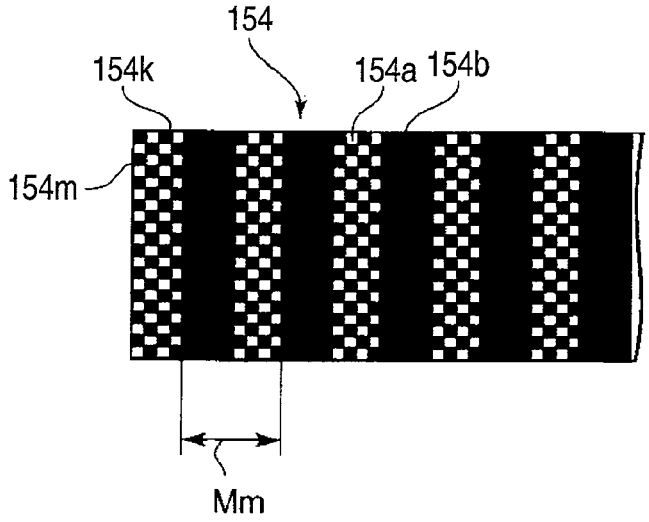
FIG. 49 is an enlarged view of a rotary scale having a light interception portion in a checker pattern.

Further, according to the above-described embodiment, the light interception pattern 154*k* is inclined to the tangential line direction of the rotary scale 151. However, as shown by FIG. 49, the light interception pattern 154*k* can also be formed by the light interception portion 154*m* in a rectangular shape arranged in a checker pattern along with the light transmitting portion in the rectangular shape. When constituted in this way, even when the light transmitting portion is constituted by the checker pattern when viewed microscopically, there is brought about a state in which the light transmitting portion is inclined to the tangential line direction of the rotary scale 151 when viewed macroscopically. Therefore, there can be prevented a drawback that it is difficult to determine a boundary portion with the second light interception portion 154*b* and erroneous detection is brought about in the position detecting pattern 153 as in a case in which the light interception portion 154*m* is in line with the tangential line direction, or as in a case in which by the position of the optical axis of the light transmitting portion 162, the transmitting area of light or the transmittivity of light of the second light transmitting portion 154*a* is varied, or the light interception portion 154*m* is in line with the diameter direction.

Figure 50:
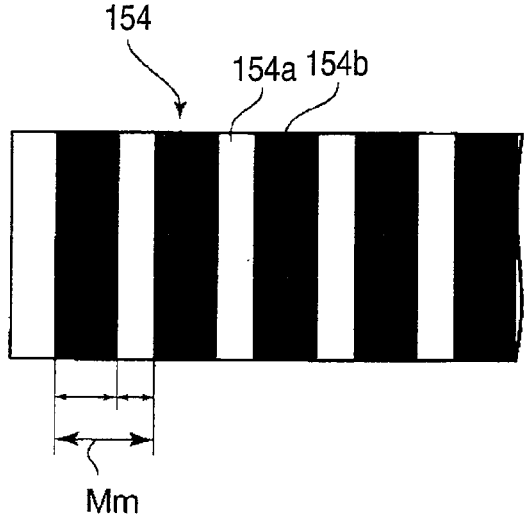
FIG. 50 is an enlarged view of a rotary scale having a second light transmitting portion having a narrow width.

Further, as shown by FIG. 50, a width of the second light transmitting portion 154*a* can be formed to be narrower than a width of the first light transmitting portion 153*a*. When constituted in this way, as the rotary scale 151 is smeared, at the second light transmitting portion 154*a*, in comparison with the first light transmitting portion 153*a*, light is made to be easy to be blocked. Therefore, the degree of smear of the rotary scale 151 can be detected from a result of receiving light at the second light transmitting portion 154*a* before light is blocked at the first light transmitting portion 153*a* and erroneous detection is brought about the rotary scale 151.

Further, as shown by FIG. 51 through FIG. 54, there can also be adopted a constitution in which the light interception pattern 154*k* is changed along the tangential line direction or the diameter direction of the rotary scale 151. When constituted in this way, at the second light transmitting portion 154*a* having a comparatively small transmitting area or a comparatively low transmittivity, light is blocked at a comparatively early stage by smear of the rotary scale 151. On the other hand, at the second transmitting portion 154*a* having a comparatively large transmitting area or a comparatively high transmittivity, light is blocked at a comparatively later stage. Therefore, the degree of smear brought about at the rotary scale 151 can easily be detected, and by detecting the degree of smear, a change over time of smear brought about at the rotary scale 151 can be grasped. As a result, a time period or the like until finally bringing about erroneous detection can be predicted and a limit of detection can be recognized.

Figure 51:
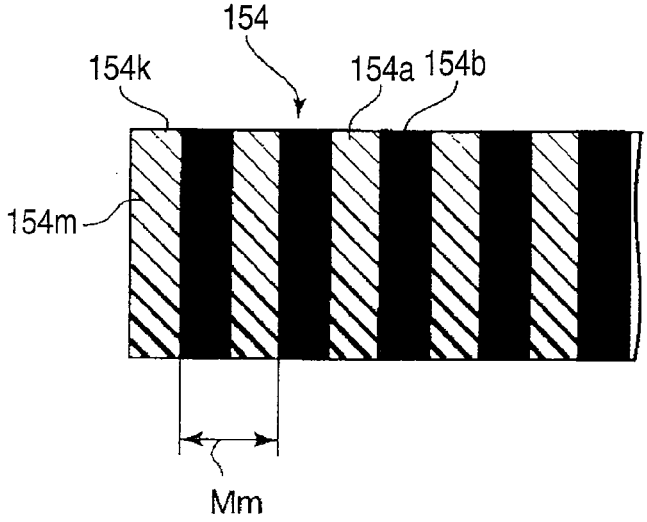
FIG. 51 is an enlarged view when a light interception portion in a shape of a skewed line is changed along a diameter direction.
Figure 52:
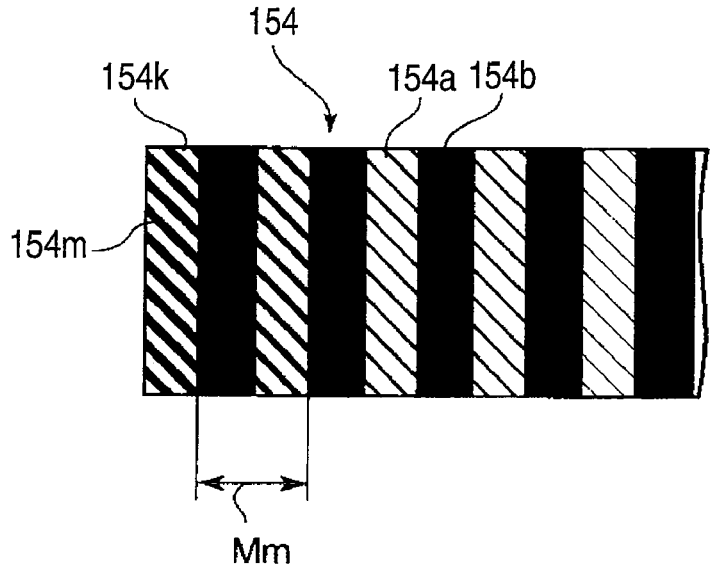
FIG. 52 is an enlarged view when a light interception portion in a shape of skewed line is changed along a tangential line direction.
Figure 53:
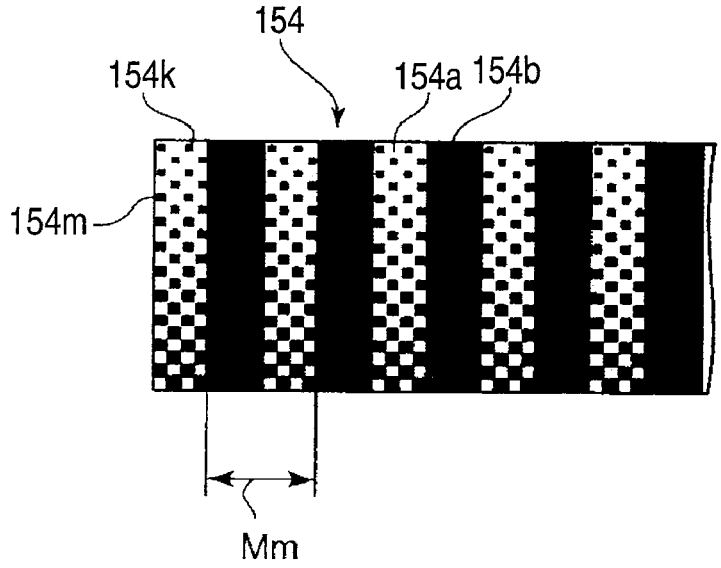
FIG. 53 is an enlarged view when a light interception portion in a checker pattern is changed along a diameter direction.
Figure 54:
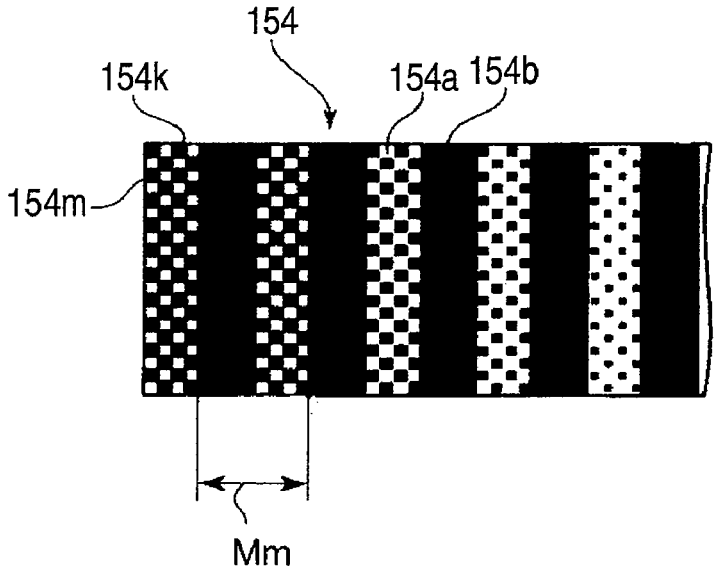
FIG. 54 is an enlarged view when a light interception portion in a checker pattern is changed along a tangential line direction.

Further, FIG. 51 shows a case in which the light interception portion 154*m* in the shape of the skewed line is changed along the diameter direction of the rotary scale 151, and FIG. 52 shows a case in which the light interception portion 154*m* in the shape of the skewed line is changed along the tangential line direction of the rotary scale 151. Further, FIG. 53 shows a case in which the light interception portion 154*m* in the checker pattern is changed along the diameter direction, and FIG. 54 shows a case in which the light interception portion 154*m* in the checker pattern is changed along the tangential line direction of the rotary scale 151.

Figure 55:
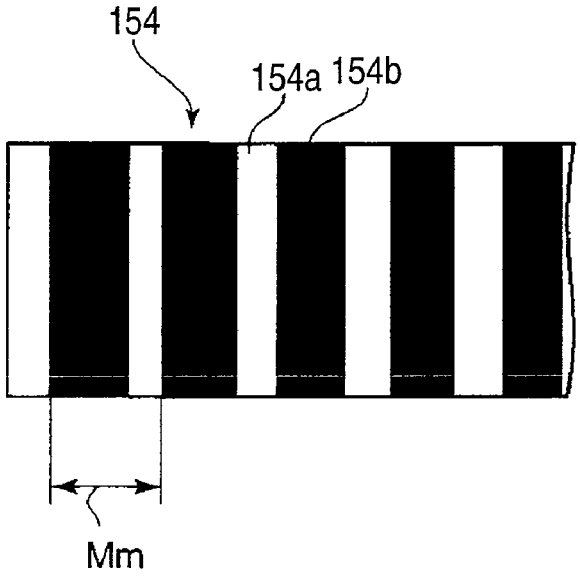
FIG. 55 is an enlarged view when a width dimension of a second light transmitting portion is changed along a tangential line direction.
Figure 56:
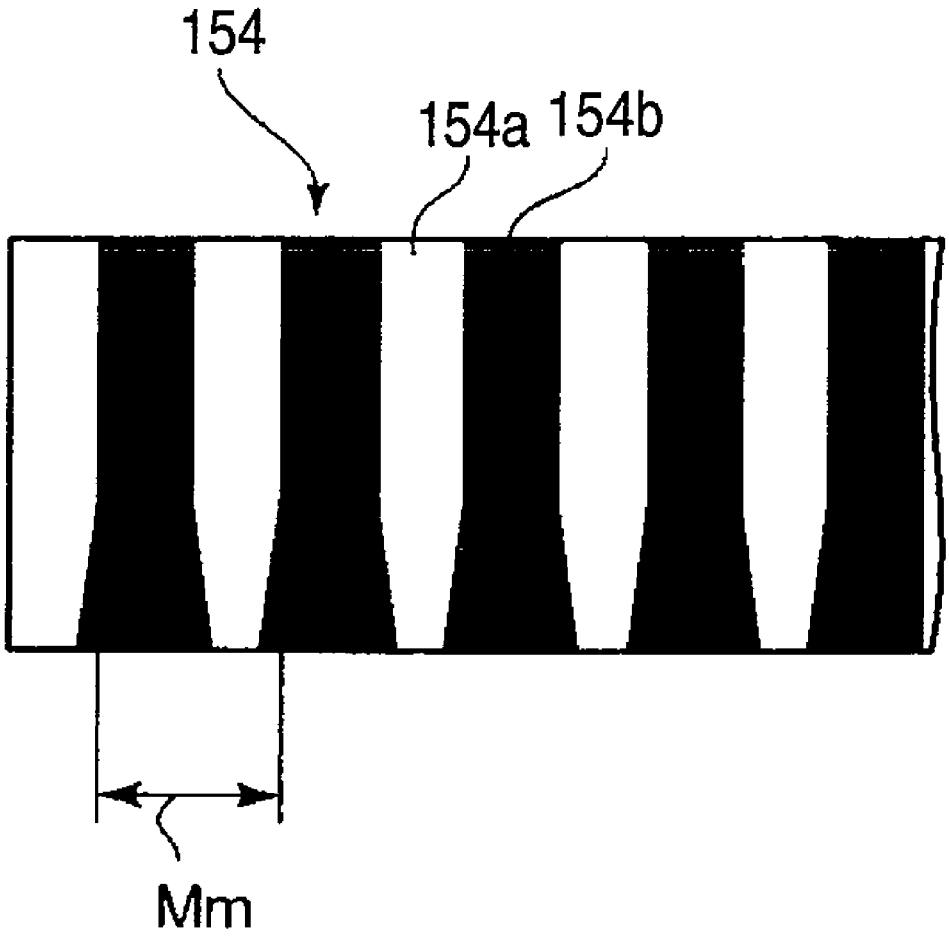
FIG. 56 is an enlarged view when a width dimension of a second light transmitting portion is changed along a diameter direction.

Further, as shown by FIG. 55 and FIG. 56, there can be adopted a constitution in which a width dimension of the second light transmitting portion 154*a* is changed along the tangential line direction or the diameter direction of the rotary scale 151. When constituted in this way, at the second light transmitting portion 154*a* having a comparatively narrow width, light is blocked by smear of the rotary scale 151 at a comparatively early stage, and at the second light transmitting portion 154*a* having a comparatively wide width, light is blocked at a comparatively later stage. Therefore, the degree of smear brought about at the rotary scale 151 can be detected and by detecting the degree of smear, a change over time of smear brought about at the rotary scale 151 can be grasped. As a result, a time period or the like until bringing about erroneous detection can be predicted and the detection limit can be recognized.

Further, FIG. 55 shows a case in which the width dimension of the second light transmitting portion 154*a* is changed along the tangential line direction of the rotary scale 151, and FIG. 56 shows a case in which the width dimension of the second light transmitting portion 154*a* is changed along the diameter direction of the rotary scale 151.

Further, according to the above-described embodiment, the sensor position switching mechanism 170 is constituted by the arm 171, the pivoting shaft 172, the eccentric cam 173, the pressing spring 174. However, the constitution of the sensor position switching mechanism 170 is not limited thereto but can variously be changed. For example, there may be constructed a constitution in which a rack gear is attached to the photosensor 160 and a pinion gear is provided to a final stage of a gear train. At this occasion, when the pinion gear is provided at a fixed portion, the photosensor 160 can be moved between the position detecting pattern 153 and the smear detecting pattern 154.

Although according to the above-described embodiment, a description has been given of the constitution in which the smear detecting pattern 154 is disposed on the inner diameter side of the position detecting pattern 153, there may be adopted a constitution in which the smear detecting pattern 154 is disposed on the outer diameter side of the position detecting pattern 153.

Further, according to the above-described embodiment, the smear detecting pattern 154 is provided over a total periphery in a peripheral direction of the rotary scale 151. However, there may be adopted a constitution in which the smear detecting pattern 154 is provided only at a portion in the peripheral direction of the rotary scale 151. Further, the smear detecting pattern 154 may be constituted by a portion on the inner diameter side of the position detecting pattern 153.

Further, although in the above-described embodiment, an explanation has been given of the printer 110 as the liquid ejecting apparatus, and the printer 110 provided with the position detecting device, the liquid ejecting apparatus is not limited to the printer 110, further, also the apparatus provided with the position detecting device is not limited to the printer 110. The liquid ejecting apparatus provided with the position detecting device is applicable to various liquid ejecting apparatus applying the ink jet technology of a color filter fabricating apparatus, a dying apparatus, a micromachining apparatus, a semiconductor machining apparatus, a surface machining apparatus, a three-dimensional forming apparatus, a liquid vaporizing apparatus, an organic EL fabricating apparatus (particularly, polymer EL fabricating apparatus), a display fabricating apparatus, a film forming apparatus, a DNA chip fabricating apparatus and the like. Further, liquids delivered by the liquid ejecting apparatus are changed in accordance with the respective apparatus, for example, there are a metal material, an organic material, a magnetic material, a conductive material, a wiring material, a film forming material, various machining fluids and the like.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application Nos. 2005-281514 filed on Sep. 28, 2005, 2005-277274 filed on Sep. 26, 2005, 2005-277275 filed on Sep. 26, 2006 and 2005-295966 filed on Oct. 11, 2006, the contents of which are incorporated herein for reference.

What is claimed is:

1. A position detecting device for detecting a position of an object, comprising:

a light emitting portion that emits light;

a light receiving portion that receives the light from the light emitting portion;

a scale that is arranged between the light emitting portion and the light receiving portion, and includes a position detecting pattern and a smear detecting pattern;

a control portion which determines position from the position detecting pattern and determines smear from the smear detecting pattern; and a sensor position switching unit that moves a photosensor having the light emitting portion and the light receiving portion to switch a state of detecting the position detecting pattern and a state of detecting the smear detecting pattern, wherein the position detecting pattern has a first light transmitting portion for transmitting the light from the light emitting portion and a first light interception portion for intercepting the light from the light emitting portion which are alternately arranged in a detection range of the object; and wherein the smear detecting pattern for detecting smear of the scale has a second light transmitting portion for transmitting the light from the light emitting portion and a second light interception portion for intercepting the light from the light emitting portion which are alternately arranged.

2. The position detecting device according to claim 1, wherein the scale is a rotary scale having a circular plate shape; and wherein the smear detecting pattern is arranged at an inner diameter side of the rotary scale with respect to the position detecting pattern.

3. The position detecting device according to claim 1, wherein the second light transmitting portion is formed with a light interception pattern so that a light transmitting area of the second light transmitting portion into which the light from the light emitting portion transmits is smaller than that of the first light transmitting portion or a light transmittivity in the second light transmitting portion is smaller than a light transmittivity in the first light transmitting portion.

4. The position detecting device according to claim 3, wherein the light interception pattern is changed so that the light transmitting area or the light transmittivity in the smear detecting pattern is changed.

5. The position detecting device according to claim 3, wherein the scale is a rotary scale having a circular plate shape; and wherein the light interception pattern includes a light interception portion having a rectangular shape, the light interception portion being inclined to a tangential line direction of the rotary scale.

6. The position detecting device according to claim 3, wherein the light interception pattern includes a light interception portion in a rectangle shape and a light transmitting portion in a rectangle shape which are arranged in a checker pattern.

7. The position detecting device according to claim 1, wherein the second light transmitting portion is smaller in width than the first light transmitting portion.

8. The position detecting device according to claim 1, further comprising a light amount controlling unit that controls to increase an amount of the light emitted from the light emitting portion when smear of the scale is detected.

9. The position detecting device according to claim 1, wherein the sensor position switching unit includes:

an arm which supports the photosensor at one end side thereof;

an eccentric cam which has a cam face in which a distance from a center of rotation is changed in accordance with a rotational position, the cam face being brought into contact with other end side of the arm; and a pivoting shaft which is disposed between the one end side and the other end side of the arm for supporting the arm pivotably.

10. A liquid ejecting apparatus comprising:

the position detecting device according to claim 1; and a liquid ejection portion that ejects a liquid to a medium.

11. A method of detecting smear of a scale having a position detecting pattern and a smear detecting pattern of a position detecting device, the method comprising:

detecting the scale by a photosensor while the photosensor is relatively moved with respect to the scale;

obtaining a signal detected by the photosensor;

determining position from the position detecting pattern and determining the smear of the scale from the smear detecting pattern; and moving the photosensor to switch a state of detecting the position detecting pattern and a state of detecting the smear detecting pattern.

12. The method according to claim 11, wherein it is determined that the scale is smeared when a period or a frequency of a part of the signal corresponding to the smear detecting pattern is deviated from a predetermined range of a basis period or a basis frequency.

13. The method according to claim 11, wherein it is determined that the scale is smeared when a phase of the signal corresponding to the smear detecting pattern is reversed.

14. The method according to claim 11, further comprising:

performing at least one of operations when it is determined that the scale is smeared, the operations being as follows;

halting a liquid ejecting operation of a liquid ejecting apparatus provided with the position detecting device;

setting an upper limit of a moving speed of the carriage provided with the photosensor so as to move the carriage slower than that of the carriage at the detecting time;

increasing an light amount emitted from the photosensor for detecting the scale;

moving down the scale relative to the photosensor to detect other area in the scale; and cleaning the scale.

* * * * *